US010328590B2

(12) United States Patent
Bormann et al.

(10) Patent No.: US 10,328,590 B2
(45) Date of Patent: Jun. 25, 2019

(54) DEVICE FOR TREATING SUBSTRATES

(71) Applicant: KOENIG & BAUER AG, Würzburg (DE)

(72) Inventors: Gunar Bormann, Oberhermsdorf (DE); Johannes Naumann, Weinböhla (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 15/777,945

(22) PCT Filed: Nov. 23, 2016

(86) PCT No.: PCT/EP2016/078594

§ 371 (c)(1),
(2) Date: Aug. 21, 2018

(87) PCT Pub. No.: WO2017/089423

PCT Pub. Date: Jun. 1, 2017

(65) Prior Publication Data

US 2018/0339416 A1 Nov. 29, 2018

(30) Foreign Application Priority Data

Nov. 23, 2015 (DE) ..... 10 2015 223 105
Nov. 23, 2015 (DE) ..... 10 2015 223 106
May 30, 2016 (DE) ..... 10 2016 209 337

(51) Int. Cl.
*B26D 1/40* (2006.01)
*B26D 7/01* (2006.01)
(Continued)

(52) U.S. Cl.
CPC ..... *B26D 1/405* (2013.01); *B26D 7/018* (2013.01); *B26D 7/18* (2013.01); *B26D 7/1854* (2013.01);
(Continued)

(58) Field of Classification Search
CPC ..... B26D 7/1863; B26D 7/018; B26D 7/18; B26D 7/1854; B26D 7/265;
(Continued)

(56) References Cited

U.S. PATENT DOCUMENTS 2,594,804 A 4/1952 Ringel
3,404,607 A 10/1968 Feick et al.
(Continued)

FOREIGN PATENT DOCUMENTS

DE 2109237 A1 9/1972
DE 1786548 A1 2/1973
(Continued)

OTHER PUBLICATIONS

International Search Report of PCT/EP2016/078594 dated May 11, 2017.

*Primary Examiner* — David H Bollinger
(74) *Attorney, Agent, or Firm* — Mattingly & Malur, PC

(57) ABSTRACT

A device for treating substrates has a separation system, with which processed substrates can be separated into one or more waste parts and at least one blank. The device for treating substrates offers improved flexibility. The separation system comprises a transport cylinder and a stripping cylinder associated therewith. The transport cylinder is able to secure replaceable packing, along with first and second openings which, when the packing is secured, are covered at least partially by perforations that may be formed in the packing. A first air supply supplies air to the first openings and a second air supply supplies air to the second openings independently of the supply of the air to the first openings. The first and the second air supply are switchable between a suction air supply and a blower air supply.

15 Claims, 42 Drawing Sheets

(51) Int. Cl.

| | |
|---|---|
| ***B26D 7/18*** | (2006.01) |
| ***B26D 7/26*** | (2006.01) |
| ***B26F 1/00*** | (2006.01) |
| ***B26F 1/38*** | (2006.01) |
| ***B41F 19/00*** | (2006.01) |
| ***B31B 50/16*** | (2017.01) |
| ***B31B 50/14*** | (2017.01) |
| ***B41F 13/08*** | (2006.01) |
| ***B41F 13/193*** | (2006.01) |
| ***B41F 13/54*** | (2006.01) |
| ***B41F 13/56*** | (2006.01) |
| ***B41F 21/00*** | (2006.01) |
| ***B41F 21/10*** | (2006.01) |
| ***B41F 27/00*** | (2006.01) |
| ***B41F 27/10*** | (2006.01) |
| ***B65H 35/08*** | (2006.01) |
| ***B65H 29/24*** | (2006.01) |
| ***B65H 29/56*** | (2006.01) |
| ***B65H 31/24*** | (2006.01) |
| ***B65H 20/12*** | (2006.01) |
| *B26F 1/44* | (2006.01) |
| *B65H 3/10* | (2006.01) |

(52) U.S. Cl.

CPC ..... *B26D 7/1863* (2013.01); *B26D 7/265* (2013.01); *B26F 1/0092* (2013.01); *B26F 1/384* (2013.01); *B31B 50/146* (2017.08); *B31B 50/16* (2017.08); *B41F 13/08* (2013.01); *B41F 13/193* (2013.01); *B41F 13/54* (2013.01); *B41F 13/56* (2013.01); *B41F 19/008* (2013.01); *B41F 21/00* (2013.01); *B41F 21/10* (2013.01); *B41F 27/00* (2013.01); *B41F 27/10* (2013.01); *B65H 20/12* (2013.01); *B65H 29/242* (2013.01); *B65H 29/56* (2013.01); *B65H 31/24* (2013.01); *B65H 35/08* (2013.01); *B26D 2007/2607* (2013.01); *B26F 2001/4418* (2013.01); *B65H 3/10* (2013.01); *B65H 2301/42632* (2013.01); *B65H 2402/10* (2013.01); *B65H 2406/323* (2013.01); *B65H 2801/21* (2013.01); *B65H 2801/27* (2013.01)

(58) Field of Classification Search

CPC ..... B26D 2007/2607; B65H 20/12; B26F 1/0092; B26F 2001/4418; B41F 19/008; B31B 2201/143

See application file for complete search history.

(56) References Cited

U.S. PATENT DOCUMENTS

| | | | |
|---|---|---|---|
| 5,865,433 | A | 2/1999 | Morrissette |
| 6,205,899 | B1 | 3/2001 | Blumle et al. |
| 8,007,425 | B2 | 8/2011 | Scheu |
| 2008/0176728 | A1 | 7/2008 | Scheu |

FOREIGN PATENT DOCUMENTS

| | | | |
|---|---|---|---|
| DE | 214566 | A | 10/1984 |
| DE | 4013116 | A1 | 11/1991 |
| DE | 878277 | A2 | 11/1998 |
| DE | 19841834 | A1 | 3/2000 |
| DE | 10147486 | A1 | 6/2002 |
| DE | 10300234 | B3 | 7/2004 |
| DE | 10300235 | A1 | 7/2004 |
| DE | 202004018764 | U1 | 3/2005 |
| DE | 10356405 | A1 | 6/2005 |
| DE | 10356413 | A1 | 6/2005 |
| DE | 102004058597 | A1 | 7/2005 |
| DE | 102004058598 | A1 | 8/2005 |
| DE | 102004058599 | A1 | 8/2005 |
| DE | 102004058600 | A1 | 8/2005 |
| DE | 102004058601 | A1 | 8/2005 |
| DE | 102007003592 | B3 | 7/2008 |
| DE | 102007031059 | A1 | 1/2009 |
| DE | 102007031060 | A | 1/2009 |
| DE | 102008054420 | A1 | 6/2009 |
| DE | 102005039773 | B4 | 12/2011 |
| EP | 0117623 | A2 | 9/1984 |
| EP | 0281064 | A1 | 9/1988 |
| EP | 1759843 | A2 | 3/2007 |
| EP | 2011646 | A2 | 1/2009 |
| EP | 2399835 | A1 | 12/2011 |
| EP | 2222471 | B1 | 2/2014 |
| GB | 969753 | A | 9/1964 |
| GB | 1050360 | A | 12/1966 |
| WO | 2006/117646 | A1 | 11/2006 |

DEVICE FOR TREATING SUBSTRATES

CROSS REFERENCE TO RELATED APPLICATIONS

This application is the U.S. National Phase, under 35 U.S.C. § 371, of PCT/EP2016/078594, filed Nov. 23, 2016; published as WO 2017/089423A1 on Jun. 1, 2017 and claiming priority to DE 102015223105.4, filed Nov. 23, 2015; to DE 102015223106.2, filed Nov. 23, 2015 and to DE 102016209337.1 filed May 30, 2016, the disclosures of which are expressly incorporated herein by reference in their entireties.

FIELD OF THE INVENTION

The present invention relates to a device for treating substrates using a separation system, with which processed substrate can be separated into at least one waste part and at least one blank. The substrates are understood in particular to be in the form of sheets, which preferably are or can be printed. Such substrates are processed by one or more processing operations such as printing and/or coating and/or varnishing and/or cutting and/or punching and/or embossing and/or creasing and/or perforating.

BACKGROUND OF THE INVENTION

DE 40 13 116 A1 discloses a method for stacking flat blanks of cardboard or the like, in which the blanks arrive on a first conveyor, are transferred to a second conveyor in the same conveyor plane and for a time at the same conveyor speed, and are conveyed in at least one linear shingled stream, being conveyed intermittently at a higher speed on the second conveyor and discharged over the end of the second conveyor onto a pile situated directly downstream and against a stop, forming a pile of blanks lying horizontally and flat, one on top of another.

DE 103 56 405 A1 describes a device for processing and finishing, e.g. for cutting, punching, embossing, film transfer and/or coating, of printed paper, cardboard, cardboard packaging, corrugated board and plastics by means of a rotary operation, in which the substrate can be inserted in the direction of feed between a rotating impression processing roller and a rotating processing roller, the substrate being processed as it passes through the working nip by means of tool parts that are active therein. A delivery conveyor belt for formless substrates having an approximately horizontal orientation is arranged directly downstream of the processing roller.

This device is configured exclusively for processing web-type substrates.

DE 103 56 413 A1 describes a device for processing and finishing printed paper or similar web-type substrates by means of a rotary operation, in which the substrate can be inserted in the direction of feed between a rotating impression processing roller and a rotating processing roller and is processed as it passes through the working nip by means of tool parts that are active therein. The impression processing roller is arranged substantially adjacent to the processing roller, and a delivery conveyor belt with an approximately horizontal orientation for formless substrates is arranged directly downstream of the processing roller. The processing roller is configured as double-sized and has grippers. The guidance of the substrates on the circumferential surface of the processing roller in the regions spaced apart from the gripper is not variably adjustable for different substrate formats.

DE 20 2004 018 764 U1 discloses a device for processing and finishing printed and/or coated sheet-type substrates, in particular, e.g. for punching by means of a rotary operation, in which the substrate can be inserted in the direction of feed between two rotating processing rollers and is processed as it passes through the working nip by means of tool parts that are active therein, wherein a processing roller having at least one gripper is provided for a register-true transport of the web-type substrate, and a gripper support and/or gripper anvil is formed as a suspended cam for the tool part, which is embodied as a die plate.

This device is configured exclusively for the use of die plates having recesses that correspond to the suspended cams.

DE 10 2004 058 597 A1 discloses a device for processing and finishing printed sheet-type substrates by means of a rotary punching operation, in which the substrate can be inserted between two rotating processing rollers and undergoes processing, wherein one processing roller has a gripper for the register-true transport of the substrate and at certain positions, one of the processing rollers has pins on its surface for receiving waste cutouts.

The substrates are guided in the regions spaced part from the gripper on the circumferential surface of the processing roller by using a plurality of mechanically moving individual parts and is susceptible to soiling.

DE 10 2004 058 598 A1 discloses a tool part in a device for processing and finishing printed and/or coated sheet-type substrates, in particular, e.g. for punching by means of a rotary operation, in which the substrate can be inserted between two rotating processing rollers and is processed during its passage through the working nip by means of tool parts that are active therein, wherein one processing roller has a gripper for register-true transport of the substrate, and the tool part profiled as a female die has perforations on its periphery.

This tool part has a complex configuration, and also has openings in addition to profilings.

DE 10 2004 058 599 A1 discloses a device for the processing and finishing of printed sheet-type substrates, printed paper or the like by means of a rotary punching operation, in which the substrate can be inserted in the direction of feed between two rotating processing rollers, wherein each processing roller has a gripper for register-true transport of the substrate. Two additional processing rollers are assigned to the processing roller at the 12 o'clock position and the 10 o'clock position.

This device has a comparatively complex configuration due to the multitude of processing rollers.

DE 10 2004 058 600 A1 discloses a device for processing and finishing printed sheet-type substrates using two processing rollers. Arranged adjacent to one of the processing rollers is a conveyor belt having a form-specific configuration and aligned approximately horizontally.

DE 10 2004 058 601 A1 discloses a device for processing and finishing printed sheet-type substrates using two processing rollers. Arranged adjacent to one of the processing rollers is a conveyor belt, aligned approximately horizontally. The conveyor belt is acted upon by suction air, and one of the processing rollers is acted upon by blower air.

DE 10 2005 039 773 B4 discloses a device for supplying and removing a packing.

DE 101 47 486 A1 discloses a punching or cutting device having a magnetic cylinder and a suction device located adjacent to the magnetic cylinder for removing punched-out pieces of material by suction.

DE 103 00 234 B3, DE 103 00 235 A1, DE 1 786 548 A1 and EP 2 399 835 A1 each disclose a machine for processing web-type substrates.

DE 10 2007 003 592 B3 and U.S. Pat. No. 5,865,433 A disclose a suction roller for transporting material blanks.

EP 0 281 064 A1, WO 2006/117646 A1, DE 1 486 958 A and GB 969,753 A disclose devices for treating substrates comprising separation systems.

EP 0 878 277 A2 discloses a device in which waste parts are separated from pre-punched webs and the blanks continue to be conveyed with the frame for a short time.

DD 214 566, U.S. Pat. No. 2,594,804 and GB 1 050 360 A disclose a device for stripping pre-punched pieces of material.

U.S. Pat. No. 3,404,607 relates to a device for processing substrates having stripping and transport cylinders.

EP 0 117 623 A2 discloses a method for treating substrates.

EP 2 222 471 B1 discloses a modular film unit.

DE 10 2007 031 060 A1 and DE 10 2007 031 059 A1 disclose a sheet-fed rotary printing machine having a separation device.

SUMMARY OF THE INVENTION

The object of the present invention is to create a device for treating substrates, with which it is possible to separate processed substrates into one or more waste parts and at least one blank. In particular, the object of the invention is to create a device for treating substrates that will offer improved flexibility.

This object is achieved by a device for treating substrates and having a separation system, with which process substrates can be separated into at least one waste part and at least one blank. The separation system comprises a transport cylinder and a stripping cylinder associated therewith. The transport cylinder is able to secure a replaceable packing, along with first and second openings, which openings, when the packing is secured, are at least partially covered by perforations that may be formed in the packing. First air supply means for supplying air to the first openings, and second air supply means for supplying air to the second openings, independently of the supply of air to the first openings, are provided. The first and/or the second air supply means are switchable between a suction air supply and a blower air supply.

The advantages that can be achieved with the invention consist in that an effective and/or reliable separation of substrates into at least one waste part and at least one blank is accomplished, while minimizing the machine complexity required for this purpose.

In one embodiment of the invention, it is advantageous in particular that the separation system treats already processed substrate, in particular separating it into at least one waste part and at least one blank, with the substrate undergoing processing, in particular cutting, punching, creasing or perforating, by means of tool parts that are active in the cylinder nip of two processing rollers disposed upstream of the separation system. The functional stability of the device for treating substrates is increased by the performance of separation, also referred to as stripping, and processing at different locations. Likewise advantageous, in particular, is that the provision of two air supply means for supplying air separately to first and second openings combined with the ability to switch between suction air supply and blower air supply results in a reliable transport of waste parts and/or blanks and a reliable release at the locations provided for this purpose.

In the case of a device for treating substrates that comprises a gripper system for securing the leading edges of sheet-type substrate, embodied as a suction gripper system, it is advantageous in particular that substrate sheets or waste parts, referred to as grid, can be transported reliably until being released at the locations intended for this purpose. The suction gripper system has a relatively simple configuration as compared with mechanical gripper systems, in particular clamping grippers. The formation of the suction gripper system for register-true transport can advantageously be omitted. With the latter device, it is also advantageous in particular that the suction gripper system is associated with the means for securing the packing, and vice-versa. This advantageously achieves the result that the number of moving parts is minimized. With a minimal space requirement, the functions of securing the packing and holding the leading edges of the sheet-type substrate and/or grids are implemented in a simple manner that also has functional stability. In a preferred embodiment of the invention, the suction air required for operation of the suction gripper system is already available on the transport cylinder and can also be used advantageously for holding waste parts and/or blanks on the circumferential surface of the transport cylinder.

In one embodiment of the device for treating substrates having a separation system which comprises a transport cylinder with which a revolving conveyor belt is associated, it is advantageous in particular that the conveyor belt reliably receives the waste parts or blanks from the transport cylinder. If the conveyor belt is associated directly with the transport cylinder and together with the transport cylinder forms a transfer point or transfer region, in particular in the form of a tangency point or a wrap angle, the conveyor belt can advantageously support the removal of the waste parts or blanks. The latter is true in particular if the conveyor belt is a suction belt. With the latter device, it is further advantageous, in particular, that the transfer of waste parts or blanks from the transport cylinder to the conveyor belt is supported by the application of blower air to the circumferential surface of the transport cylinder, i.e. in particular to the openings in the packing secured on the transport cylinder. It is likewise advantageous for the transfer of waste parts or blanks from the transport cylinder to the conveyor belt to be accomplished solely by the application of blower air to the circumferential surface of the transport cylinder, and for the conveyor belt to be formed without openings that are acted on by suction air, i.e. not as a suction belt.

In the case of a device for treating substrates having a separation system which comprises a transport cylinder and a stripping cylinder associated with the transport cylinder, with which stripping cylinder a revolving conveyor belt is associated, one advantage, in particular, lies in the flexible usability of the device. If the conveyor belt is associated directly with the stripping cylinder and together with the stripping cylinder forms a transfer point or a transfer region, in particular in the form of a tangency point or a wrap angle, the conveyor belt can advantageously support the removal of the waste parts or blanks. The conveyor belt is preferably associated with the stripping cylinder such that they are in contact. The latter is true in particular if the conveyor belt is a suction belt. With the device last mentioned, it is additionally advantageous, in particular, that the transfer of waste parts or blanks from the stripping cylinder to the conveyor belt is supported by the application of blower air to the circumferential surface of the stripping cylinder, i.e., in particular to the openings of the packing secured on the transport cylinder. It is likewise advantageous for the transfer of waste parts or blanks from the stripping cylinder to the conveyor belt to be induced solely by the application of blower air to the circumferential surface of the transport cylinder, and for the conveyor belt to be formed without openings that are acted upon by suction air, i.e. not as a suction belt.

BRIEF DESCRIPTION OF THE DRAWINGS

Exemplary embodiments of the invention are illustrated in the drawings and will be described in greater detail below.

In the drawings.

DESCRIPTION OF PREFERRED EMBODIMENTS

Figure 1:
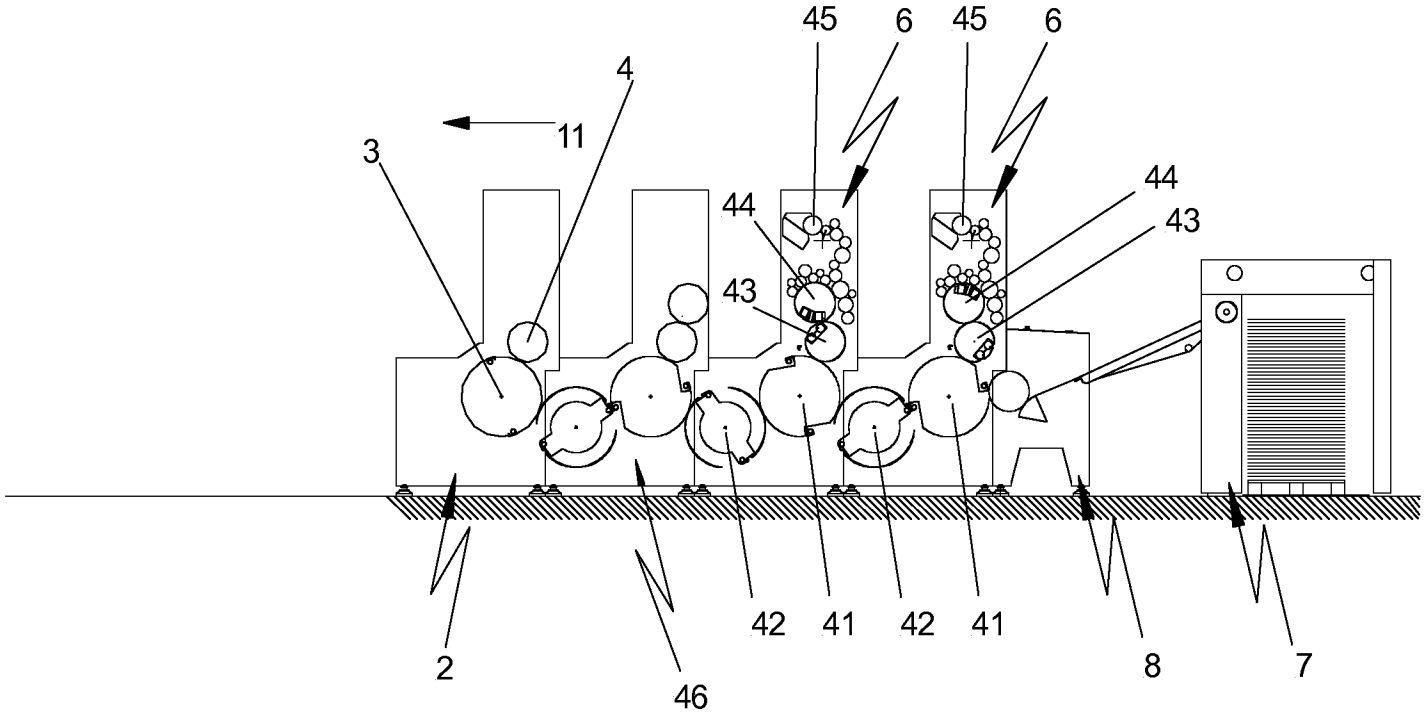
FIG. 1 shows a schematic diagram of a sheet processing machine with a schematic diagram of a device for treating substrates

The device for treating substrates 1 having a separation system 2, with which processed substrate 1 can be separated into at least one waste part 9 and at least one blank 10, may be embodied as an independent machine, and in this case has a feed system for substrate 1, not described in greater detail here.

According to another embodiment, separation system 2 is part of a substrate processing machine, in particular a sheet processing machine, and is operated in-line with the units of the sheet processing machine. A sheet processing machine is understood, in particular, to be a sheet-fed printing machine, such as that illustrated, e.g. in FIG. 1. In the following, the invention will be described by way of example in reference to a sheet-fed printing machine, in particular an offset sheet-fed printing machine, although this description is also intended to apply similarly to other sheet processing machines as well as to an embodiment of the device as an autonomous machine.

The sheet-fed printing machine comprises a feeding system, also referred to as feed unit 7, for substrates 1. Substrates 1 are understood, in particular, to be sheet-type materials made of paper, paperboard, cardboard, corrugated cardboard, plastic or the like, preferably printed or printable. Substrates 1 are present in the form of piles in feed unit 7 of the sheet-fed printing machine and are separated from the pile and fed to the units of the sheet-fed printing machine downstream of feed unit 7 via an acceleration system 8. The sheet-fed printing machine comprises at least one and preferably a plurality of printing units 6. Printing units 6 each comprise in particular a printing cylinder 41 and a sheet-guiding cylinder 42, preferably embodied as a transfer drum 42. A rubber blanket cylinder 43 that carries a rubber blanket is associated with printing cylinder 41, and a plate cylinder 44 that carries a printing plate is in turn associated with the rubber blanket cylinder. Plate cylinder 44 is in contact with an inking unit 45 and preferably also with a dampening unit. In printing unit 6, substrate sheet 1 is guided in a manner known per se by the sheet holding systems provided on printing cylinder 41 and sheet guiding cylinder 42, printed in the printing nip formed between printing cylinder 41 and rubber blanket cylinder 43, and transferred to the next unit of the sheet-fed printing machine, e.g. in the form of next printing unit 6. One or more processing units 46 may be formed downstream of printing unit(s) 6 or between printing units 6. Processing units 46 preferably comprise two processing cylinders 96, 97, one of which, preferably the lower one, has a sheet holding system, and the other of which, preferably the upper one, has a tool carrier. The sheet holding system of processing cylinder 96 may be embodied as a clamping gripper system or as a suction gripper system. Its function is preferably identical to that of the gripper system (clamping gripper system or suction gripper system) of transport cylinder 3, the description of which is herewith referenced.

The processing cylinders are assigned to one another, forming a cylinder nip. At least one of the processing cylinders carries a tool. In the simplest case, a pair of processing cylinders is formed by printing cylinder 41 and rubber blanket cylinder 43 of a printing unit 6. In that case, a printing unit 6 functions as processing unit 46. The clamping device for the rubber blanket is used for fastening the tool onto rubber blanket cylinder 43 in that case.

The processing cylinders may be configured in various ways.

According to one embodiment, which is suitable in particular for punching and perforating applications, the upper processing cylinder is embodied as a fully magnetic cylinder or as a carrier cylinder having magnetic segments for receiving magnetic sheets or magnetic plates, and the lower processing cylinder is embodied as a surface-hardened cylinder or as having a hardened metal plate attached to it.

According to another embodiment, which is suitable in particular for embossing or creasing or grooving applications, the upper processing cylinder is embodied as a fully magnetic cylinder or as a carrier cylinder having magnetic segments for receiving magnetic sheets or magnetic plates, and the lower processing cylinder is embodied as a surface-hardened cylinder or as having a hardened metal plate attached to it or as having a metal plate with hard rubber/plastic.

In any case, the lower processing cylinder may be provided with tool carriers or packing carriers that operate mechanically, in particular in a form-fitting or force-locking manner. The force-locking tool carriers or packing carriers are embodied in particular with a magnetic action.

According to a further preferred embodiment, the device for treating substrates 1, which may be embodied as a sheet processing machine or as a component thereof, may be in particular a processing unit 46, and a first and a second processing cylinder 96, 97. Substrate sheets 1 can be inserted between a first and a second processing cylinder 96, 97, and are processed in passing through the cylinder nip between the processing cylinders 96, 97. First processing cylinder 96 has a sheet holding system. First and/or second processing cylinder(s) 96, 97 has/have a tool carrier for receiving a tool or a tool part, preferably from the group composed of cutting tools, punching tools, creasing tools, perforating tools or grooving tools. An impression cylinder 98, which is in surface contact with second processing cylinder 97, is associated with the second processing cylinder 97 on the side thereof that faces away from first processing cylinder 96.

Impression cylinder 98 is associated with processing cylinder 97 in such a way that, when processing cylinder 97 undergoes deflection such as occurs during processing of substrate sheets 1 in the nip between the two processing cylinders 96, 97, the resulting deflecting force of second processing cylinder 97 acts on impression cylinder 98, preferably at or near the center thereof. As seen geometrically, the midpoints of the first and second processing cylinders 96, 97 and of impression cylinder 98 preferably lie on an imaginary straight line, or the midpoints of second processing cylinder 97 and of impression cylinder 98 lie on a straight line that is inclined by an angle of less than or equal to 10 degrees with respect to a straight line on which the midpoints of the first and second processing cylinders 96, 97 lie.

Impression cylinder 98 may have the same diameter as second processing cylinder 97.

Likewise, impression cylinder 98 and second processing cylinder 97 may have bearer rings which are in rolling contact with one another. It is also possible for the surface contact between impression cylinder 98 and second processing cylinder 97 to be limited to the contact between the bearer rings. In this case, at least one deflection of second processing cylinder 97 is counteracted in each of the areas between its bearing points in a frame wall and the bearer ring adjacent to the respective bearing point.

The use of bearer rings is known in printing machine technology. In printing machines, bearer rings are arranged at the ends of the printing cylinders. The bearer ring is intended to prevent spots. It is made of hardened and tempered steel and is polished to be round with a high precision and to hold its dimensions. The bearer ring is approximately 1-4 cm wide and rolls either on the foundation rail or on the bearer ring of the impression cylinder. The circumference of the bearer ring is precisely the same as the circumference of the packing or has the precise circumference of the shape of whatever machine part on which it is mounted. The bearer ring is an element of forced guidance on printing machines that have a central drive and equalizes minor inaccuracies in bearing as well as uneven drive and output from the gearwheel drive of the printing machines.

In the case of the provision of bearer rings, a device for adjusting the pressure between the bearer rings by repositioning impression cylinder 98 and/or second processing cylinder 97 is advantageously provided. A device for securing a packing is preferably assigned to impression cylinder 98. This makes it possible to arrange a packing on impression cylinder 98 to ensure that, even if a tool that may vary in terms of thickness is arranged on the second processing cylinder 97, the impression cylinder will be in surface contact, in particular in rolling contact, with second processing cylinder 97 and/or with the tool arranged on the surface thereof. A device for clamping the packing in the circumferential direction of impression cylinder 98, which tool may form a module with the device for securing a packing, is preferably also associated with impression cylinder 98.

For the use of a profiled packing, in particular, for example in the form of a female die, it has proven advantageous for impression cylinder 98 to have a register system for positioning a packing on impression cylinder 98.

According to another preferred embodiment, which facilitates the replacement of tool parts, the device for treating substrates 1 comprises a processing unit 46 having two processing cylinders 96, 97, which cooperate with one another and between which substrate 1 can be inserted. Substrate 1 is processed as it passes through, by means of tool parts from the group composed of cutting tools, punching tools, creasing tools, perforating tools and grooving tools, which are active in the cylinder nip between processing cylinders 96, 97. At least one of processing cylinders 96, 97 is embodied as a magnetic cylinder. A peeling unit for peeling at least one tool part is assigned to the processing cylinder 96, 97 embodied as a magnetic cylinder.

Figure 47:
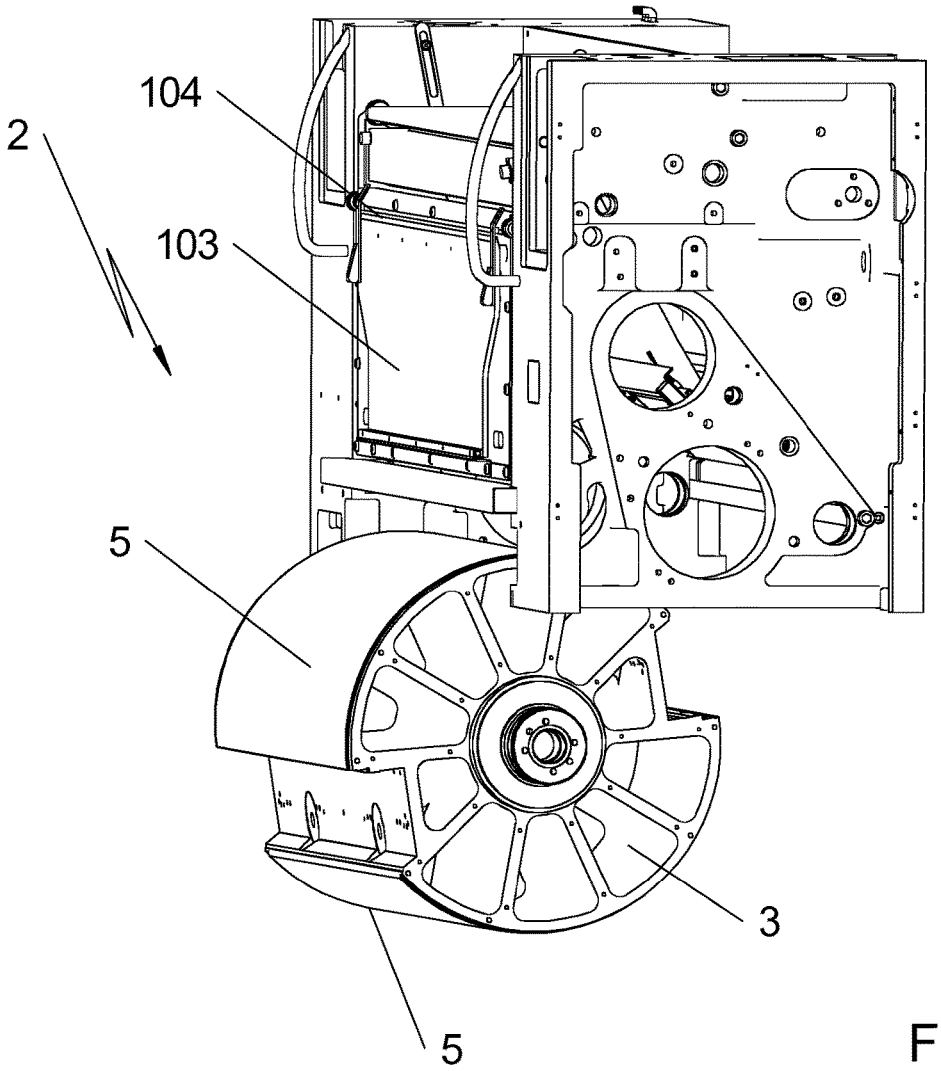
FIGS. 47 to 48 show a device for treating/stacking substrates having a peeling device
Figure 48:
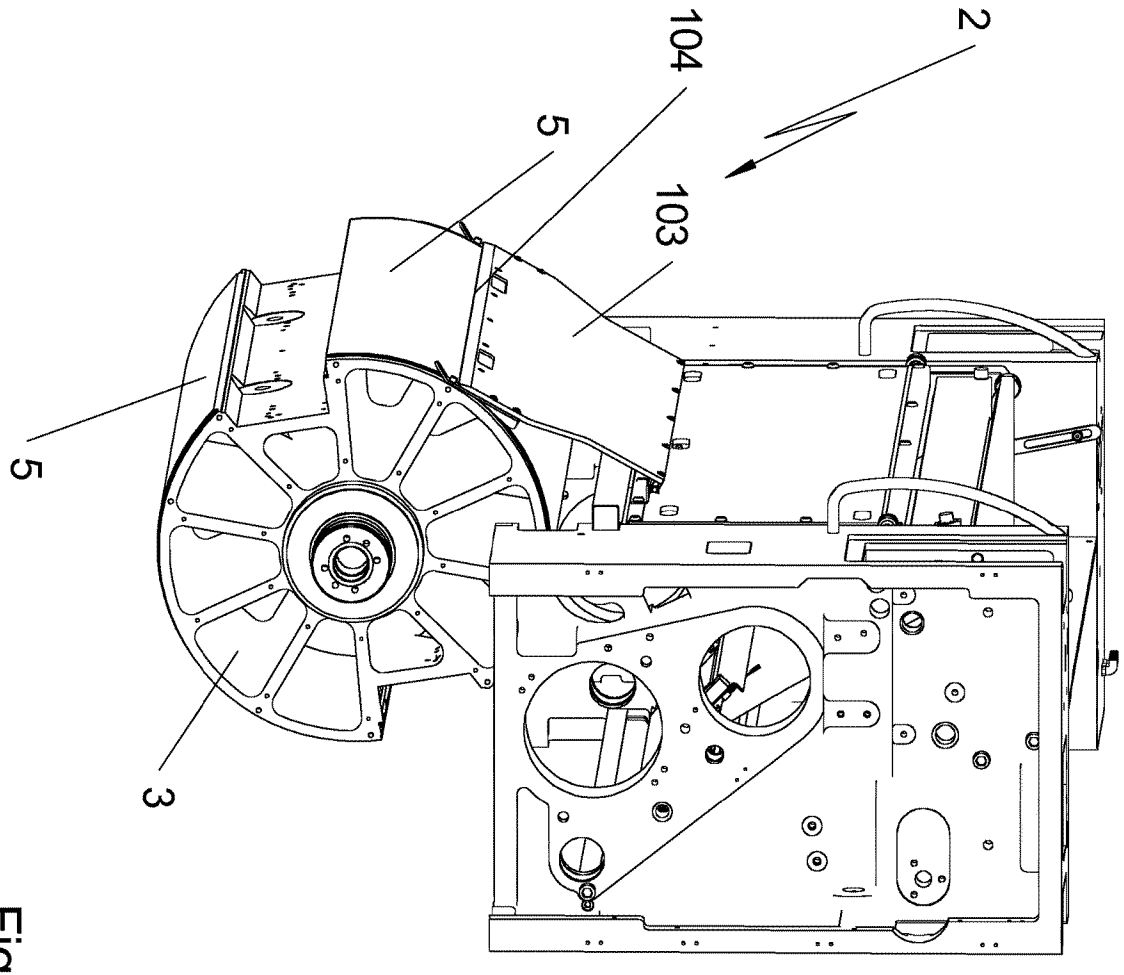

According to another preferred embodiment, which facilitates the replacement of tool parts, the device for treating substrates 1 comprises a separation system having a transport cylinder 3 and a stripping cylinder 4, between which substrate 1 can be inserted. Substrate 1 is separated by at least one packing 5 into at least one waste part 9 and at least one blank 10 as it passes through the cylinder nip between transport cylinder 3 and stripping cylinder 4. Transport cylinder 3 and/or stripping cylinder 4 is/are embodied as magnetic cylinders. A peeling device 103 for peeling the at least one packing 5 is associated with transport cylinder 3 and/or stripping cylinder 4. In this regard see FIGS. 47 and 48, in particular. Peeling device 103 is embodied to be thrown on and/or thrown off of the cylinder to which it is assigned and which is configured for carrying a packing 5, in particular processing cylinder 96, 97 or transport cylinder 3 or stripping cylinder 4. Peeling device 103 has a peeling edge 104. When peeling device 103 is thrown onto the respective cylinder, peeling edge 104 extends preferably tangentially or approximately tangentially to the periphery of the cylinder to which it is assigned, i.e., in particular to processing cylinder 96, 97, transport cylinder 3 or stripping cylinder 4. In addition, it has proven to be advantageous for peeling device 103 to form a module with a guard device 70, 71. Guard device 70, 71 may be, for example, any part of a housing of a processing unit 46 or of a separation unit 2.2 that protects the operator from injuries caused by rotating cylinders or prevents or reduces noise or dust emissions. It is also possible for peeling device 103 to be assigned to parts of the plate-changing unit or the device for changing the packing. If peeling device 103 and guard device 70, 71 form a module, the module may perform the function of a peeling device 103 in one position and the function of a guard device 70, 71 in another position.

Peeling device 103 preferably has a retaining element for securing the tool parts or the at least one packing 5. The retaining element may act pneumatically or magnetically or may be embodied in some other way, e.g. in the form of a step or a latch.

To ensure that peeling device 103 engages beneath an edge of the tool part or beneath an edge of the at least one packing 5, the tool part or the at least one packing 5 may be raised manually. According to an advantageous alternative, an ejector is provided for this purpose, which is assigned to processing cylinder 96, 97 and/or transport cylinder 3 and/or stripping cylinder 4 and is configured to at least partially raise tool parts or the at least one packing 5 off of the surface of processing cylinder 96, 97 or transport cylinder 3 or stripping cylinder 4.

A drive that acts on processing cylinder 96, 97 and/or transport cylinder 3 and/or stripping cylinder 4 is preferably provided, which cooperates with a drive controller. The drive controller causes processing cylinder 96, 97 and/or transport cylinder 3 and/or stripping cylinder 4 to be automatically positioned in a position in which one end of a tool part or of the at least one packing 5 is opposite peeling device 103 and/or is situated in the operative zone of peeling device 103, in particular peeling edge 104. After positioning, the drive controller may induce a rotation of processing cylinder 96, 97 and/or of transport cylinder 3 and/or of stripping cylinder 4, such that the other end of the tool part or of the at least one packing 5 is opposite peeling device 103 and/or is within the operative zone of peeling device 103. As the processing cylinder rotates, peeling device 103 peels the tool part or the at least one packing 5 off of the respective cylinder surface. Between the positioning and the rotation of processing cylinder 96, 97 and/or of transport cylinder 3 and/or of stripping cylinder 4, the ejector is preferably activated to at least partially lift the tool part in question or the at least one packing 5 off of the surface of processing cylinder 96, 97 or of transport cylinder 3 or of stripping cylinder 4.

A magnetic cylinder in the aforementioned context is understood to include all types of cylinders or drums that exert a magnetic force in the area of their periphery on neighboring ferromagnetic elements, in particular on tools or tool parts from the group composed of cutting tools, punching tools, creasing tools, perforating tools and grooving tools. Such a cylinder may be embodied as a fully magnetic cylinder or as a cylinder with inserted magnetic segments or as a carrier cylinder for magnetic segments or magnetic sheets arranged thereon, which also applies similarly to the configuration as a drum.

According to another preferred embodiment, the device for treating substrates 1, which may be embodied as a sheet processing machine or may be a component thereof, comprises, in addition to units preferably embodied as printing units 6 and processing units 46, additional units, which may be arranged in any sequence, individually or in groups. For instance, one or more coating units 88.2 and/or one or more separation units 2.2 and/or one or more window applicator units 85 or a film applicator unit 85 and/or one or more punching units may be provided, alternatively or in addition to the aforementioned units.

A separation unit 2.2 preferably comprises a transport cylinder 3 having openings 12, 13 formed in its circumferential surface and air supply means 14, 15 for supplying air to openings 12, 13, preferably suction air. A stripping cylinder 4 is preferably assigned to transport cylinder 3.

A coating unit 88.2 preferably comprises a device for sheet transport, in particular a sheet guiding cylinder, and a coating device 88, and is configured for partially or fully coating a substrate sheet 1 with an adhesive.

A window applicator unit 85 or a film applicator unit 85 in various configurations may be provided. In a first configuration, the film is provided in the form of film sections. The first configuration preferably comprises a transport cylinder 3.1 for transport of sheet-type substrates 1, a sheet conveying device, e.g., in the form of a sheet guiding cylinder, which cooperates with transport cylinder 3.1, a film feed device 86 having means for guiding film sections, and a coating device 88 for supplying an adhesion promoter to substrate 1 or to a respective film section.

Film feed device 86 may include a magazine 93 for accommodating a pile of film sections and a separation device, which separates film sections from the pile of film sections and accelerates them to the circumferential speed of transport cylinder 3.1.

Film feed device 86 preferably comprises a feed cylinder 84, which forms a press nip with transport cylinder 3.1.

The separation device may include a transport element 94 for separating the film sections from the top side or from the bottom side of the pile of film sections. A transport element 94 is preferably provided for feeding film sections to the press nip formed between feed cylinder 84 and transport cylinder 3.1. Transport element 94 may have one or more elements from the group composed of suction belts and/or suction rollers and/or suckers. A force resulting from an applied negative pressure preferably serves as the transport mechanism for the aforementioned elements provided as transport elements 94. Alternatively or additionally, a friction-locking force may also serve as a transport mechanism. If a sucker is provided as transport element 94, it may be embodied as a combined sucker and may have one or more transport suckers cooperating with one or more lifting suckers.

Transport element 94 may be provided for feeding a respective separated film section directly to the press nip or feed cylinder 84. In this context, direct feed is understood as feeding without transfer, i.e. intermediate transfer to another transport element 94.

Openings that can be supplied with suction air by air supply means are preferably formed in the circumferential surface of feed cylinder 84. According to one embodiment, the air supply means may be adapted for supplying suction air based upon the angular position of the respective openings being supplied with air.

Coating device 88 may be assigned to transport cylinder 3.1 or to a feed cylinder 84.

If coating device 88 is assigned to transport cylinder 3.1, substrate 1 is coated directly and then brought into contact with a film section. If coating device 88 is assigned to feed cylinder 84, substrate 1 is coated indirectly. This means that the adhesion promoter, in particular the glue, is supplied to a respective film section, which is then brought into contact with a substrate sheet 1.

Coating device 88 may be configured in the manner of a coating unit and/or may comprise a forme roller and/or an inkjet head. Coating device 88 is preferably configured such that it permits an addressable partial coating of the substrate sheet 1 or the respective film section in question with adhesion promoter, in particular glue. In the case of a coating device 88 formed with a forme roller, a printing forme, in particular a coating plate, in particular a flexo plate, may be provided for the addressable partial coating.

In a second preferred configuration of a window applicator unit 85 or a film applicator unit 85, the film is in the form of a film web 87. The second configuration preferably comprises a transport cylinder 3.1 for transporting sheet-type substrates 1, a sheet conveying device that cooperates with transport cylinder 3.1, and a film feed device 86 having means for guiding a film web 87. A coating device 88 for supplying an adhesion promoter to substrate 1 and a cutting device 89 for cutting film web 87 into film sections or for separating film sections from film web 87 are preferably associated with the second configuration. Film feed device 86 preferably comprises means for guiding the film sections.

Film feed device 86 preferably comprises a feed cylinder 84, which forms a press nip with transport cylinder 3.1. Cutting device 89 may be associated with feed cylinder 84. According to one embodiment of cutting device 89, it comprises a cutting cylinder 90, which has a cutting means or separating means that acts in the nip between feed cylinder 84 and cutting cylinder 90. The cutting means may be embodied as a cross-cutter or in another suitable form. Openings that can be supplied with suction air by air supply means are preferably formed in the circumferential surface of feed cylinder 84. According to one embodiment, the air supply means may be configured for supplying suction air dependent upon the angular position of the respective openings being supplied with air.

Coating device 88 may be assigned to transport cylinder 3.1 or to a feed cylinder 84. If coating device 88 is assigned to transport cylinder 3.1, substrate 1 is coated directly and then brought into contact with a film section. If coating device 88 is assigned to feed cylinder 84, substrate 1 is coated indirectly. This means that the adhesion promoter, in particular the glue, is supplied to a respective film section, which is then brought into contact with a substrate sheet 1.

Coating device 88 may be configured in the manner of a coating unit and/or a forme roller and/or an inkjet head. Coating device 88 is preferably configured such that it permits an addressable partial coating of the substrate sheet 1 or the film section in question with adhesion promoter, in particular glue. In the case of a coating device 88 formed with a forme roller, a printing forme, in particular a coating plate, in particular a flexo plate, may be provided for the addressable partial coating.

According to another embodiment, film feed device 86 comprises an unwinding device 91, configured to hold one or more film rolls 92. Unwinding device 91 preferably includes positioning means for accommodating a plurality of film rolls 92, wherein film rolls 92 can be positioned axially and/or radially in relation to one another using the positioning means.

Figure 33:
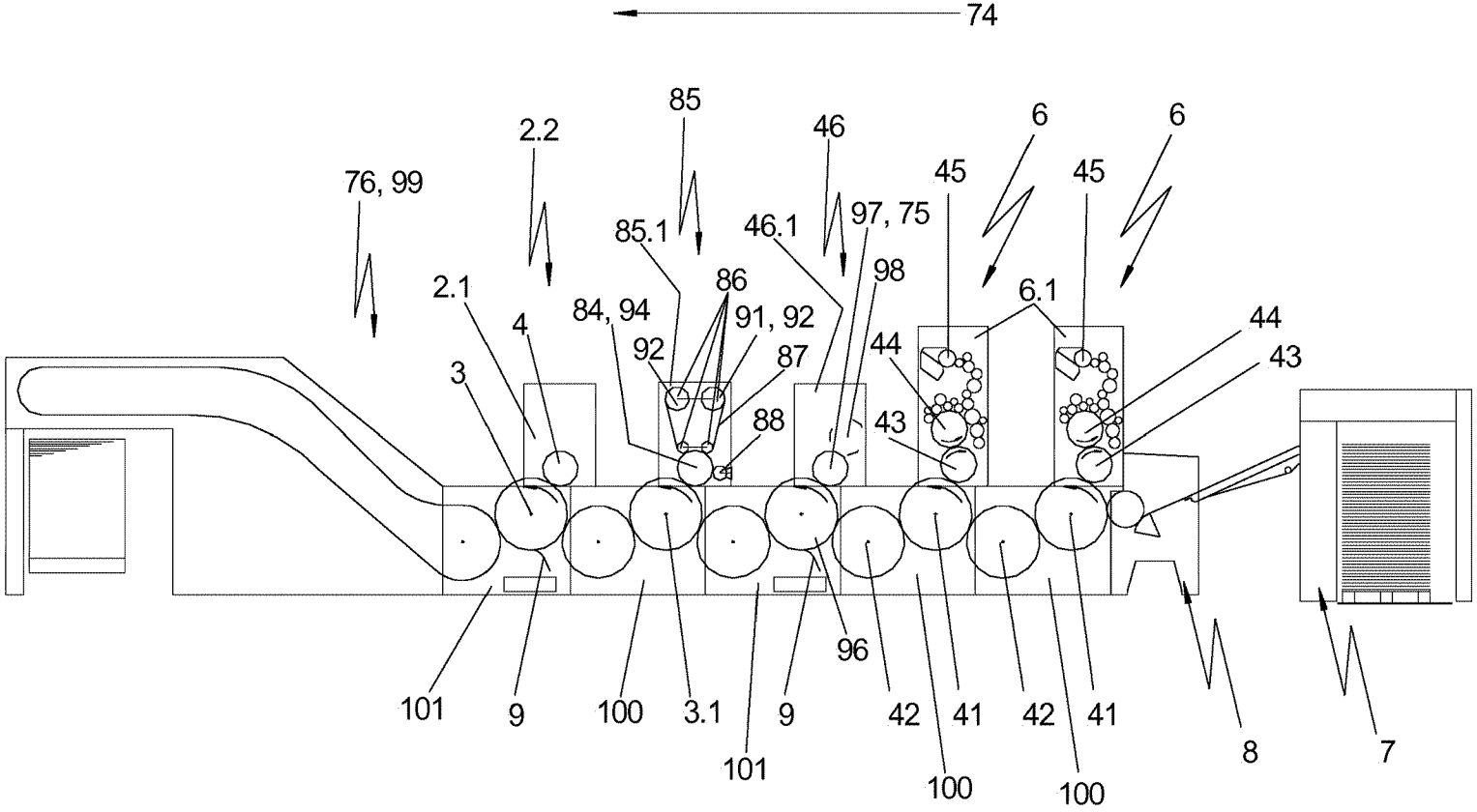
FIGS. 33 to 46 show variants of sheet processing machines having a window applicator unit or film applicator unit
Figure 40:
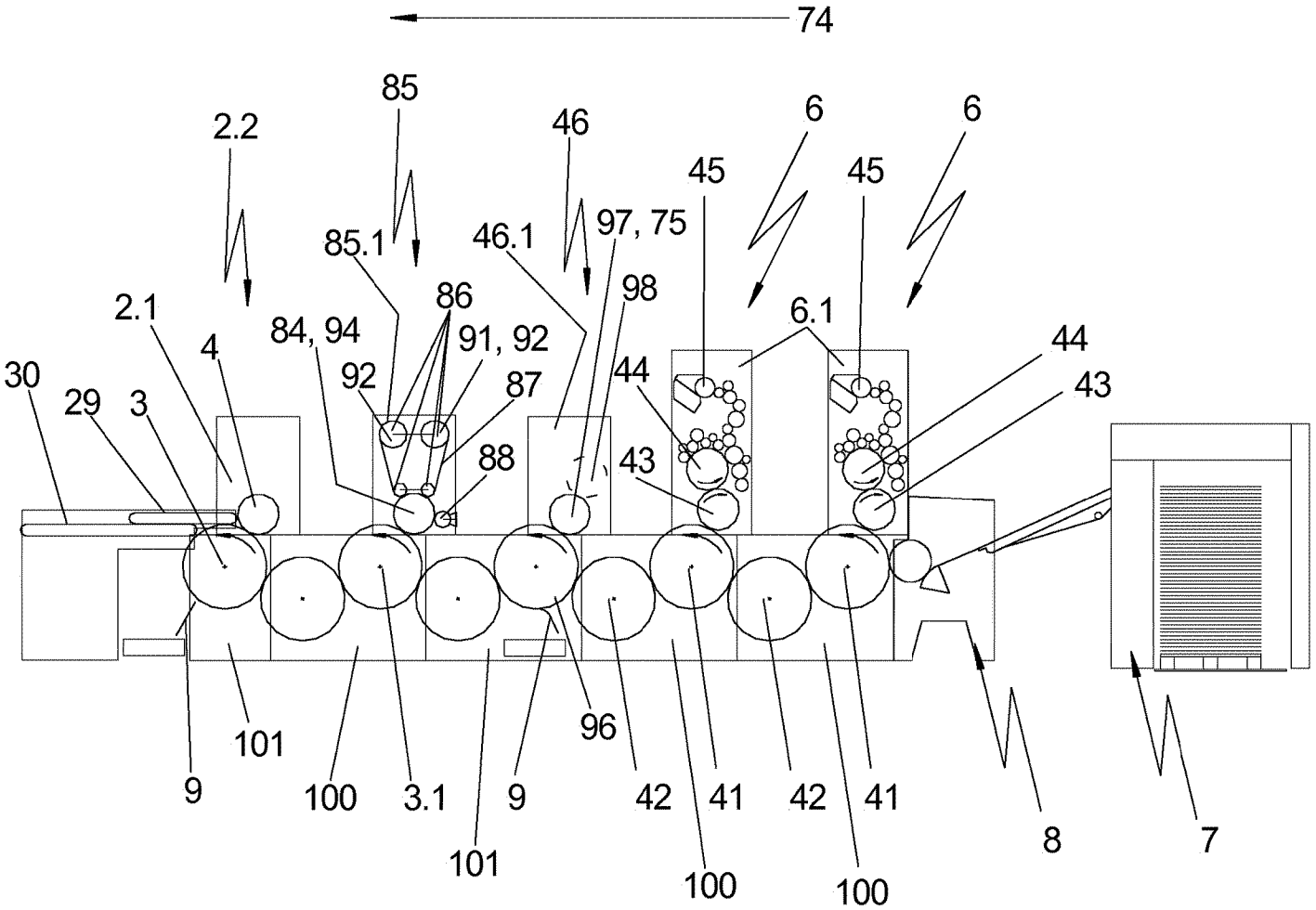

A window applicator unit 85 or film applicator unit 85 of the second configuration is illustrated by way of example in FIGS. 33 and 40. The film feed device 86 of this window applicator unit 85 or film applicator unit 85 comprises an unwinding device 91 and a winding device. A cutting device 89 may also be provided but is not shown in FIG. 33 or 40. A coating device 88 is assigned to feed cylinder 84.

Figure 34:
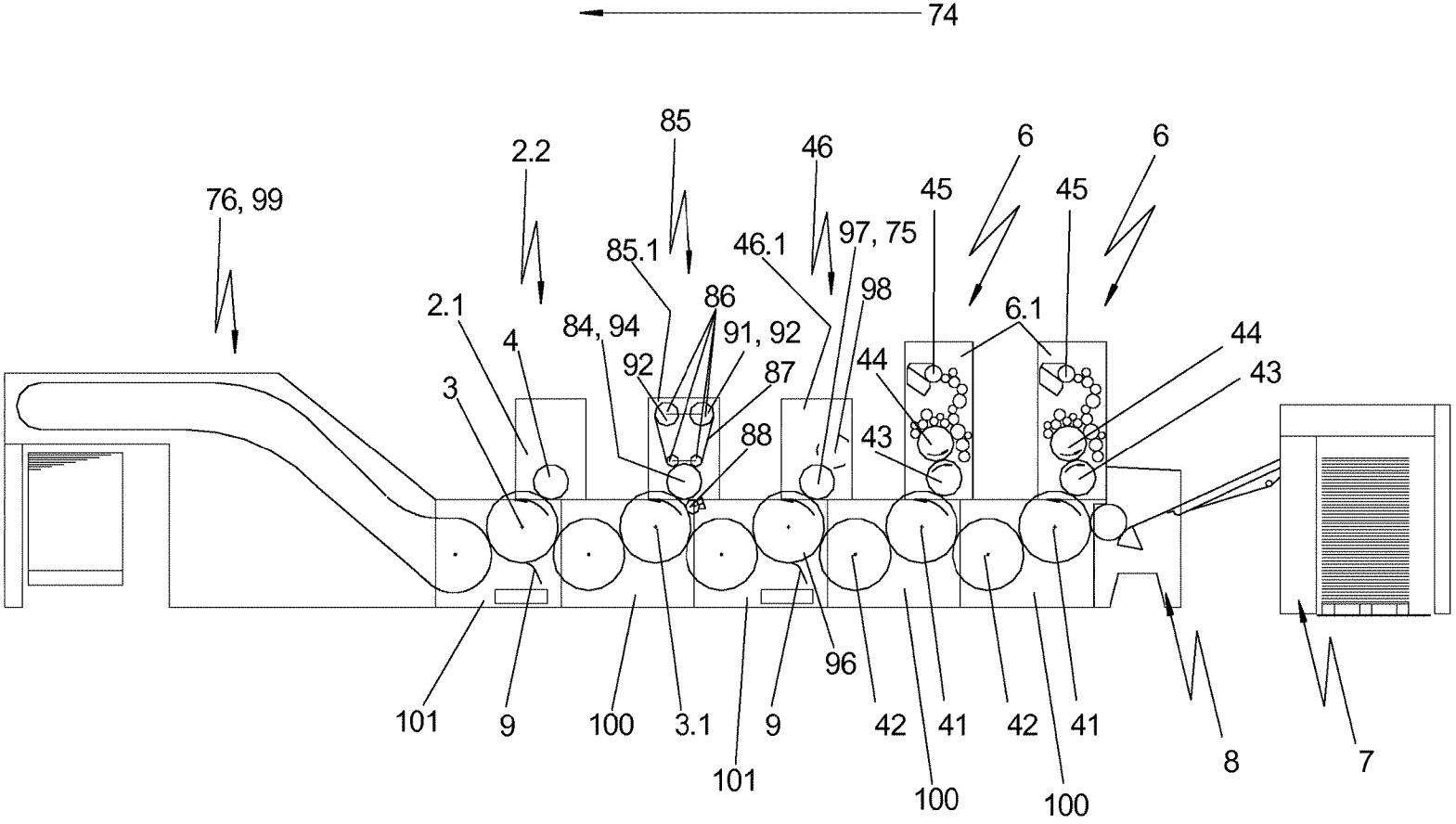
Figure 41:
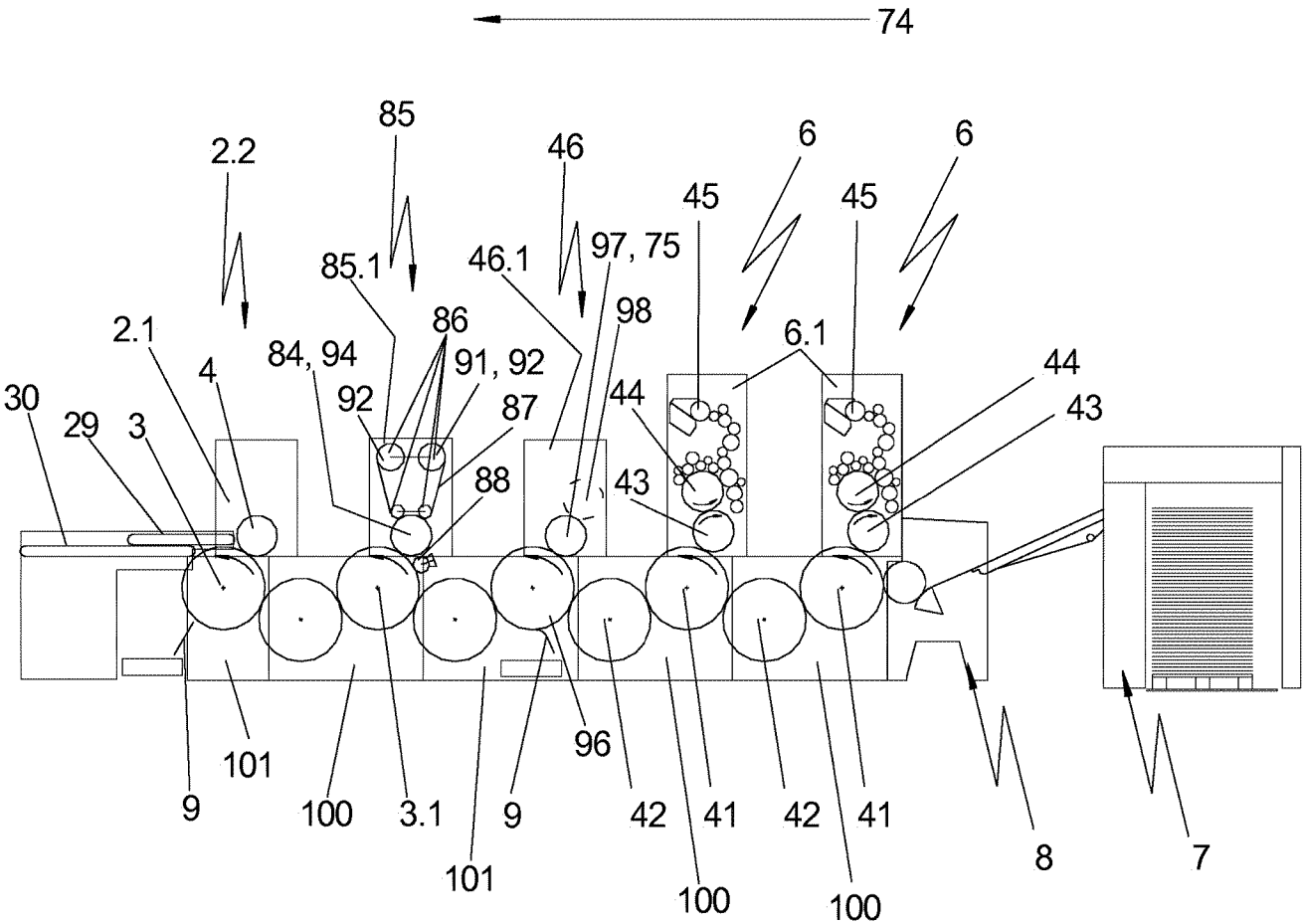

Another window applicator unit 85 or film applicator unit 85 of the second configuration can be seen in FIG. 34 or 41, and differs from window applicator unit 85 or film applicator unit 85 according to FIG. 33 or 40 in that coating device 88 is assigned to transport cylinder 3.1.

Figure 35:
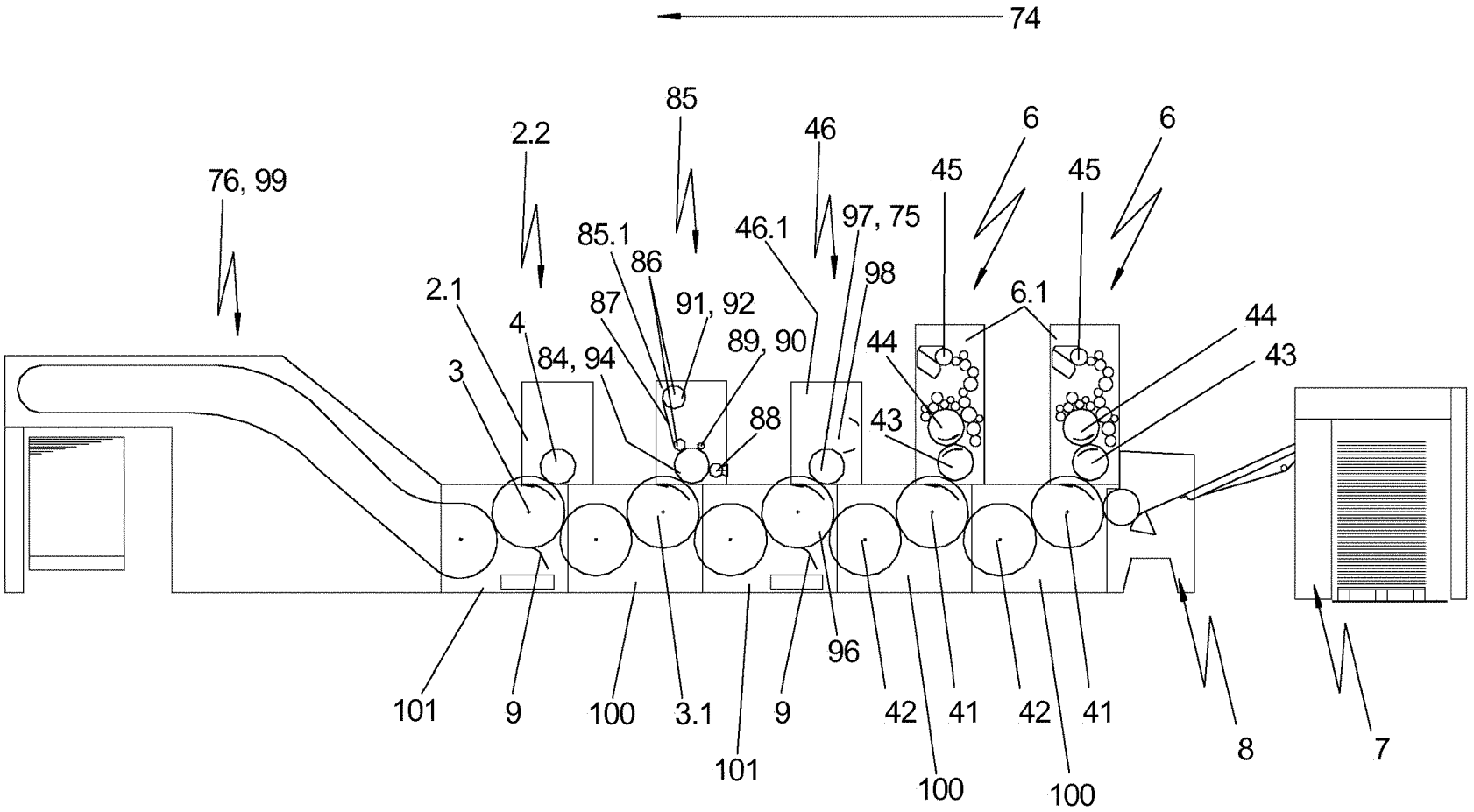
Figure 42:
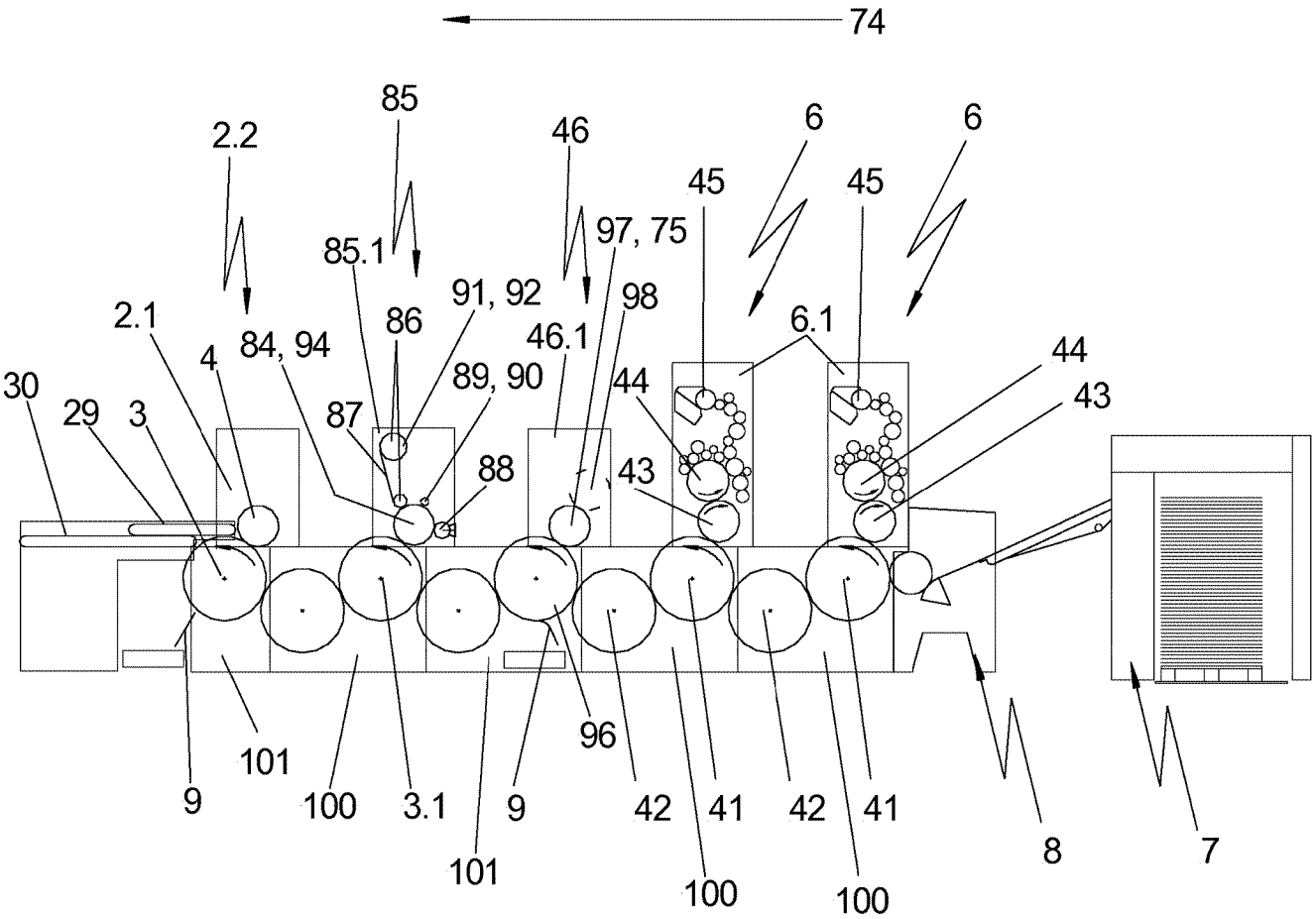

Another window applicator unit 85 or film applicator unit 85 of the second configuration can be seen in FIG. 35 or 42. It differs from window applicator unit 85 or film applicator unit 85 according to FIG. 33 or 40 in that film feed device 86 includes an unwinding device 91 but not a winding device. A cutting device 89 having a cutting cylinder 90 is assigned to feed cylinder 84.

Figure 36:
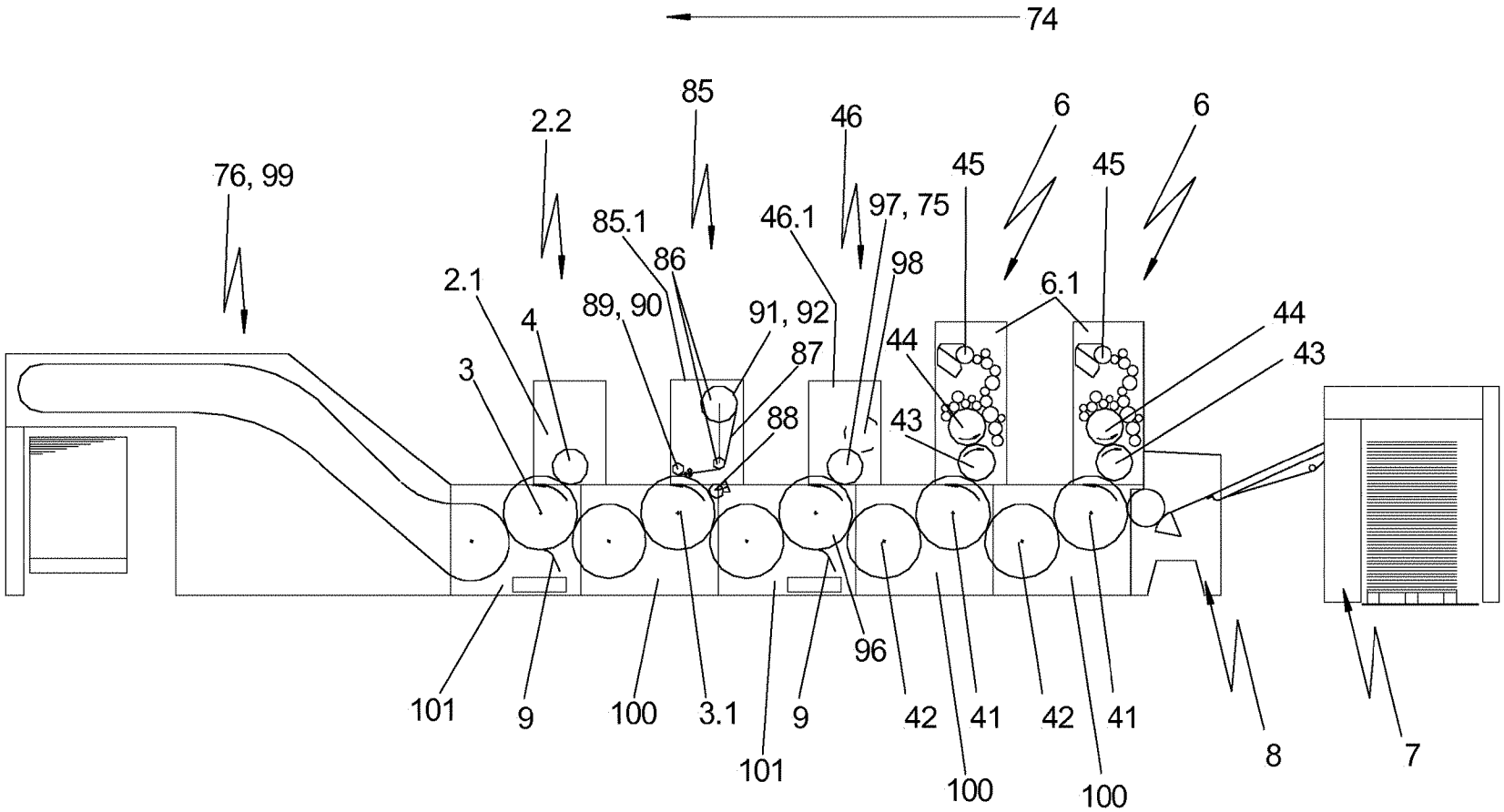
Figure 43:
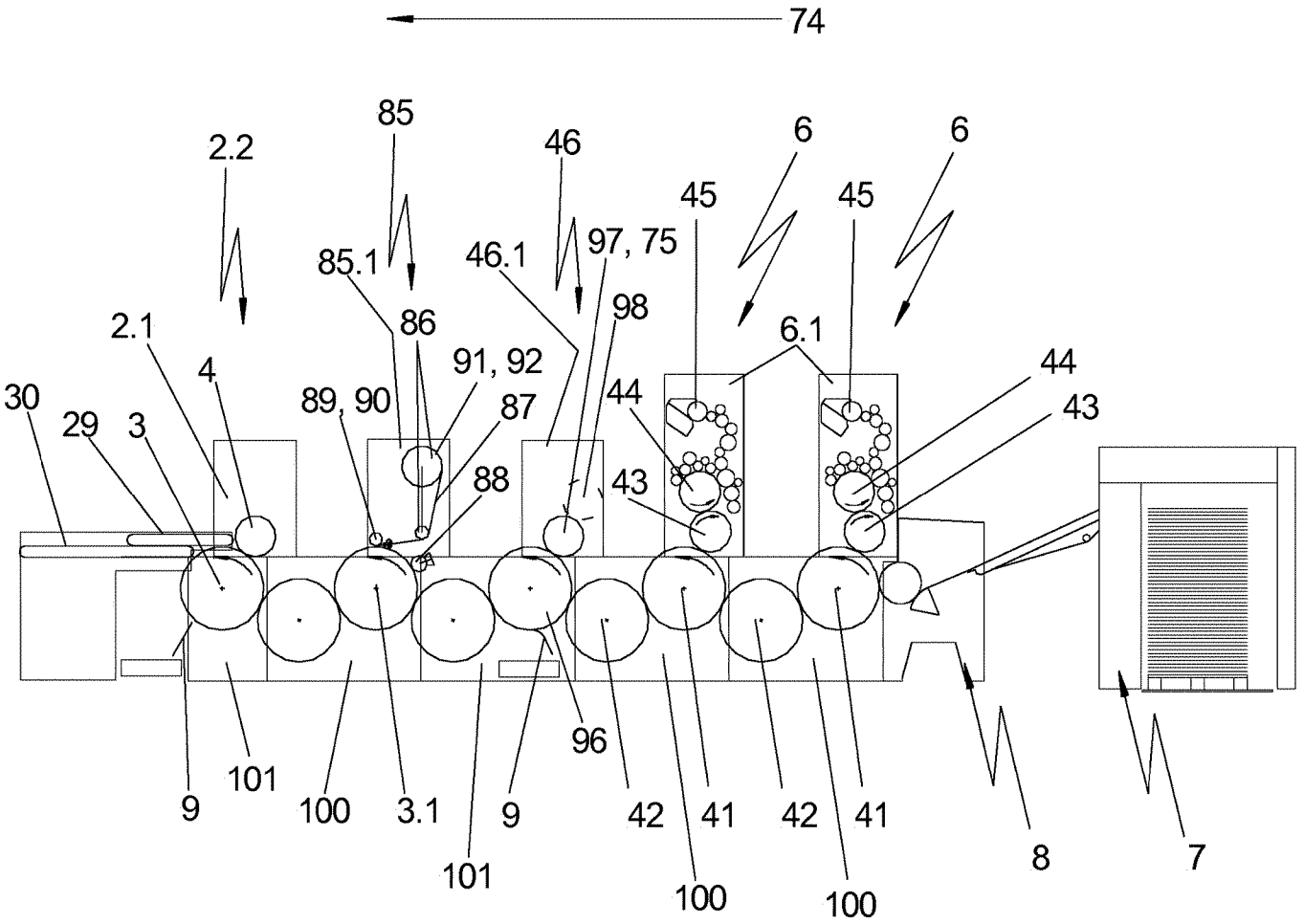

Another window applicator unit 85 or film applicator unit 85 of the second configuration can be seen in FIG. 36 or 43. It includes a film feed device 86 having unwinding device 91. A cutting device 89 having a cutting cylinder 90 is assigned to transport cylinder 3.1. Coating device 88 is assigned to transport cylinder 3.1.

Figure 37:
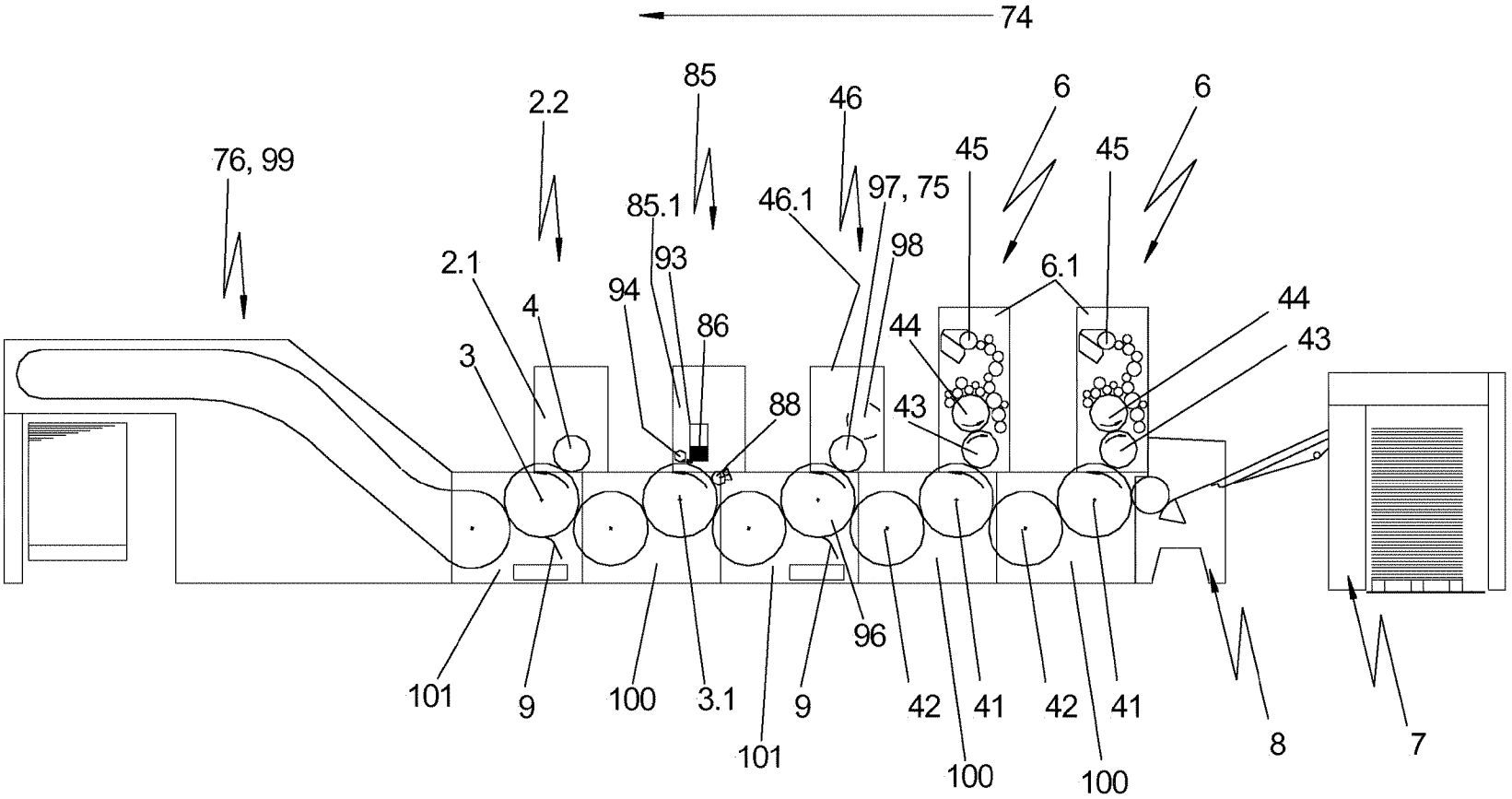
Figure 44:
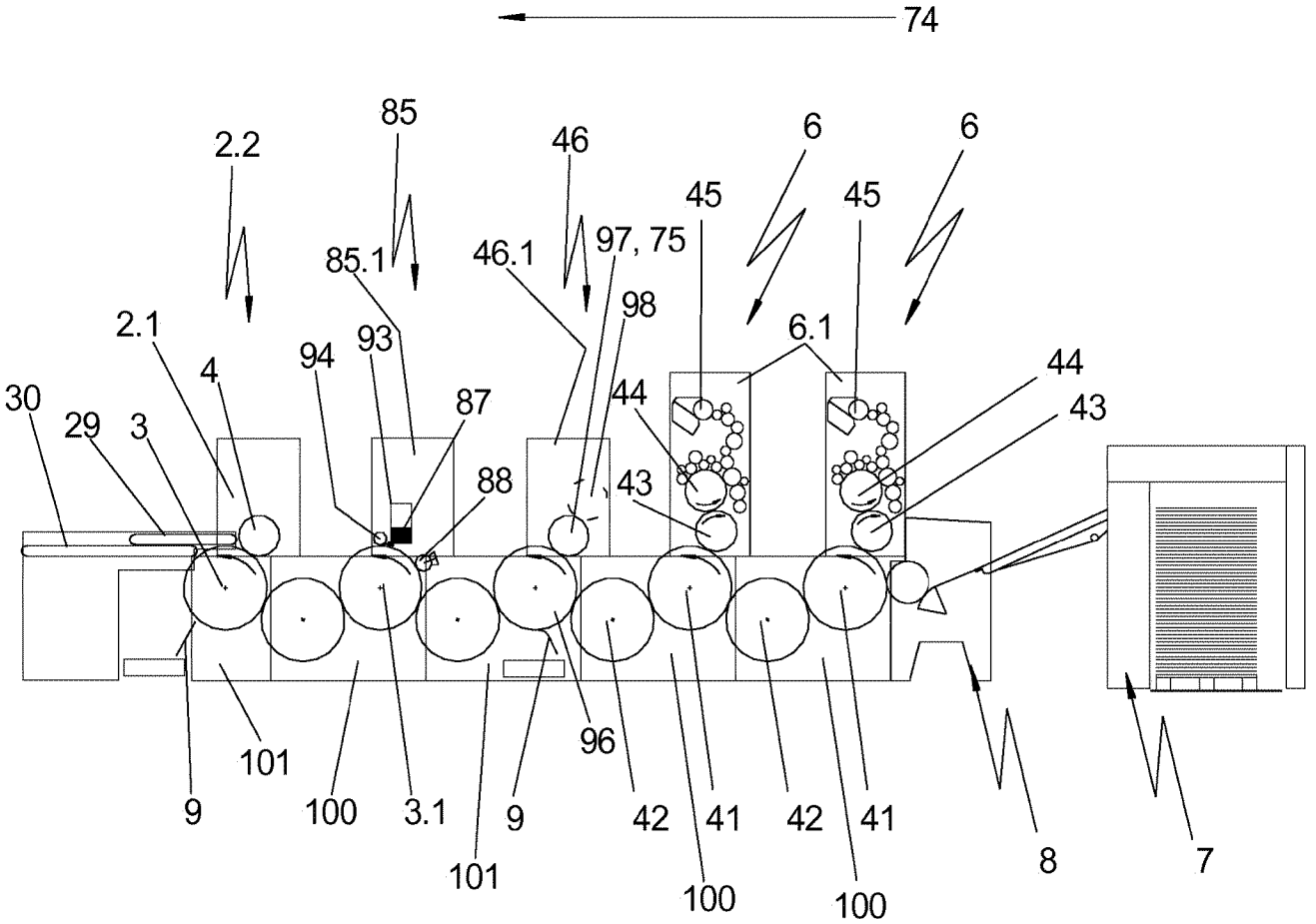

A window applicator unit 85 or film applicator unit 85 of the first configuration can be seen in FIG. 37 or 44, for example. Film feed device 86 comprises a magazine 93 for accommodating a pile of film sections and at least one transport element 94. Transport element 94 feeds a respective film section to transport cylinder 3.1. The coating device is assigned to transport cylinder 3.1.

According to one embodiment, the device for treating substrates 1, which may be embodied as a sheet processing machine or may be a component thereof, comprises a feed unit 7, to which one or more printing units 6 and/or one or more punching units are connected, to which a separation unit 2.2 is connected, to which either a coating unit 88.2 and a film applicator unit or window applicator unit 85 or a window applicator unit 85 having a coating device 88 is/are connected. Such a device or sheet processing machine is suitable, in particular, for the production of film windows.

Embodiments of such machines can be seen in FIGS. 33 to 46, in particular. A separation unit 2.2 is preferably connected to the film applicator unit or window applicator unit 85. A delivery 99 preferably follows the film applicator unit or window applicator unit 85 or the last separation unit 2.2 in the direction of transport 74 of substrate 1.

According to one embodiment, the device for treating substrates 1, which may be embodied as a sheet processing machine, comprises a feed unit 7 and one or more first substructure modules 100, each of which includes a printing cylinder 41 with means for securing a rubber packing, and a sheet conveying device, and also comprises one or more second substructure modules 101, each of which includes a transport cylinder 3 with openings 12 formed in its circumferential surface, as well as means for securing a rubber packing 5, and a sheet conveying device.

All of the first and second substructure modules 100, 101 preferably have, at the input end and/or the output end thereof, the same interface for connecting substructure modules 100, 101 to one another in a freely preselectable order, and are or can be equipped with an add-on module. Air supply means 14 may be provided for supplying air to openings 12. These air supply means 14 are preferably configured for switching between suction air supply and blower air supply based upon the angular position of the respective openings 12 being supplied with air.

Printing cylinder 41 of at least one first substructure module 100 is preferably embodied as a magnetic cylinder. Preferably, all the printing cylinders 14 of first substructure modules 100 are embodied as magnetic cylinders. All of the substructure modules 100, 101 may likewise include sheet conveying devices of the same configuration. Some or all of the first substructure modules 100 are preferably configured to be furnished with an add-on module embodied as a printing module 6.1 or as a varnishing module or as a drying module or as a film applicator module 85.1 or as a processing module 46.1, and/or all of the second substructure modules 101 are configured to be furnished with an add-on module embodied as a separation module 2.1 or as an inspection module. More preferably, all first substructure modules 100 and/or all second substructure modules 101 have identical interfaces for connection to add-on modules.

Separation module 2.1 preferably comprises a stripping cylinder 4.

Gluing module 88.1 comprises at least one device for applying glue.

Processing module 46.1 preferably comprises a punching cylinder 75 or a cylinder prepared for receiving a punching forme.

Printing module 6.1 preferably comprises a plate cylinder 44, a rubber packing cylinder 43 and an inking unit 45.

Film applicator module 85.1 preferably comprises a device for feeding in film sections.

According to one embodiment, at least one first substructure module 100 equipped with a printing module 6.1 or a processing module 46.1 is located downstream of feed unit 7, and at least one second substructure module 101 equipped with a separation module 2.1 is located downstream of the first substructure module.

One or more first substructure modules 100 that are equipped with a printing module 6.1 may also be located downstream of feed unit 7, followed by one or more first substructure modules 100 equipped with a processing module 46.1, followed by a second substructure module 101 equipped with a separation module 2.1, followed by a first or second substructure module 100, 101 that is equipped with a film applicator module 85.1.

According to one embodiment, a substructure module 102 equipped with a gluing module 88.1 is located between the substructure module 100 that is equipped with a separation module 2.1 and the substructure module 100 that is equipped with a film applicator module 85.1, or the film applicator module 85.1 comprises a device for applying glue.

Possible configurations of devices for treating substrates 1, embodied as sheet processing machines, will be described below. In the description, there is no differentiation as to whether or not a respective unit is a unit consisting of a substructure module 101 and an add-on module. The description therefore relates to both variants.

In the preferred embodiment according to FIG. 33, the following modular units are provided in succession: feed unit 7, acceleration system 8, a plurality of printing units 6, processing unit 46, film applicator unit or window applicator unit 85, separating unit 2.2 and delivery 99. They function as follows: substrate sheets 1 separated by feed unit 7 are accelerated by acceleration system 8 and printed in the printing units 6. Following that, window-shaped recesses are punched into substrates 1 in processing unit 46, after which waste parts 9 are removed. In the film applicator unit or window applicator unit 85, film sections are coated with glue and secured to the window-shaped recesses such that they overlap. In the subsequent separation unit 2.2, additional waste parts 9 are stripped out, and substrate sheets 1 are stacked in delivery 99 to form a pile.

In the preferred embodiment according to FIG. 34, the following modular units are provided in succession: feed unit 7, acceleration system 8, a plurality of printing units 6, processing unit 46, film applicator unit or window applicator unit 85, separation unit 2.2 and delivery 99. They function as follows: substrate sheets 1 separated by feed unit 7 are accelerated by acceleration system 8 and printed in the printing units 6. Following that, window-shaped recesses are punched into substrates 1 in processing unit 46, after which waste parts 9 are removed. In the film applicator unit or window applicator unit 85, substrate sheets 1 are coated with glue and the film sections are secured to the window-shaped recesses such that they overlap. In the subsequent separation unit 2.2, additional waste parts 9 are stripped out, and substrate sheets 1 are stacked in delivery 99 to form a pile.

In the preferred embodiment according to FIG. 35, the following modular units are provided in succession: feed unit 7, acceleration system 8, a plurality of printing units 6, processing unit 46, film applicator unit or window applicator unit 85, separation unit 2.2 and delivery 99. They function as follows: substrate sheets 1 separated by feed unit 7 are accelerated by acceleration system 8 and printed in printing units 6. Following that, window-shaped recesses are punched into substrates 1 in processing unit 46, after which waste parts 9 are removed. In the film applicator unit or window applicator unit 85, film sections are separated from film web 87 by means of a cutting device 89 and a cutting cylinder 90 and are then coated with glue and secured to the window-shaped recesses such that they overlap. In the subsequent separation unit 2.2, additional waste parts 9 are stripped out, and substrate sheets 1 are stacked in delivery 99 to form a pile.

In the preferred embodiment according to FIG. 36, the following modular units are provided in succession: feed unit 7, acceleration system 8, a plurality of printing units 6, processing unit 46, film applicator unit or window applicator unit 85, separation unit 2.2 and delivery 99. They function as follows: substrate sheets 1 separated by a feed unit 7 are accelerated by acceleration system 8 and printed in printing units 6. Following that, window-shaped recesses are punched into substrates 1 in processing unit 46, after which waste parts 9 are removed. In film applicator unit or window applicator unit 85, substrate sheets 1 are coated with glue, and the film sections are separated from film web 87 by means of a cutting device 89 and a cutting cylinder 90 and are then secured to the window-shaped recesses such that they overlap. In the subsequent separation unit 2.2, additional waste parts 9 are stripped out, and substrate sheets 1 are stacked in delivery 99 to form a pile.

The following modular units are provided in succession in the preferred embodiment according to FIG. 37: feed unit 7, acceleration system 8, a plurality of printing units 6, processing unit 46, film applicator unit or window applicator unit 85, separation unit 2.2 and delivery 99. They function as follows: substrate sheets 1 separated by feed unit 7 are accelerated by acceleration system 8 and printed in printing units 6. Following that, the window-shaped recesses are punched into substrates 1 in processing unit 46, after which waste parts 9 are removed. In the film applicator unit or window applicator unit 85, substrate sheets 1 are coated with glue, and the film sections are fed from a magazine 93 to transport cylinder 3.1 by way of a transport element 94, and are secured to the window-shaped recesses such that they overlap. In the subsequent separation unit 2.2, additional waste parts 9 are stripped out, and substrate sheets 1 are stacked in delivery 99 to form a pile.

Figure 38:
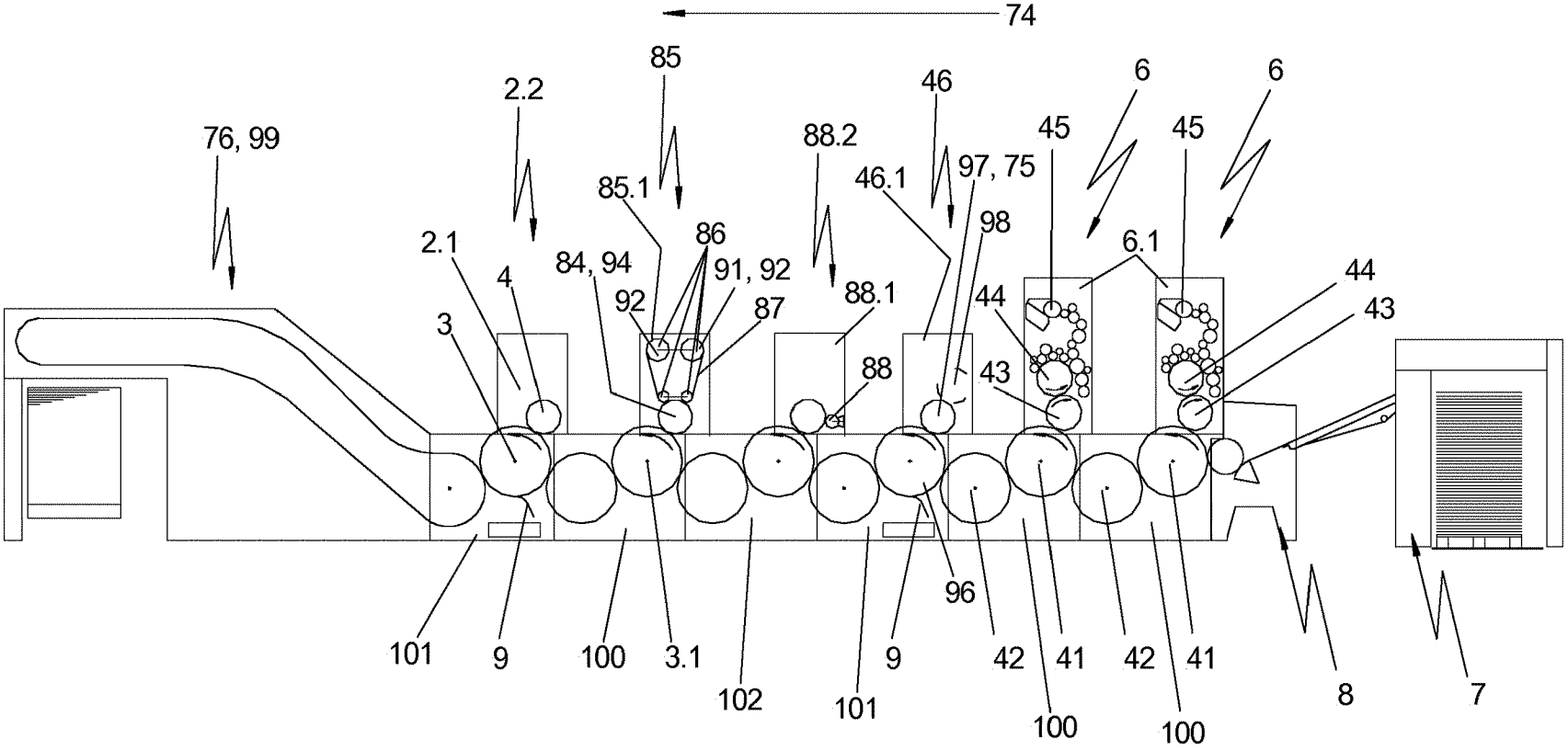

In the preferred embodiment according to FIG. 38, the following modular units are provided in succession: feed unit 7, acceleration system 8, a plurality of printing units 6, processing unit 46, coating unit 88.2, film applicator unit or window applicator unit 85, separation unit 2.2 and delivery 99. They function as follows: substrate sheets 1 separated by feed unit 7 are accelerated by acceleration system 8 and printed in printing units 6. Following that, window-shaped recesses are punched into substrates 1 in processing unit 46, after which the waste parts 9 are removed. Substrate sheets 1 are coated with glue in coating unit 88.2. In the film applicator unit or window applicator unit 85, film sections are secured to the window-shaped recesses such that they overlap. Additional waste parts 9 are stripped out in the subsequent separation unit 2.2 and substrate sheets 1 are stacked in delivery 99 to form a pile.

Figure 39:
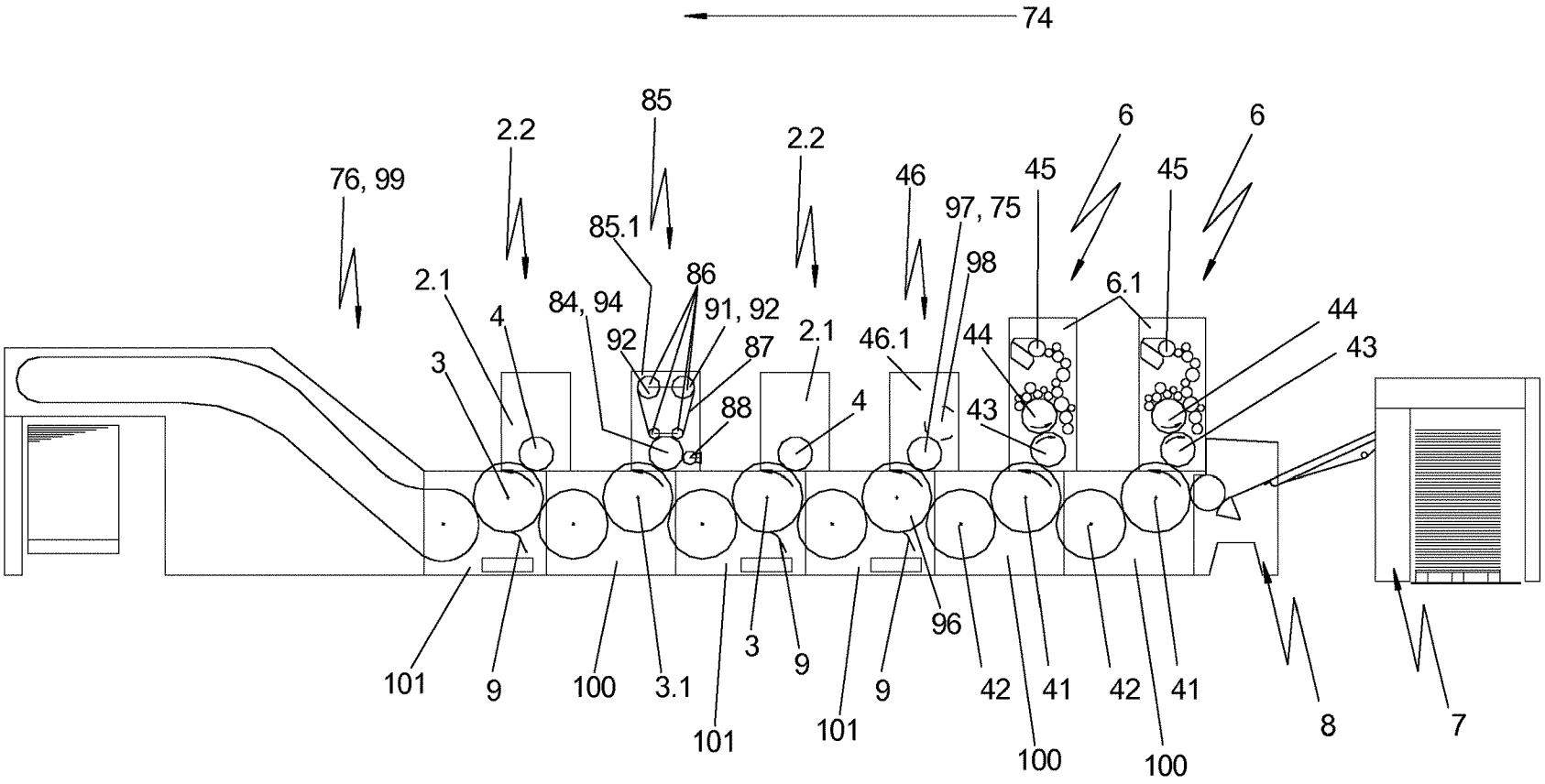

In the preferred embodiment according to FIG. 39, the following modular units are provided in succession: feed unit 6, acceleration system 8, a plurality of printing units 6, processing unit 46, separation unit 2.2, film applicator unit or window applicator unit 85, separation unit 2.2 and delivery 99. They function as follows: substrate sheets 1 separated by feed unit 7 are accelerated by acceleration system 8 and printed in the printing units 6. Following that, window-shaped recesses are punched into substrates 1 in processing unit 46, after which waste parts 9 are removed. In the subsequent separation unit 2.2, additional waste parts 9 are stripped out. In the film applicator unit or window applicator unit 85, film sections are coated with glue and are secured to the window-shaped recesses such that they overlap. In the subsequent separation unit 2.2, additional waste parts 9 are stripped out, and substrate sheets 1 are stacked in delivery 99 to form a pile.

In the preferred embodiment according to FIG. 40, the following modular units are provided in succession: feed unit 7, acceleration system 8, a plurality of printing units 6, processing unit 46, film applicator unit or window applicator unit 85, separation unit 2.2 and conveyor belts 29, 30. They function as follows: Substrate sheets 7 separated by feed unit 7 are accelerated by acceleration system 8 and printed in printing units 6. Following that, window-shaped recesses are punched into substrates 1 in processing unit 46, after which waste parts 9 are removed. In the film applicator unit or window applicator unit 85, substrate sheets 1 are coated with glue and the film sections are secured to the window-shaped recesses such that they overlap. In the subsequent separation unit 2.2, either only additional waste parts 9 or waste parts 9 together with the frames are stripped out and removed. Conveyor belts 29, 30 transport substrate sheets 1 or stripped-out blanks 10 to a pile, depending upon the preceding separation operation.

In the preferred embodiment according to FIG. 41, the following modular units are provided in succession: feed unit 7, acceleration system 8, a plurality of printing units 6, processing unit 46, film applicator unit or window applicator unit 85, separation unit 2.2 and conveyor belts 29, 30. They function as follows: substrate sheets 1 separated by feed unit 7 are accelerated by acceleration system 8 and printed in printing units 6. Following that, window-shaped recesses are punched into substrates 1 in processing unit 46, after which waste parts 9 are removed. In the film applicator unit or window applicator unit 85, substrate sheets 1 are coated with glue and the film sections are secured to the window-shaped recesses such that they overlap. In the subsequent separation unit 2.2, either only additional waste parts 9 or waste parts 9 together with the frames are stripped out and removed. Conveyor belts 29, 30 transport substrate sheets 1 or stripped-out blanks 10 to a pile, depending upon the preceding separation operation.

In the preferred embodiment according to FIG. 42, the following modular units are provided in succession: feed unit 7, acceleration system 8, a plurality of printing units 6, processing unit 46, film applicator unit or window applicator unit 85, separation unit 2.2 and conveyor belts 29, 30. They function as follows: substrate sheets 1 separated by feed unit 7 are accelerated by acceleration system 8 and printed in printing units 6. Following that, window-shaped recesses are punched into substrates 1 in processing unit 46, after which waste parts 9 are removed. In the film applicator unit or window applicator unit 85, film sections are separated from film web 87 by means of a cutting device 89 and a cutting cylinder 90, and are then coated with glue and secured to the window-shaped recesses such that they overlap. In the subsequent separation unit 2.2, either only additional waste parts 9 or waste parts 9 together with the frames are stripped out and removed. Conveyor belts 29, 30 transport substrate sheets 1 or stripped-out blanks 10 to a pile, depending upon the preceding separation operation.

In the preferred embodiment according to FIG. 43, the following modular units are provided in succession: feed unit 7, acceleration system 8, a plurality of printing units 6, processing unit 46, film applicator unit or window applicator unit 85, separation unit 2.2 and conveyor belts 29, 30. They function as follows: substrate sheets 1 separated by feed unit 7 are accelerated by acceleration system 8 and printed in printing units 6. Following that, window-shaped recesses are punched into substrates 1 in processing unit 46, after which waste parts 9 are removed. In the film applicator unit or window applicator unit 85, substrate sheets 1 are coated with glue, and the film sections are separated from film web 87 by means of a cutting device 89 and a cutting cylinder 90 and are then secured to the window-shaped recesses such that they overlap. In the subsequent separation unit 2.2, either only additional waste parts 9 or waste parts 9 together with the frames are stripped out and removed. Conveyor belts 29, 30 transport substrate sheets 1 or stripped-out blanks 10 to a pile, depending upon the preceding separation operation.

In the preferred embodiment according to FIG. 44, the following modular units are provided in succession: feed unit 7, acceleration system 8, a plurality of printing units 6, processing unit 46, film applicator unit or window applicator unit 85, separation unit 2.2 and conveyor belts 29, 30. They function as follows: substrate sheets 1 separated by feed unit 7 are accelerated by acceleration system 8 and printed in printing units 6. Following that, window-shaped recesses are punched into substrates 1 in processing unit 46, after which waste parts 9 are removed. In the film applicator unit or window applicator unit 85, substrate sheets 1 are coated with glue and the film sections are fed from a magazine 93 to transport cylinder 3.1 via a transport element 94 and are secured to the window-shaped recesses such that they overlap. In the subsequent separation unit 2.2, either only additional waste parts 9 or waste parts 9 together with the frames are stripped out and removed. Conveyor belts 29, 30 transport substrate sheets 1 or stripped-out blanks 10 to a pile, depending upon the preceding separation operation.

Figure 45:
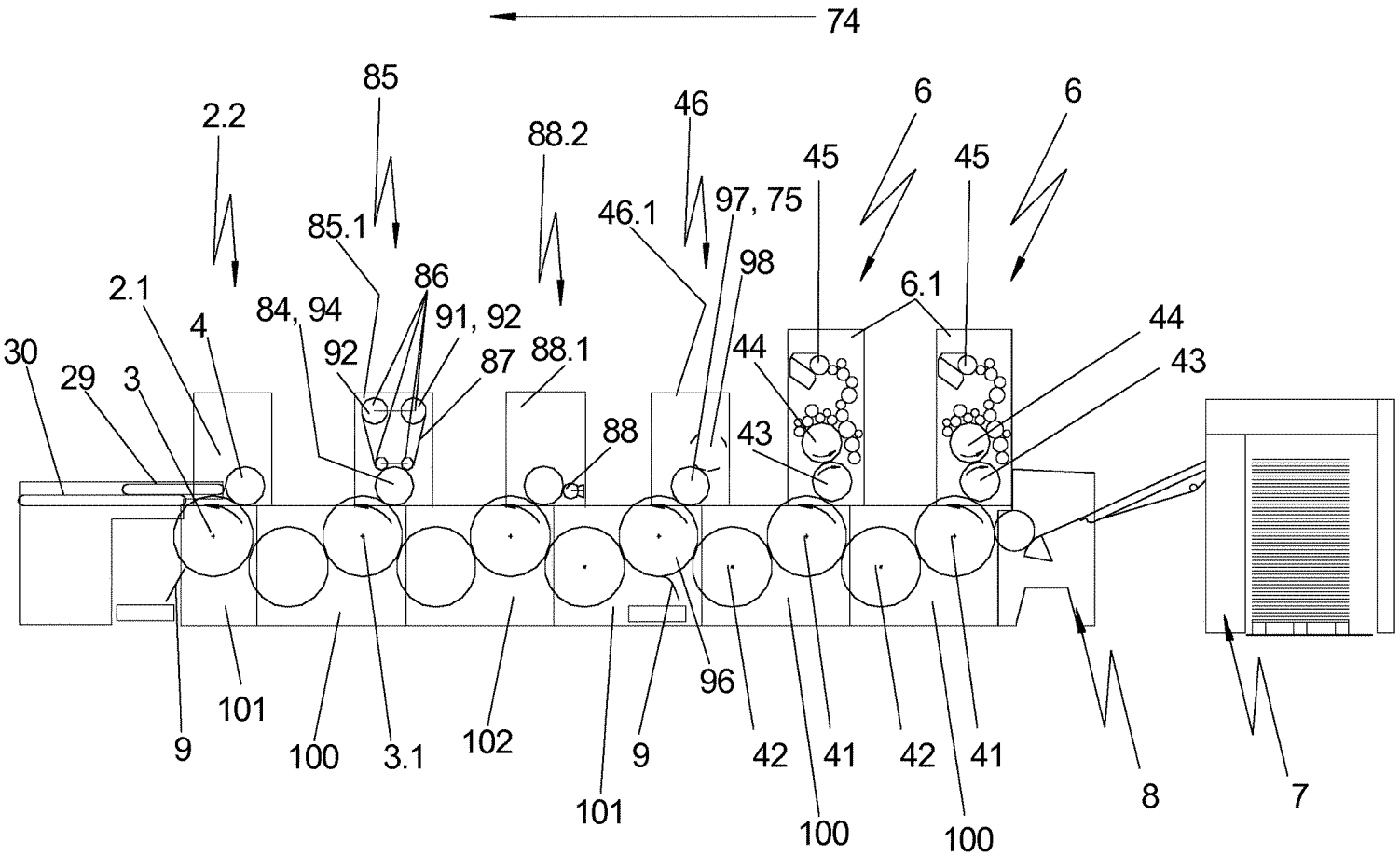

In the preferred embodiment according to FIG. 45, the following modular units are provided in succession: feed unit 7, acceleration system 8, a plurality of printing units 6, processing unit 46, coating unit 88.2, film applicator unit or window applicator unit 85, separation unit 2.2 and conveyor belts 29, 30. They function as follows: substrate sheets 1 separated by feed unit 7 are accelerated by acceleration system 8 and printed in printing units 6. Next, window-shaped recesses are punched into substrates 1 in processing unit 46, after which waste parts 9 are removed. Substrate sheets 1 are coated with glue in coating unit 88.2. In the film applicator unit or window applicator unit 85, film sections are secured to the window-like recesses such that they overlap. In the subsequent separation unit 2.2, either only additional waste parts 9 or waste parts 9 together with the frames are stripped out and removed. Conveyor belts 29, 30 transport substrate sheets 1 or stripped-out blanks 10 to a pile, depending upon the preceding separation operation.

Figure 46:
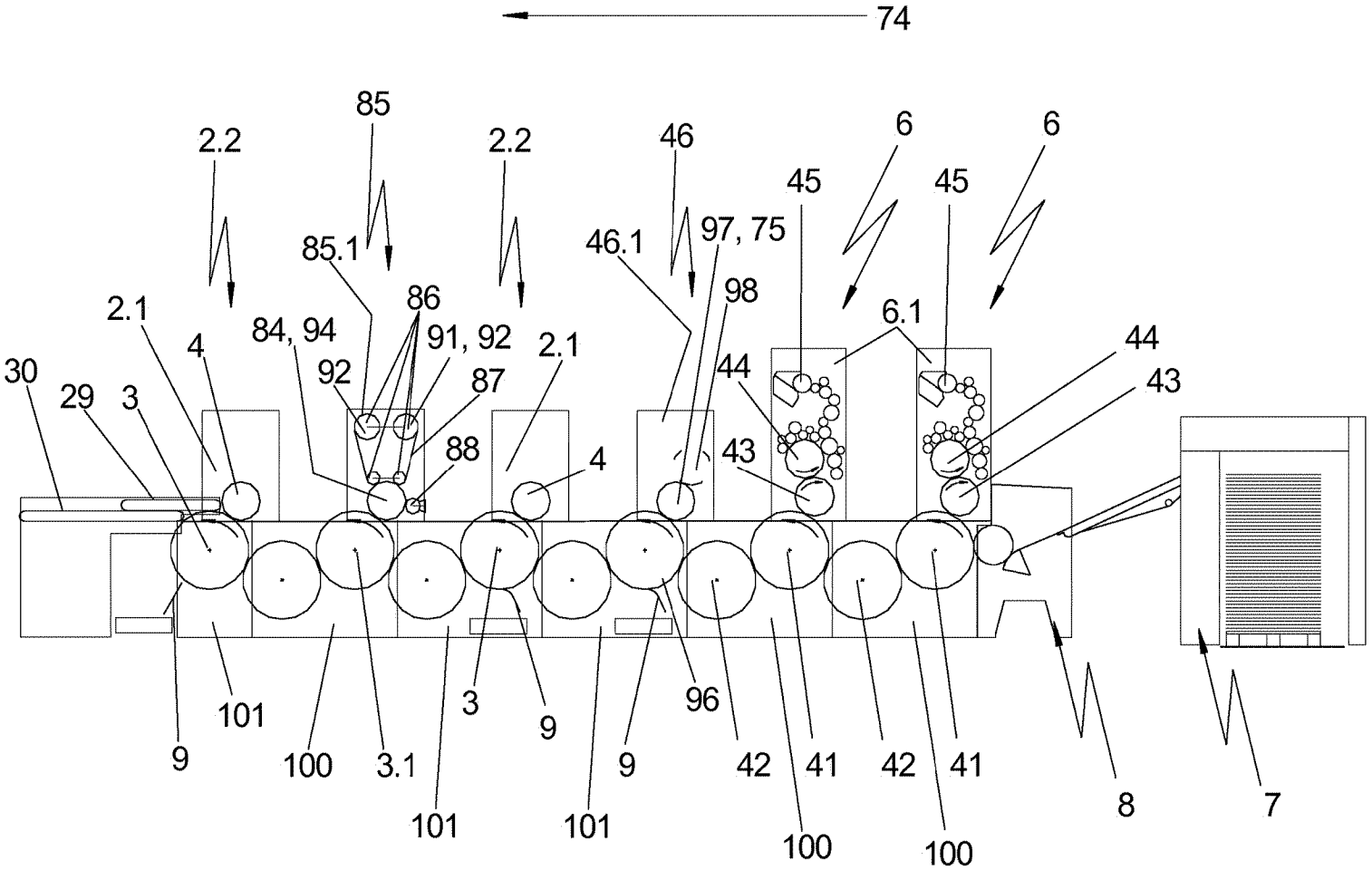

In the preferred embodiment according to FIG. 46, the following modular units are provided in succession: feed unit 7, acceleration system 8, a plurality of printing units 6, processing unit 46, separation unit 2.2, film applicator unit or window applicator unit 85, separation unit 2.2 and conveyor belts 29, 30. They function as follows: substrate sheets 1 separated by feed unit 7 are accelerated by acceleration system 8 and printed in printing units 6. Window-like recesses are then punched into substrates 1 in processing unit 46, after which waste parts 9 are removed. Additional waste parts 9 are stripped out in the subsequent separation unit 2.2. In the film applicator unit or window applicator unit 85, film sections are secured to the window-like recesses such that they overlap. In the subsequent separation unit 2.2, either only additional waste part 9 or waste parts 9 together with the frames are stripped out and removed. Conveyor belts 29, 30 transport substrate sheets 1 or stripped-out blanks 10 to a pile, depending upon the preceding separation operation.

For all the described embodiments having a film applicator unit or a window applicator unit 85, it is useful for a turning unit to be arranged directly or indirectly upstream of the unit in which the glue is applied. This has the advantage that, for the production of envelopes, for example, the cutting lines or punching lines or material cutouts resulting from the cutting or punching of substrate 1 will appear on the inside of the envelopes, where they are less objectionable than on the outside.

A preferred method for treating sheet-type substrates 1 that can be carried out with any of the embodiments according to FIGS. 33 to 46 will be described below.

The method is as follows.

In a punching method step, window-shaped regions are punched into substrates 1, preserving the material connections. In a separating method step which preferably immediately follows the punching method step, the window-shaped regions are stripped out of substrates 1, severing the material connections so that window-shaped recesses are formed in substrates 1. In a coating method step, which preferably immediately follows the separating method step, substrates 1 are coated with glue in the region bordering the window-shaped recesses. In a window application method step, film sections, the length and width of which is greater than the length and width of the window-shaped recesses, are positioned over the window-shaped recesses and secured with the glue.

In the punching method step, blanks 10 are preferably punched into substrates 1, each containing at least one window-shaped region, wherein additional material connections are maintained among the blanks 10 and between the blanks 10 and the waste parts 9. In the production of envelopes having windows, such a blank 10 would represent an unfolded envelope. Following window application, substrates 1 are deposited directly onto a pile or a conveyor belt 29, 30; alternatively, before being deposited, the additional material connections among blanks 10 or between blanks 10 and waste parts 9, e.g., the outer frames, may be separated in another separating operation. It is also possible for substrates 1 to be printed prior to the punching method step. The method steps that have been described are preferably carried out in consecutive units of a sheet processing machine, in particular a rotary printing machine.

Another embodiment relates to a method for treating sheet-type substrates 1.

This method is as follows.

A substrate sheet 1 in question is separated by a feed unit 7 from a pile of substrate sheets 1, and is then embossed and/or dried in a first processing unit 46, then creased or punched and/or surface punched in a second processing unit 46, then punched and/or surface punched and/or perforated and/or embossed and/or creased in a third processing unit 46. Between being separated in feed unit 7 and treated in first processing unit 46, said substrate sheet 1 is preferably printed in one or more printing units 6 and/or varnished in one or more varnishing units. Alternatively or additionally, the printing and/or varnishing may be carried out in at least one printing unit and/or varnishing unit between treatments in two of the processing units 46 and/or after treatment in the last processing unit 46. After separation, sheet-type substrates 1 or blanks 10 are preferably deposited onto a pile or as a sequence, shingled or unshingled, in a delivery 99 or on a conveyor belt 29, 30.

Cutting is understood, in particular, as the complete mechanical separation of an unpunched material by means of pressure, primarily under the influence of shear stresses. The cutting operation may be carried out by a knife cutting or shear cutting or burst cutting principle.

Punching is understood, in particular, as the separation of materials along a dividing line that is different from a straight line. This is preferably meant to include the production of blanks and cutouts having self-contained boundary lines. In some cases, however, open cuts are implemented by punching, for example, the rounding of corners and register punching.

Embossing is understood as the processing of materials by applying pressure using corresponding tools, causing the material to be shaped and/or deformed in the manner of a relief.

Creasing is understood as the processing of materials by applying pressure using corresponding tools, creating elongated narrow depressions in the surfaces of the material.

Perforation is understood as the processing of materials by applying pressure using corresponding tools, introducing a plurality of holes, usually arranged in lines, in the material. The distances between the holes are preferably equal.

To carry out the individual method steps of the method described, an independent unit is preferably provided for each, which may be combined with other units in any order for the purpose of implementing altered production sequences. To this end, the units preferably have independent frame walls. In particular, the punching method step or the punching and separating method steps are carried out using a punching unit, the separating method step is carried out using a separation unit 2.2, the coating method step is carried out using a coating unit 88.2, the window application method step or the coating and window application method steps are carried out using a window applicator unit 85. Each of the aforementioned units, with the exception of the last unit, will transfer substrate 1 to the unit that follows it, after carrying out at least one method step.

Depending on the machine configuration implemented in a given case, with or without the film applicator unit or window applicator unit 85, after passing through various processing stages, either substrate sheets 1 (blanks 10 connected to one another via residual tabs, with or without frames) are obtained, which are stacked in a delivery 99 to form piles, or punched-out blanks 10 are obtained, which are preferably conveyed out of the machine on a conveyor belt 30. These blanks 10 are preferably divided into blank streams, which are spaced a lateral distance apart from one another. For this purpose, a plurality of roller pairs is arranged downstream of conveyor belt 30, each roller pair being arranged such that it diverges from the other roller pairs, i.e., having a different lateral angular position. Each roller pair forms a roller nip and revolves at a circumferential speed greater than the speed of conveyor belt 30. Blanks 10 situated side by side and one after the other are conveyed by conveyor belt 30 up to and into a respective roller nip. In the roller nip the blanks 10 are then gripped, accelerated to the circumferential speed of the rollers, and brought to a distance from one another according to the orientation of the roller pair. The roller pairs can be displaced transversely to their transport direction 74 for positioning on blanks 10. A conveyor belt is arranged downstream of the roller pairs, for receiving blanks 10, which are now spaced a distance apart from one another laterally and transporting them away. The downstream conveyor belt preferably runs at a lower speed than the circumferential speed of the roller pairs.

Figure 18:
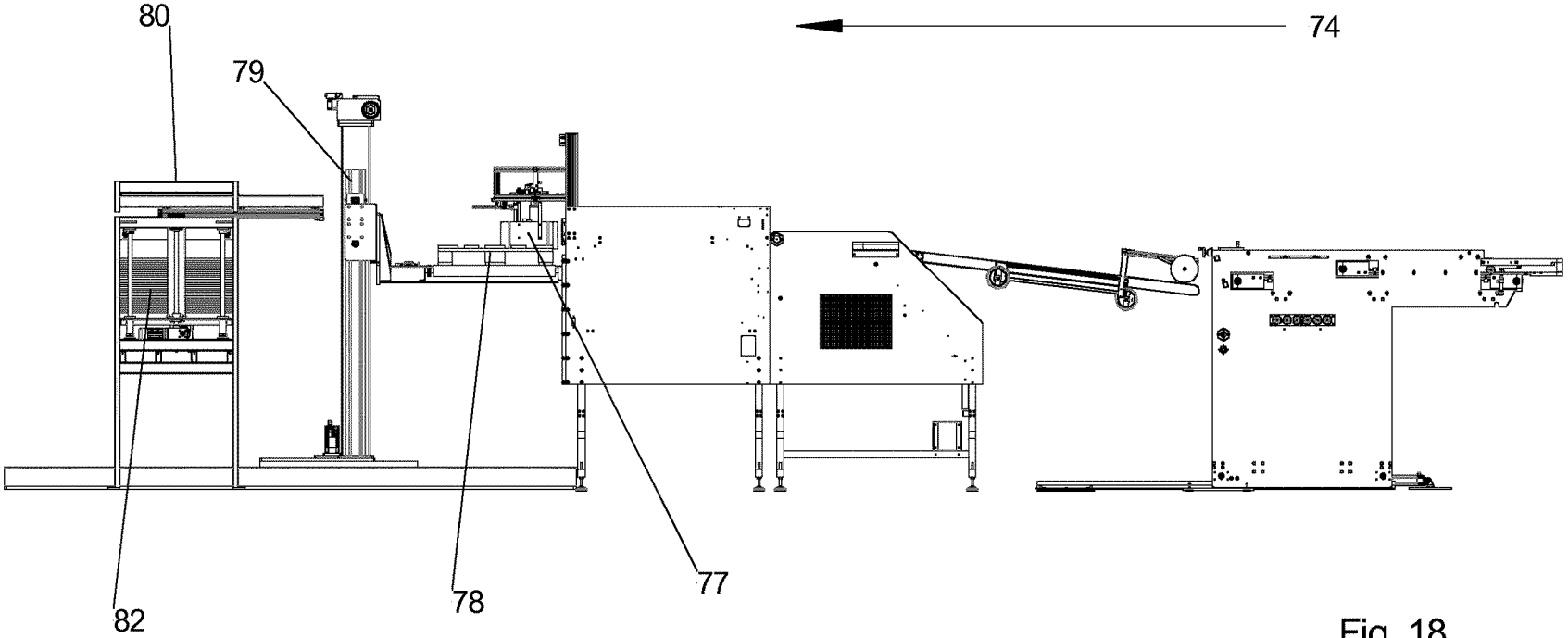
FIG. 18 shows a device for treating/stacking substrates, in a side view
Figure 19:
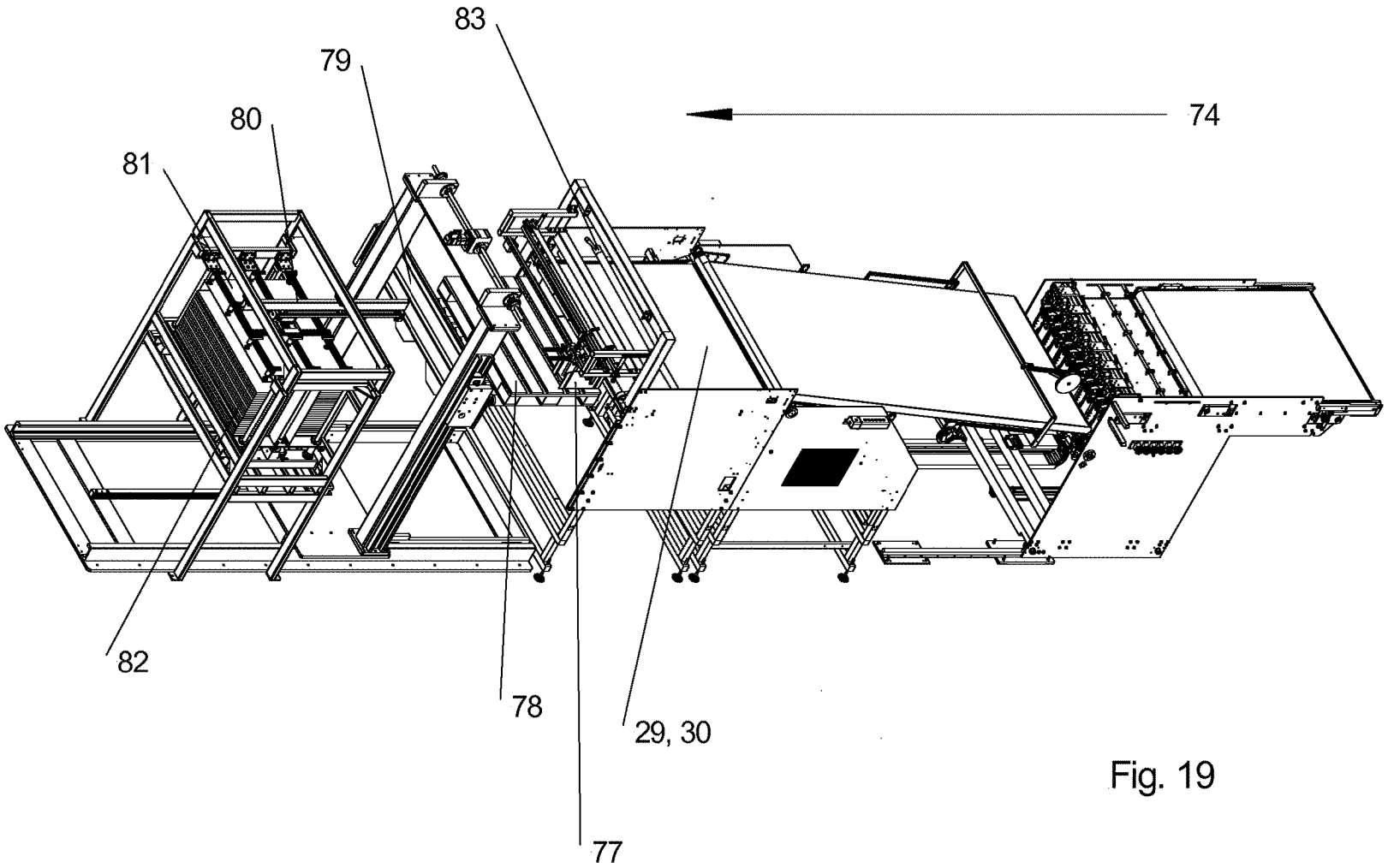
FIG. 19 shows a device for treating/stacking substrates, in a perspective view
Figure 20:
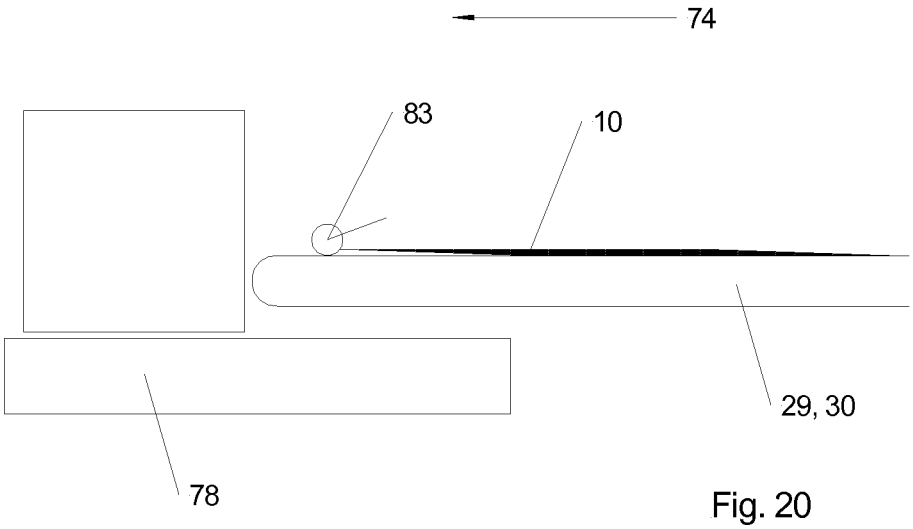
FIGS. 20 to 32 show details of the device according to FIGS. 18 and 19

A device for treating, in particular depositing, substrates 1, in particular blanks 10, may be connected to the downstream conveyor belt and will be described below specifically in reference to FIGS. 18 and 19. The device comprises a revolving conveyor belt 29, 30, which conveys substrates 1, in particular blanks 10, in at least one web, preferably as a shingled stream, against at least one stop 77, for the purpose of depositing substrates 1 onto a pile carrier 78. Pile carrier 78 may be a commercial pallet or a system pallet, such as those used in logistics systems in print shops or in further processing areas. A transport device 79 is provided for handling, in particular for repositioning the pile carrier 78; with this transport device, pile carrier 78 can be repositioned under the at least one stop 77 and/or the conveyor belt 29, 30 in such a way that substrate sheets 1 or blanks 10 being conveyed by conveyor belt 29, 30 will be deposited onto pile carrier 78. Transport device 79 is configured for vertical and horizontal repositioning of pile carrier 78. A device for forming a gap in shingled stream 83 is assigned to conveyor belt 29, 30 and is preferably embodied as a roller 83. Roller 83 is arranged such that it can be repositioned, to which end it is preferably mounted on levers at its ends. When a gap is to be formed in the shingled stream to allow pile carrier 78 to be repositioned or replaced, for example, roller 83 is repositioned or pivoted until it is in surface contact with conveyor belt 29, 30. If the movement of conveyor belt 29, 30 continues to convey substrate sheets 1, then these sheets will accumulate at roller 83. Roller 83 may be mounted in a stationary or rotary mount and is preferably braked in the latter case.

Transport device 79 is configured for repositioning pile carrier 78 in one or more positions in which pile carrier 78 and the at least one stop 77 and/or pile carrier 78 and conveyor belt 29, 30 overlap. A plurality of stops 77 is preferably arranged in groups side by side, transversely to transport direction 74 of substrate sheets 1 or of blanks 10 on conveyor belt 29, 30. More preferably, each group of stops 77 has either two lateral stops or two lateral stops and one back stop. In that case, one group of stops preferably forms a sort of pocket, which is aligned to the stream(s) of substrate sheets 1 or blanks 10 on conveyor belt 29, 30 by laterally positioning the stops 77. Stops 77 are configured as vertically movable. For the synchronous repositioning of stops 77, one or more drives are provided. Transport device 79 preferably has a drive embodied for the continuous or discontinuous repositioning of pile carrier 78. Transport device 79 is preferably configured for repositioning pile carrier 78 in and opposite transport direction 74 of conveyor belt 29, 30. More preferably, transport device 79 is configured for repositioning pile carrier 78 in transport direction 74 of conveyor belt 29, 30 based upon the length of substrates 1 or blanks 10 in transport direction 74 of conveyor belt 29, 30. More preferably, transport device 79 is configured for implementing a cycle of movements, comprising a first movement and at least one additional movement of pile carrier 78 in transport direction 74 of conveyor belt 29, 30, in which pile carrier 78 remains stationary with respect to the transport direction 74 of conveyor belt 29, 30 between its first movement and its at least one additional movement.

In addition, a feed device 80 may be provided, with which at least one separation element 81 can be positioned on the substrates 1 carried by pile carrier 78. Feed device 80 comprises a separation device, which separates the separation elements 81 from a pile 82 composed of a plurality of separation elements 81. Separation elements 81 are preferably sheet-type materials, which can be inserted between piles of blanks for spatially separating the blanks from one another. Feed device 80 may be formed by a horizontally repositionable frame, the bottom side of which is associated with vertically repositionable suckers or other suitable securing elements. It is also possible to configure feed device 80 as having rigid suckers or other suitable securing elements, as long as the frame allows a vertical movement for lifting a respective separation element 81.

Preferred movement sequences implemented by pile carrier 78 through the action of transport direction 74 shall be described below by way of example, specifically in reference to FIGS. 20 to 32.

Figure 21:
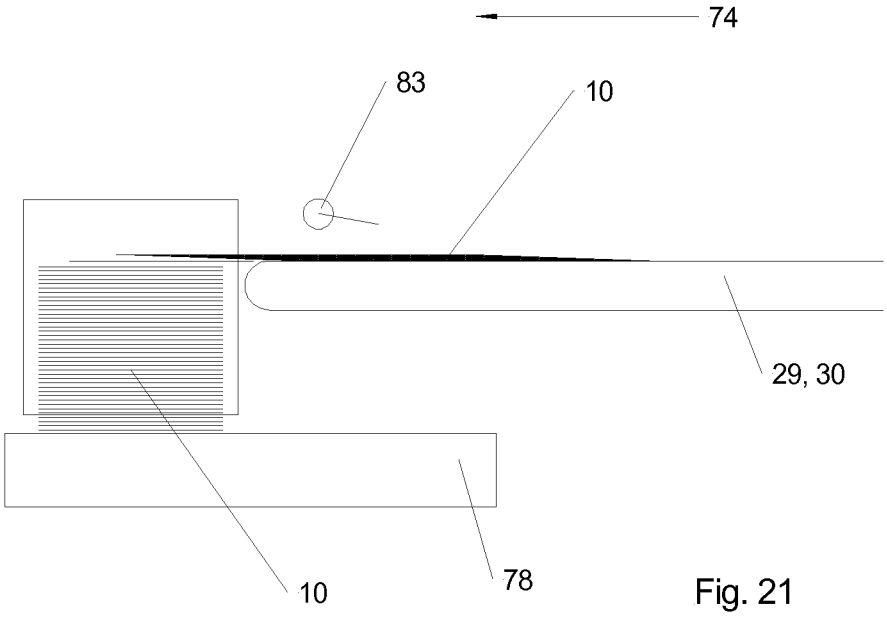
Figure 22:
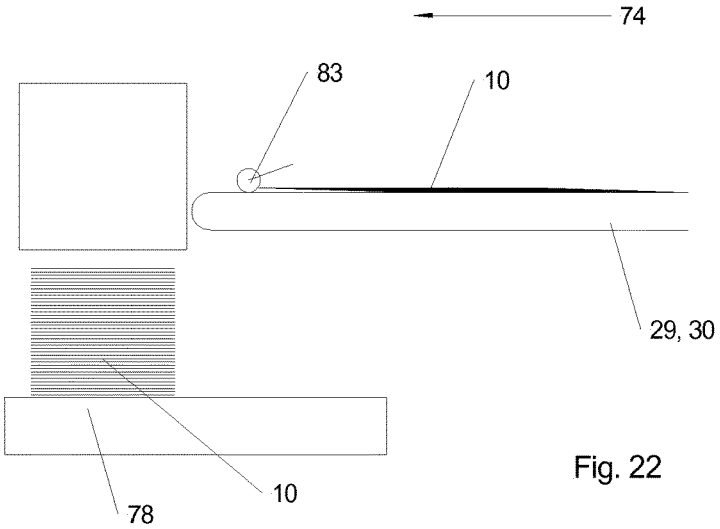
Figure 23:
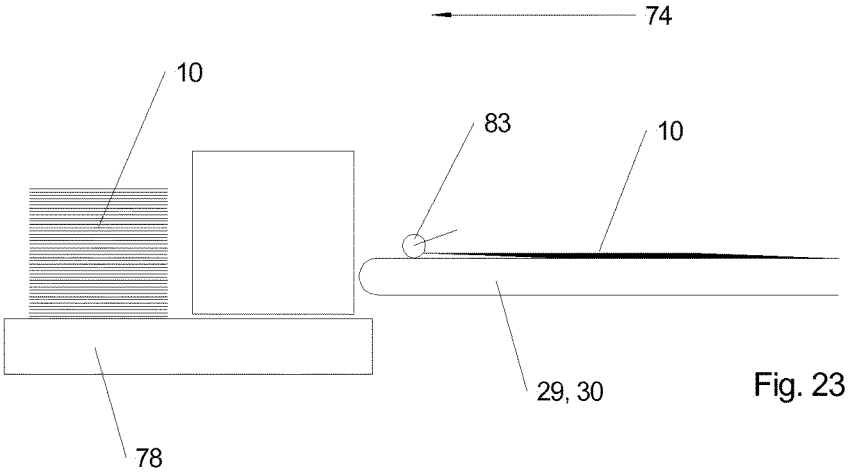
Figure 24:
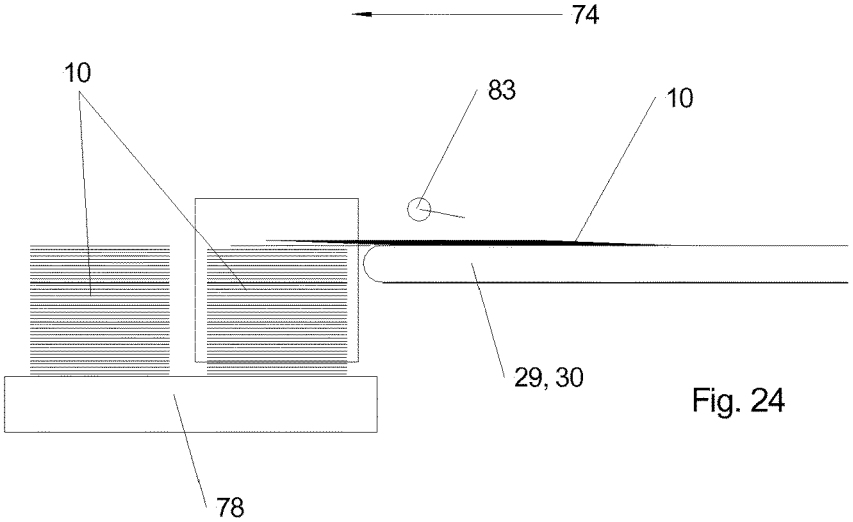

First, pile carrier 78 is positioned by transport device 79 with respect to conveyor belt 29, 30 such that the pile carrier in its vertical position is the shortest possible distance from the bottom side of the conveyor belt. With respect to its horizontal position, positioning is carried out such that blanks 10 or substrate sheets 1 that are conveyed by conveyor belt 29, 30 are deposited onto pile carrier 78. With conveyor belt 29, 30 revolving, substrate sheets 1 or blanks 10 are then conveyed onto pile carrier 78 and thereby oriented laterally by the stops 77 and preferably also in transport direction 74. As the operation continues, the pile of substrate sheets 1 or blanks 10 grows, as illustrated in FIG. 21. Pile carrier 78 is preferably lowered. Stops 77 may also be lowered in synchronization with the lowering movement of pile carrier 78. Alternatively, pile carrier 78 may also be positioned from the beginning at such a vertical distance from conveyor belt 29, 30 that it is capable of receiving a sufficient quantity of substrate sheets 1 or blanks 10 without any vertical movement. Only one pile is shown in FIG. 21. In addition to this pile, a plurality of other piles may be formed side by side at the same time. When the pile of substrate sheets 1 or blanks 10 has reached a sufficient height, stops 77 are moved vertically back to their starting position, assuming they were repositioned with pile carrier 78. Pile carrier 78 is moved vertically back to its starting position and horizontally by a distance corresponding to the length of substrate sheets 1 to be deposited plus a distance value. The chronological sequence of the repositioning of pile carrier 78 and stops 77 is irrelevant as long as collisions are prevented. The repositioning preferably takes place in synchronization. During the repositioning of pile carrier 78, the device for forming a gap in shingled stream 83 is activated, so that no substrate 1 or blank 10 is supplied to pile carrier 78 during this time. Once the device to form a gap in shingled stream 83 has been deactivated, the next pile of substrate sheets 1 or blanks 10 can be formed on pile carrier 78 (FIG. 24).

Figure 25:
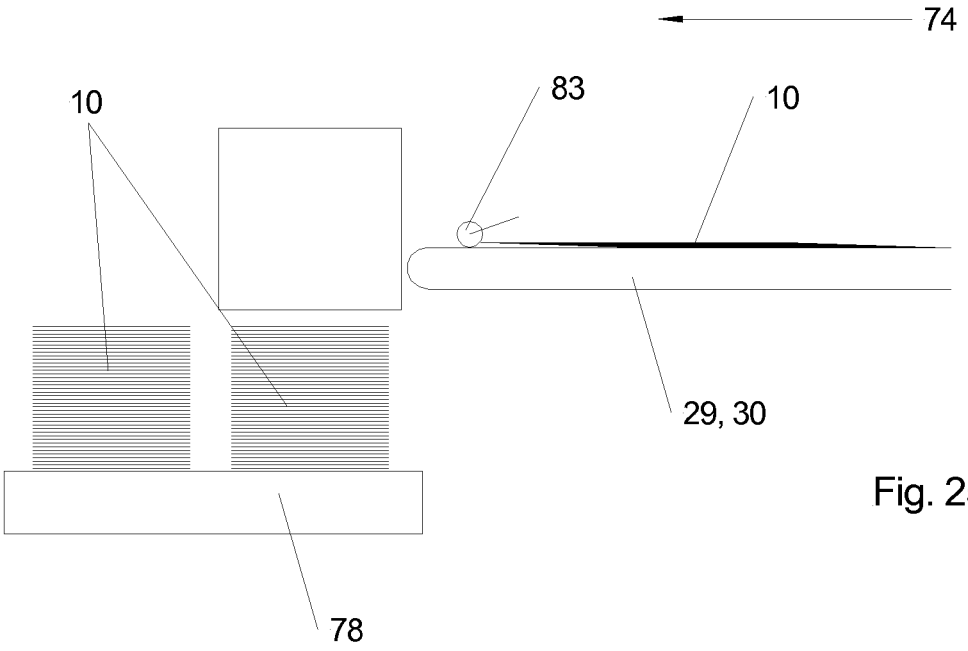

The operations are then repeated one or more times, as described for the formation of the first pile of substrate sheets 1 or blanks 10, until another pile or multiple other piles of the same desired height are formed, situated one behind the other and optionally also side by side, as seen in transport direction 74 (FIG. 25).

Figure 26:
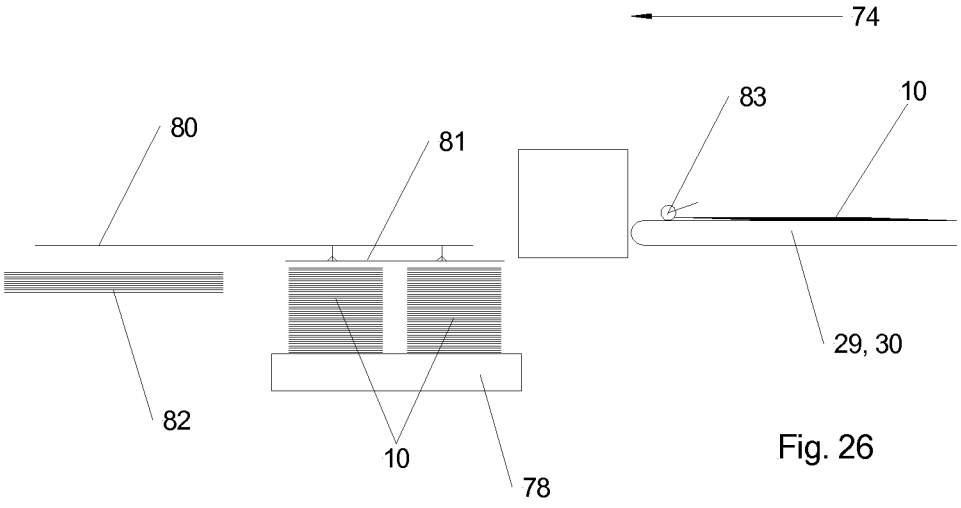
Figure 27:
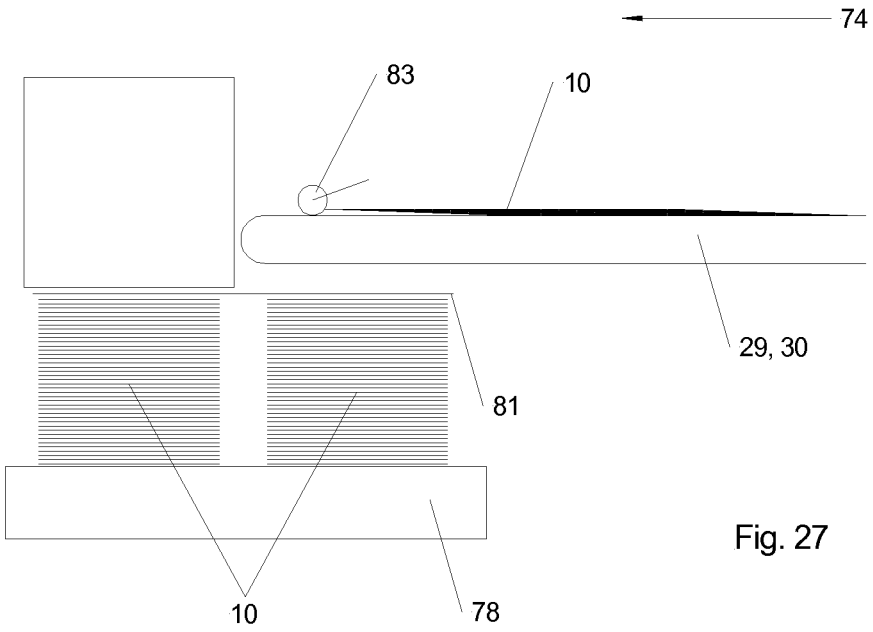

At this point in the sequence, feed device 80 may come into use. It detects the topmost separation element 81 of the pile 82 of separation elements 81 and transports it above the pile of substrate sheets 1 or blanks 10 formed on pile carrier 78, where it is released and deposited onto the topmost substrate sheet 1 or blank 10 in question (FIG. 26). The surface of separation sheet 81 takes the place of the surface of pile carrier 78 in the continued operation and thus forms the new pile plane.

Figure 28:
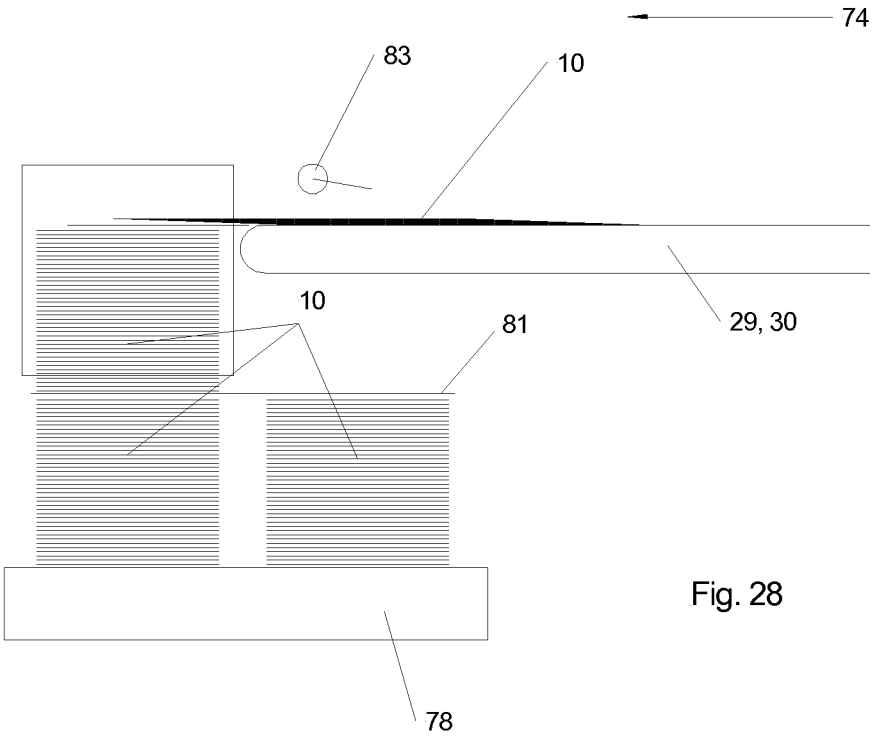

On the new pile plane, a single pile or a series of piles of substrate sheets 1 or blanks 10 is formed in a next step. For this purpose, pile carrier 78 is positioned with respect to its vertical position by transport device 79 such that the new pile plane is below the release plane of conveyor belt 29, 30. With respect to its horizontal position, the pile carrier is positioned such that blanks 10 or substrate sheets 1 conveyed by conveyor belt 29, 30 are deposited onto separation element 81 (FIG. 28).

Figure 29:
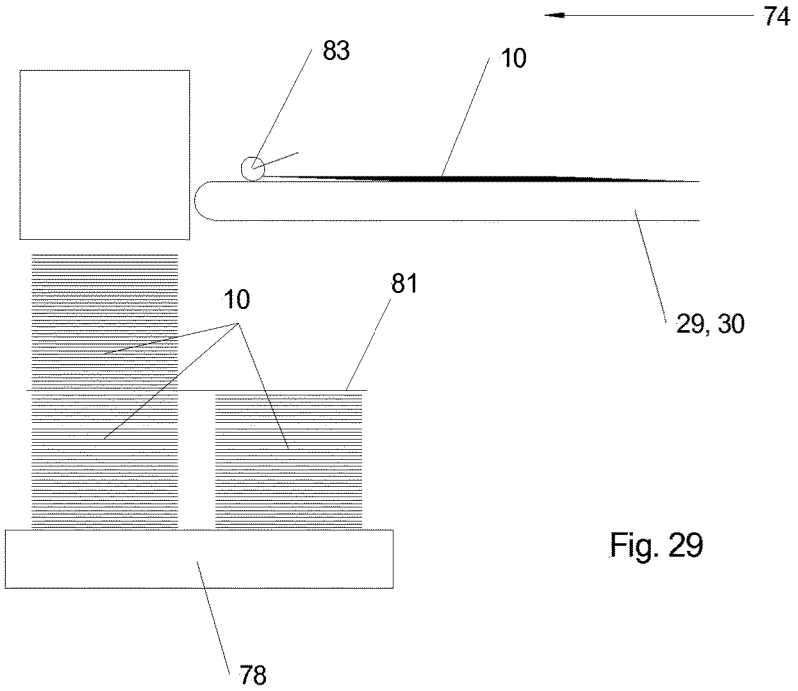
Figure 30:
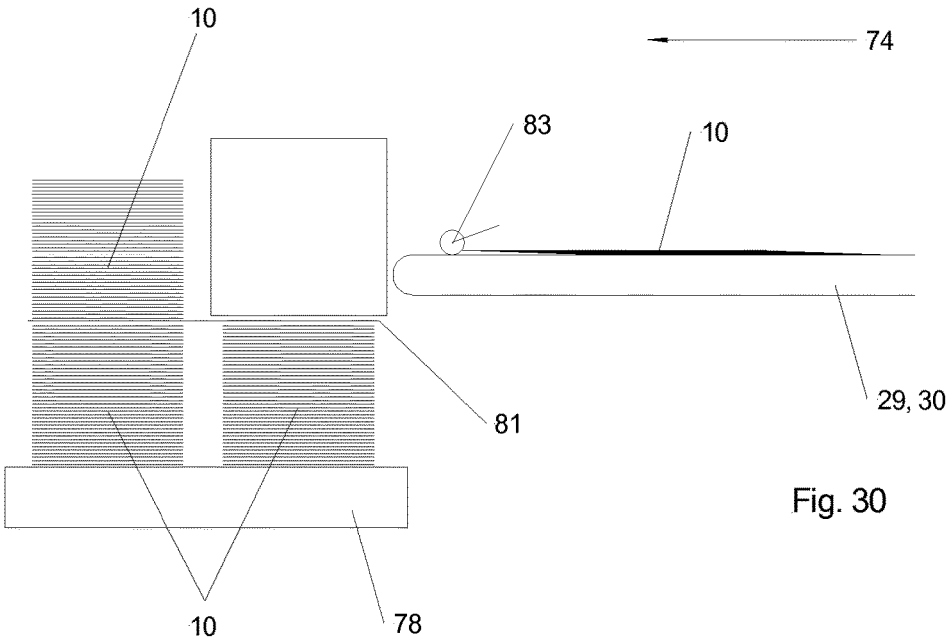

With conveyor belt 29, 30 revolving, substrate sheets 1 or blanks 10 are then conveyed onto separation element 81 and are thereby aligned by stops 77 laterally and preferably also in transport direction 74. As the operation continues, the pile of substrate sheets 1 or blanks 10 grows as illustrated in FIG. 29.

Pile carrier 78 is preferably lowered. Stops 77 may also be lowered in synchronization with the lowering movement of pile carrier 78. Alternatively, pile carrier 78 may also be positioned from the beginning at such a vertical distance from conveyor belt 29, 30 that it is capable of receiving a sufficient quantity of substrate sheets 1 or blanks 10 without any vertical movement. When the pile of substrate sheets 1 or blanks 10 has reached a sufficient height, stops 77 are moved vertically back to their starting position, assuming they were repositioned with pile carrier 78. Pile carrier 78 is moved vertically back to its position at the start of formation of the first pile on separation element 81, and horizontally by a distance corresponding to the length of substrate sheets 1 to be deposited plus a distance value.

Figure 31:
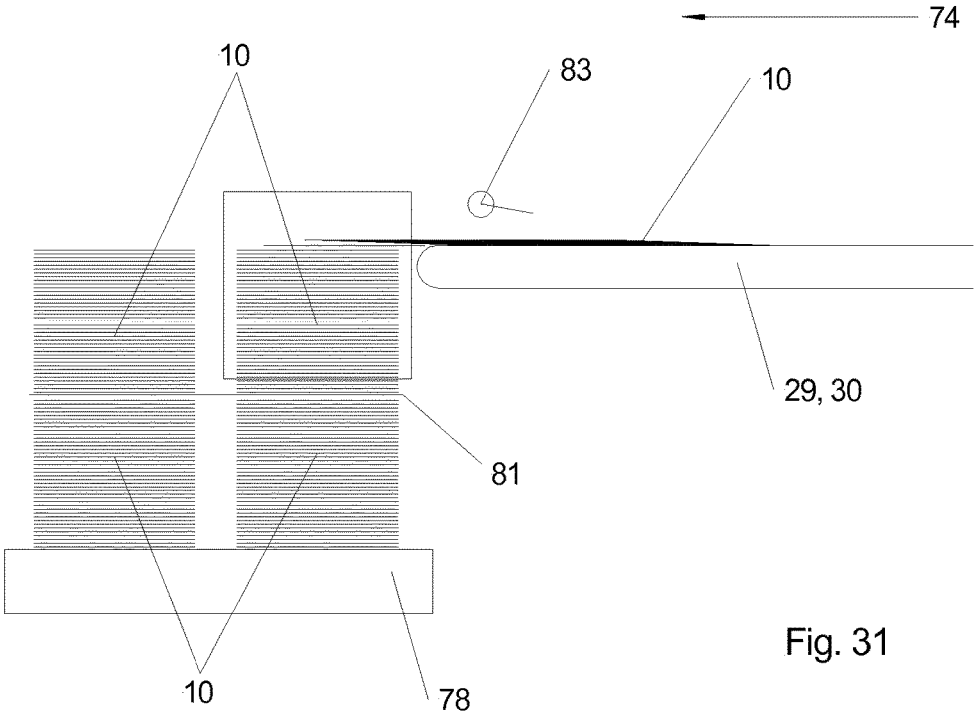
Figure 32:
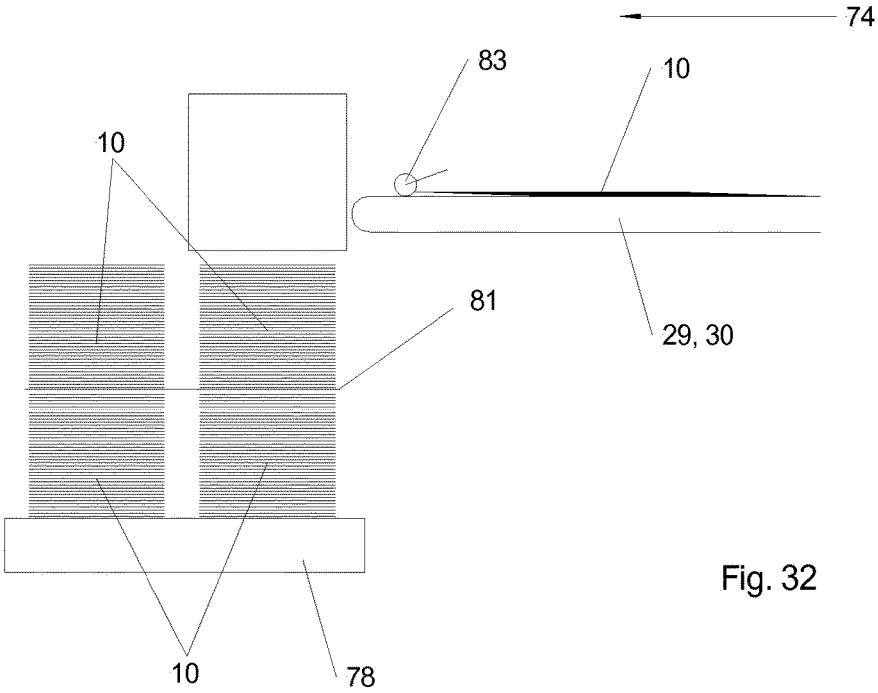

During the repositioning of pile carrier 78, the device for forming a gap in shingled stream 83 is activated, so that no substrate sheets 1 or blanks 10 are fed to pile carrier 78 during this time. Once the device for forming a gap in shingled stream 83 has been deactivated, the next pile of substrate sheets 1 or blanks 10 can be formed on separation element 81 (FIG. 31). When a sufficient number of piles of substrate sheets 1 or blanks 10 has been formed on pile carrier 78, the loaded pile carrier 78 is transported away and replaced by a new pile carrier 78 ready to receive.

The sequence of units in the sheet-fed printing machine is based on the technological requirements. Preferably, one or more processing units 46 are provided following one or more printing units 6. In the case of multiple printing units 6, these are usually equipped with different tools from the group composed of cutting tools, punching tools, creasing tools, perforating tools and grooving tools. One or more processing units 46 may also be positioned upstream of one or more printing units 6. Alternatively, an intermediate connection of one or more processing units 46 between one or more printing units 6 is also provided. The sheet-fed printing machine preferably also comprises one or more varnishing units, preferably connected downstream of printing units 6 or connected to processing units 46.

A substrate processing machine, in particular a sheet processing machine, which is not a printing machine, may be configured like the sheet-fed printing machine described here, minus the printing units 6.

Figure 3:
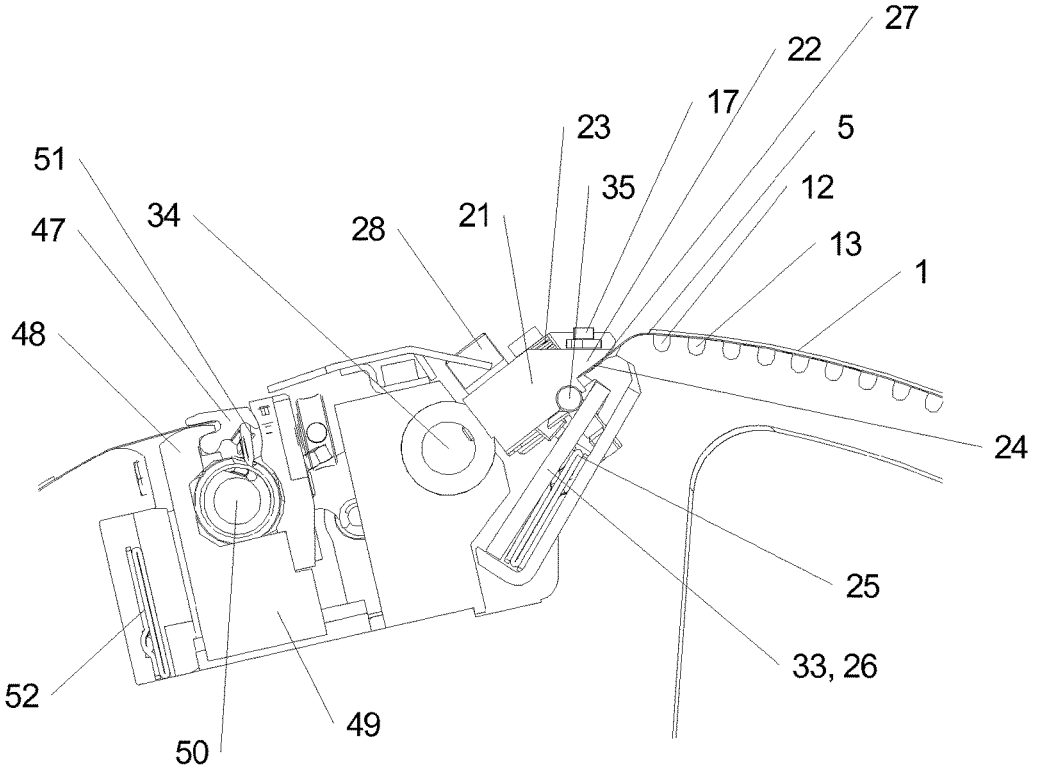
FIG. 3 shows a detail of the transport cylinder in the region of the cylinder channel, with means for securing the packing in the closed state
Figure 4:
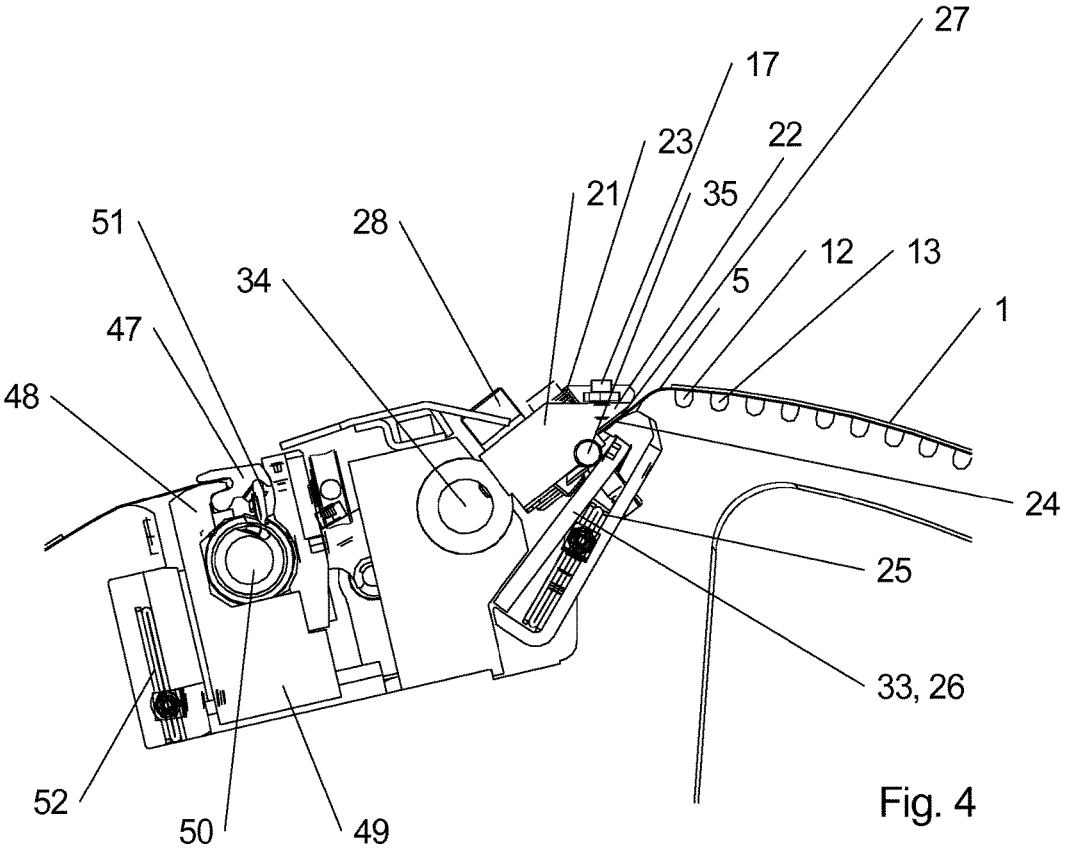
FIG. 4 shows a detail of the transport cylinder in the region of the cylinder channel, with means for securing the packing in the open state

Separation system 2 is provided downstream of printing units 6 or processing units 46. The separation system comprises a transport cylinder 3. Transport cylinder 3 is double-sized, i.e., it transports two substrate sheets 1 per revolution. However, the invention is not limited to a double-sized embodiment of transport cylinder 3. The invention will be described below on the basis of a single-sized system. This description is also representative of the double-sized system or a multiple-sized system accordingly. In the region of the circumferential surface of transport cylinder 3, a sheet holding system, in particular a gripper system (in the case of a double-sized system, two sheet holding systems are provided), is provided for securing the leading edges of sheet-type substrate 1. The gripper system is preferably embodied as a suction gripper system 17, also referred to as a sucker system 17 and is supplied with air by air supply means. Suction gripper system 17 is configured to generate a suction region, the length of which in the axial direction of transport cylinder 3 is equal to a multiple of its length in the circumferential direction. The length of the suction region of suction gripper system 17 in the circumferential direction of transport cylinder 3 is preferably less than 20 mm, more preferably less than 15 mm, more preferably less than 10 mm. The suction region may be formed by a continuous opening extending over the width of transport cylinder 3 or by a plurality of suction openings arranged side by side. The at least one suction opening is arranged for securing the leading edge of substrate 1 in such a way that it is spaced a distance from packing 5 when packing 5 is secured in the circumferential direction of transport cylinder 3. The length of the suction region in the axial direction of transport cylinder 3 is advantageously embodied as adjustable. For this purpose, adjustment means 28, in particular in the form of shut-off valves, may be provided, in particular, in the feed path of the suction air for the outer suction openings with respect to the center of transport cylinder 3. The adjustability of the length of the suction region has the advantage that it minimizes suction air consumption. Transport cylinder 3 further preferably has means for securing a replaceable packing 5 (in the case of a double-sized system, two securing means are provided). The securing means are preferably embodied as clamping grippers. With these grippers, a respective packing 5 can be secured at the trailing edge and at the leading edge. The means for securing the leading edge of packing 5 are preferably formed by leading-edge clamping element 22 (also referred to as a clamping jaw) and the additional clamping element 24 (also referred to as a striking surface), which correlates and cooperates therewith to form a clamping gap. Additional clamping element 24 is fixedly mounted on the main body of transport cylinder 3. Clamping element 22 is fixedly connected to a lever 21, which is mounted to pivot about a fulcrum 34 on the main body of transport cylinder 3. Lever 21 is prestressed by an energy accumulator 23, preferably embodied as a spring, in such a way that the clamping gap formed between clamping element 22 and additional clamping element 24 closes. Spring 23 is embodied as a compression spring and is supported at one end on lever 21 and at its other end on the head of a screw, which is screwed into the main body of transport cylinder 3. FIG. 3 shows the leading-edge clamping gripper with the leading edge of packing 5 secured, i.e. in the closed state. FIG. 4 shows the leading-edge clamping gripper with the leading edge of packing 5 released, i.e. in the open state. The leading-edge clamping gripper is opened against the active force of spring 23. The force required to open the leading-edge clamping gripper is preferably applied by an actuator 23, which may be embodied in particular as a pneumatic muscle 25. The actuator, i.e. pneumatic muscle 25, preferably acts on an additional lever 33, one end of which is supported on a fixed point of transport cylinder 3. Additional lever 33 can be pivoted about the aforementioned fixed point under the acting force of actuator 23, which may be embodied in particular as a pneumatic muscle 25. In the embodiment thereof as a pneumatic muscle 25, the muscle is acted upon by compressed air, causing it to expand, pivoting additional lever 33. The pivoting movement of additional lever 33 is limited by a wall formed on transport cylinder 3. Additional lever 33 acts on a ball 35 provided between additional lever 33 and lever 21, displacing the ball. The displacement of ball 35 causes lever 21 and, with it, leading-edge clamping element 22 to be displaced. When actuator 23 is activated in the opposite direction or if pneumatic muscle 25 becomes pressureless, i.e. forceless, then the force from energy accumulator 23, in particular spring 23, will cause lever 21, ball 35 and additional lever 33 to be moved back toward their starting position until their movement is halted by stops on leading-edge clamping element 22, on additional leading-edge clamping element 24 or on packing 5. The trailing edge of packing 5 can be secured between a trailing-edge clamping element 47 and an additional trailing-edge clamping element 48, which together form an additional clamping gap. The force required to close the trailing-edge clamping gripper is applied by a rotatable clamping shaft 50, which acts on trailing-edge clamping element 47 via a toggle lever 51. For clamping the packing 5, at least one of the clamping grippers, i.e., the leading-edge clamping gripper or the trailing-edge clamping gripper, can be displaced in the circumferential direction of the transport cylinder. In FIGS. 3 and 4, the trailing-edge clamping gripper can be displaced. In particular, the trailing-edge clamping gripper is mounted on a carriage that is displaceable in the circumferential direction of transport cylinder 3. Carriage 49 preferably also carries clamping shaft 50 and toggle lever 51 in addition to the trailing-edge clamping gripper. To clamp packing 5, said packing is first secured at both ends by the leading-edge clamping gripper and the trailing-edge clamping gripper. Next, carriage 49 is shifted clockwise, which is accomplished by an additional actuator 52, which may also be embodied as a pneumatic muscle. Regardless of the nature of the embodiment of the means for securing packing 5, they preferably include positioning pins or positioning elements are preferably assigned to them. In particular, the positioning pins or positioning elements may be assigned directly to the additional leading-edge clamping element 22.

Transport cylinder 3 preferably has first and second openings 12, 13, which, when packing 5 is secured, are covered at least partially by perforations that can be formed in packing 5. Openings 12, 13 are connected to air supply means 14, 15. In particular, first air supply means 14 are provided for supplying air to first openings 12, and second air supply means 15 are provided for supplying air to second openings 13. In the following context, air is understood to refer to all forms of system air, i.e. in particular, blower air or suction air, which are suitable in particular for exerting a physical effect, such as an acting force, and can be characterized by at least one of the parameters: static pressure, dynamic pressure or volume flow. In this connection, the chemical composition of the air and its humidity level, in particular, are irrelevant. Such air is generated in a known manner by using compressors, condensers, vacuum pumps, suction pumps or similar components. The aforementioned air-generating devices may, by the first and second air supply means 14, 15 of the transport cylinder and in particular together with all means that supply air to openings 12, 13 and/or control the supply, form the air supply means 14, 15.

The first and second openings 12, 13 can preferably be supplied with air independently of one another. The supply of air either to the first or the second openings 12, 13 or to both openings 12, 13 is preferably embodied as switchable. Switchability in this context is understood in particular to refer to switching between suction air and blower air, and the type of air supply being switched to in which type is irrelevant.

The first and second openings 12, 13 are formed in the circumferential surface of transport cylinder 3. The first and second openings 12, 13 are preferably each arranged in alternation in the circumferential direction of transport cylinder 3 or in the axial direction of transport cylinder 3. The first and/or second openings 12, 13 are preferably in the form of grooves or holes. The arrangement of the first and second openings 12, 13 in the circumferential surface of transport cylinder 3 preferably yields a fine mesh networks of elements with which it is possible to supply air to perforations that may be formed in packing 5. The perforations in packing 5 are arranged in accordance with the arrangement of waste part(s) 9, on the one hand, and blanks 10, on the other hand. Thus, for example, in the region of the first openings 12, which are formed in the region of the blanks, perforations may be formed in packing 5, whereas in packing 5, no perforations are opposite any of the second openings 13 that are formed in the region of blanks 10. The same applies similarly to the region of waste parts 9, wherein perforations in packing 5 are opposite second openings 13, while the first openings 12 are covered by closed region of packing 5. These measures allow blanks 10 and waste parts 9 to be treated differently and/or secured on the circumferential surface of transport cylinder 3 and/or its packing 5.

Figure 2:
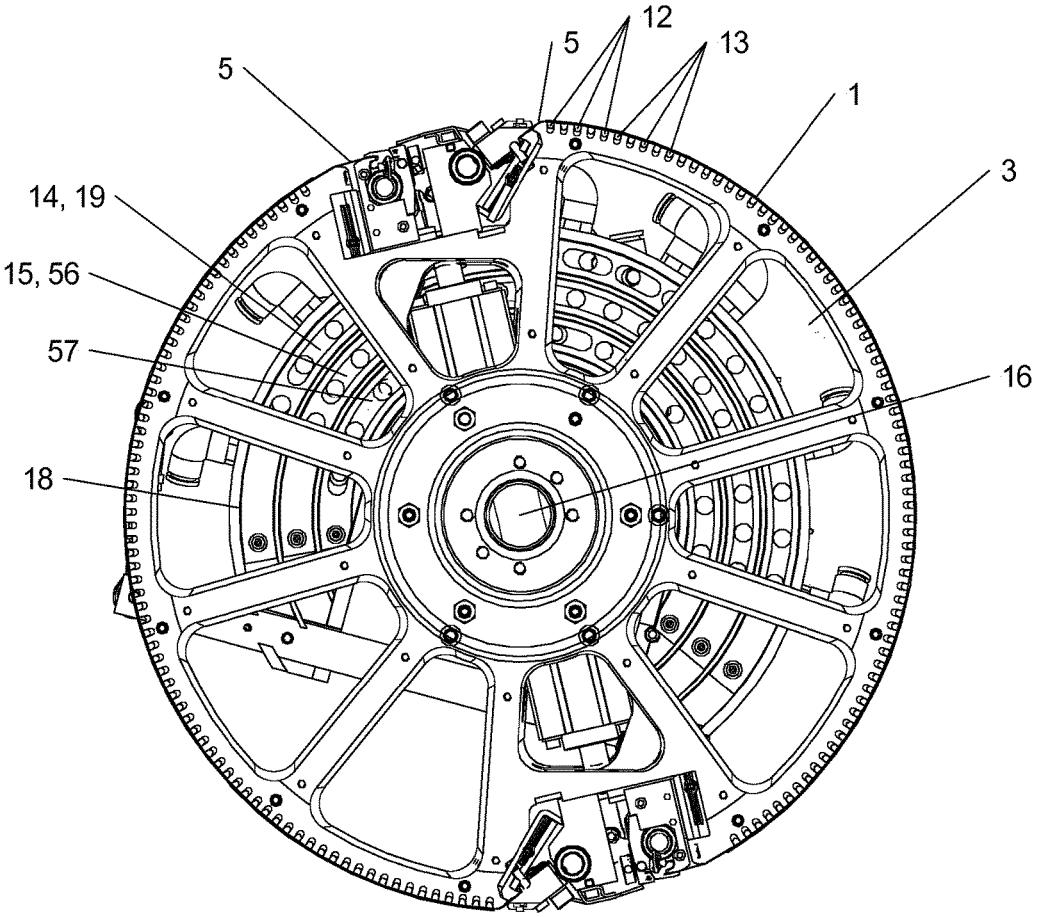
FIG. 2 shows the transport cylinder of the separation system
Figure 5:
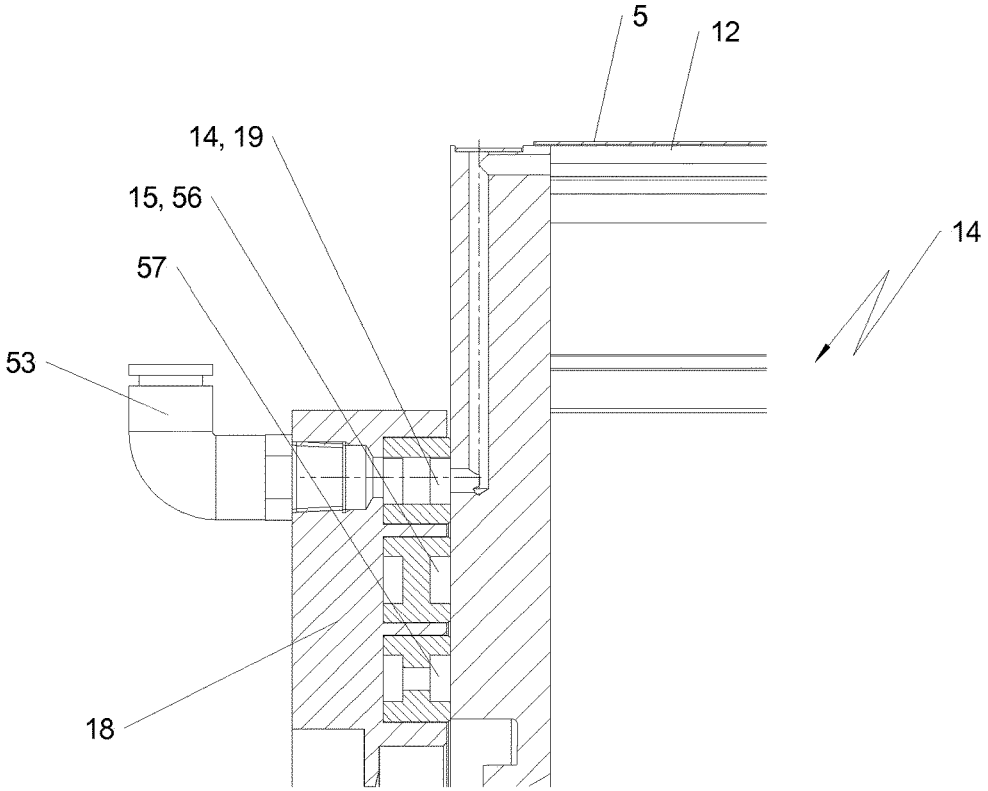
FIG. 5 shows a first air supply means
Figure 6:
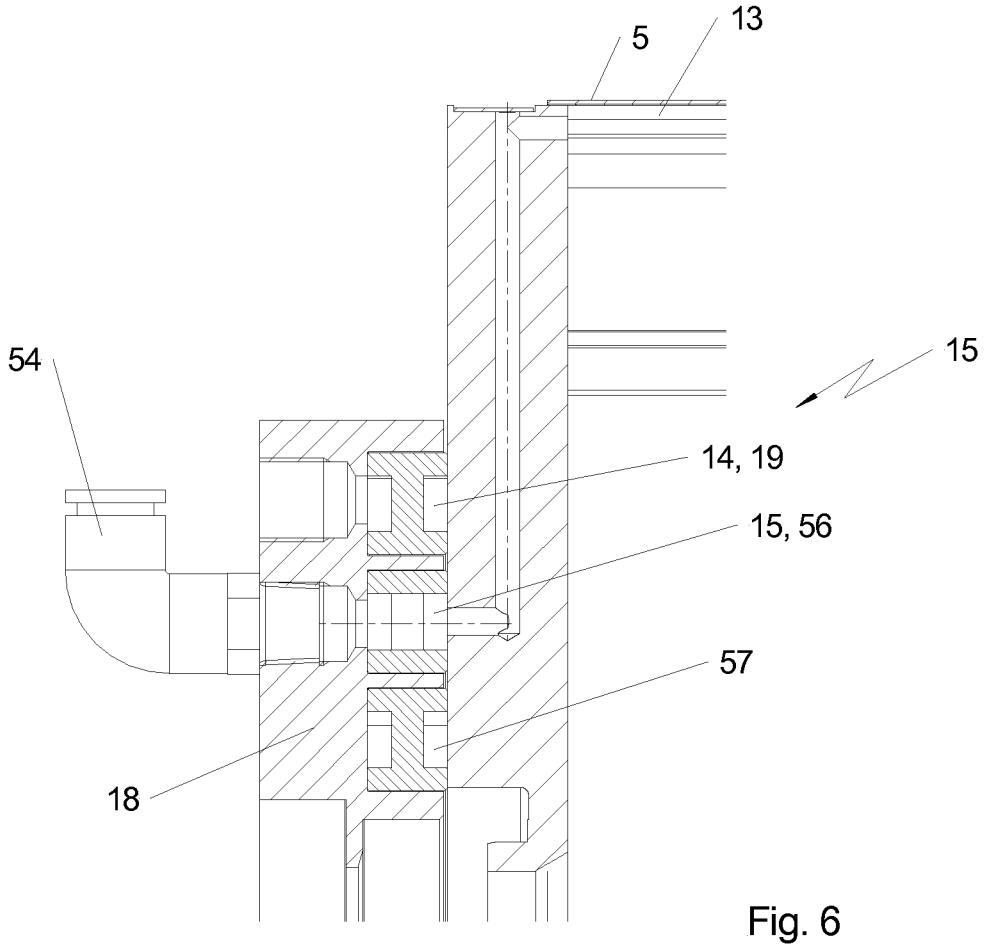
FIG. 6 shows a second air supply means
Figure 7:
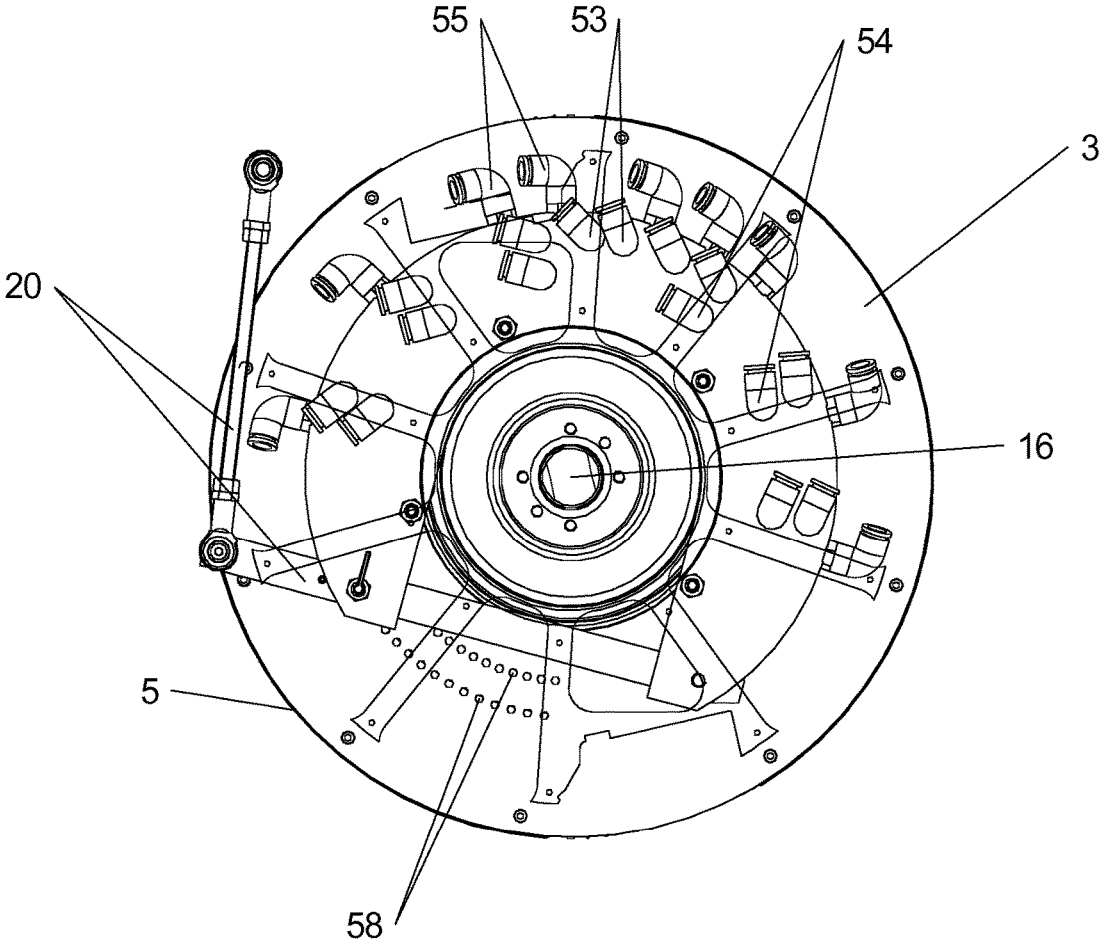
FIG. 7 shows the transport cylinder with air supply means

The details of the supply of air to the first and second openings 12, 13 are illustrated in particular in FIGS. 5, 6 and 7. The air supply means 14, 15 for supplying air to the first and second openings 12, 13 preferably comprise one or more rotary slide valves or rotary inlets. The rotary slide valves or rotary inlets are preferably formed on the end face of transport cylinder 3 or are associated therewith. Preferably, two rotary slide valves or two rotary inlets are formed on opposing end faces of transport cylinder 3. In the example illustrated in FIGS. 5, 6 and 7, the rotary slide valve or the at least one rotary inlet comprises a disk 18, assigned to one of the end faces of transport cylinder 3. A plurality of groove-type recesses 19, 56, 57 is formed in disk 18, preferably extending in the form of a circular segment, coaxially to the axis of rotation 16 of transport cylinder 3. Recess 19 is supplied with air via a first supply port 53, recess 56 is supplied with air via a second supply port 54 and recess 57 is supplied with air via a third supply port 55. Recesses 19, 56 and 57 are formed on the side of disk 18 that faces transport cylinder 3. They extend in the form of a circular segment, coaxially to the axis of rotation 16 of transport cylinder 3, at different radii. It is not necessary for each of recesses 19, 56, 57 to be continuous in the circumferential direction of disk 18, rather they may be interrupted, so that a plurality of recesses 19, 56 and 57, situated one behind the other in the circumferential direction of disk 18, is formed on the same radius. Recesses 19, 56 and 57 correspond to openings 58 formed in the end face of transport cylinder 3 in terms of their distance (radius) from the axis of rotation 16 of transport cylinder 3. Each opening 58 in the end face of transport cylinder 3 communicates via additional lines with either one or more first openings 12, or one or more second openings 13 in the circumferential surface of transport cylinder 3 or with suction gripper system 17. This is of course true only as long as the opening in question is opposite respective recess 19, 56 and 57, dependent upon the angular position of transport cylinder 3. In the embodiment illustrated in FIG. 2, the recesses 57 situated closest to the axis of rotation 16 of transport cylinder 3 supply air to suction gripper system 17, the recesses 56 adjacent to these supply air to the second openings 13 and the recesses 19 adjacent to these supply air to the first openings 12.

Disk 18 is stationary relative to transport cylinder 3, which rotates about axis of rotation 16 during operation. Regions of suction air or blower air that are formed on the circumferential surface of transport cylinder 3, dependent upon its angle of rotation, are determined by the length of recesses 19, 56 and 57 in the circumferential direction of transport cylinder 3.

Superimposed on these effects, the regions of suction air or blower air can also be determined by the type of air supply and/or by the activation or deactivation thereof. For example, the region supplied throughout its extent by the same air supply means 12 or 13 according to recesses 19, 56 can be shortened by switching off the air supply to an appropriate angular region. Likewise, a region supplied throughout its extent by the same air supply means 12 or 13 according to recesses 19, 56 can be subdivided into at least one suction region and at least one blower region by switching the air supply between a suction air supply and a blower air supply. The suction region on the circumferential surface of transport cylinder 3 serves to secure blanks 10 or waste parts 9, and the blower region serves to repel the same. It is self-evident that the air supply to first openings 12 is preferably independent of the air supply to second openings 13.

According to a preferred embodiment, the first and/or the second air supply means 14, 15 are configured for switching off the suction air supply or for switching between suction air supply and blower air supply dependent upon the angular position of the openings 12, 13 being supplied with air. First air supply means 14 preferably switch off the supply of air to the first openings 12 or switch from suction air supply to blower air supply when the respective first openings 12 reach a first release point as a result of the rotation of transport cylinder 3 about its axis of rotation 16. Further preferably, the second air supply means 15 switch off the supply of air to the second openings 13 or switch from suction air supply to blower air supply when the respective second openings 13 reach a second release point as a result of the rotation of transport cylinder 3 about its axis of rotation 16. Disk 18 is preferably connected to a frame via a torque arm 20 and is rotatably mounted on transport cylinder 3. Transport cylinder 3 is preferably rotatably mounted in the same frame to which torque arm 20 is hinge connected.

For displacing the regions of suction air or blower air that are formed on the circumferential surface of transport cylinder 3 dependent upon the angle of rotation, adjusting elements may be provided for rotating disk 18.

To facilitate mounting, disk 18 preferably includes a recess that permits a radial displacement of disk 18 in the sense of a shifting for the purpose of replacement.

In place of one disk 18, a plurality of disks 18 may also be provided. In the case of a plurality of disks 18, recesses 57 for supplying air to suction gripper system 17 are formed in one of the disks 18, and recesses 19 and 56 for supplying air to the first and second openings 12, 13 are formed in the other disk 18.

Figure 8:
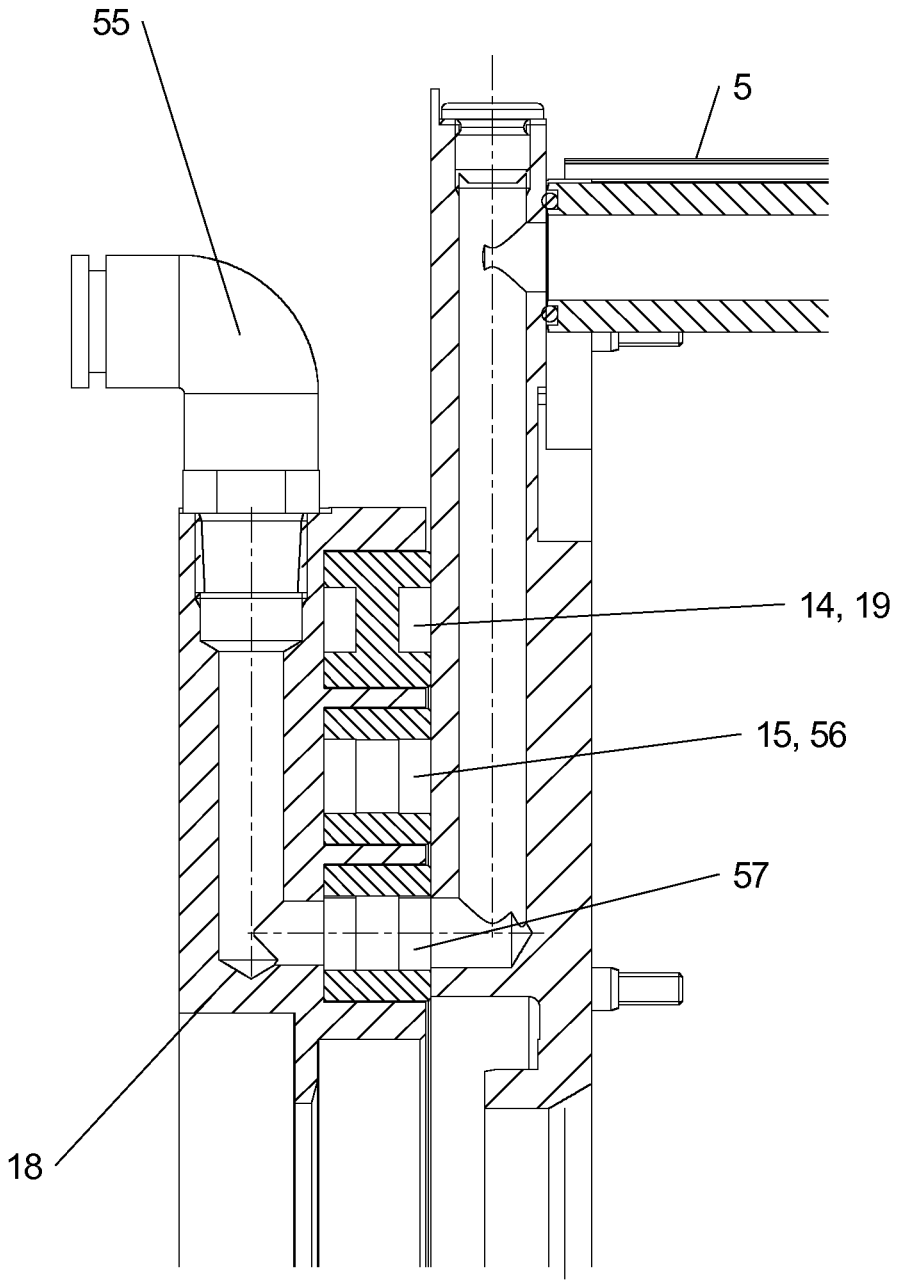
FIG. 8 shows the air supply means for the suction gripper system

The details of the supply of air to suction gripper system 17 are illustrated in FIG. 8 in a preferred variant. In the embodiment shown here, disk 18 serves to supply air to the first and second openings 12, 13 as well as supplying air to suction gripper system 17.

As an alternative, disk 18 may also have only one groove-shaped recess 57, preferably extending in the form of a circular segment, coaxially to axis of rotation 16 of transport cylinder 3. In this embodiment as well, recess 57 is supplied with air via a third supply port 55. Recess 57 is formed on the side of disk 18 that faces transport cylinder 3. Recess 57 is preferably continuous or interrupted in the circumferential direction of disk 18, so that a plurality of recesses 57 or sections of recess 57, arranged one behind the other as viewed circumferentially along the disk 18, is formed at the same radius. With respect to its distance (radius) from the axis of rotation 16 of transport cylinder 3, recess 57 corresponds to one or more openings 58 formed in the end face of transport cylinder 3. The, or each, opening 58 communicates with suction gripper system 17 via additional lines. This is of course true only as long as the opening 58 in question is opposite recess 57, dependent upon the angular position of transport cylinder 3. In other words, the length and the position of the angular range in which suction air is applied to suction gripper system 17, i.e. in which suction gripper system 17 manifests a holding effect, are determined by the extension and position of recesses 57.

It is self-evident that the supply of air to suction gripper system 17 is not limited to the embodiment with disks 18 described here. The supply of air to suction gripper system 17 may be likewise implemented using other known embodiments of an air supply that is capable of activating and deactivating the suction air applied to suction gripper system 17 in cycles with sufficient rapidity.

Suction gripper system 17 is formed in the region of the circumferential surface of transport cylinder 3. Suction gripper system 17 is preferably associated with the means for securing packing 5. In particular suction gripper system 17 may be supported on the means for securing packing 5. The means for securing packing 5, and as a result also suction gripper system 17, is preferably mounted movably, in particular pivotably. Suction gripper system 17 may, in particular, be associated with leading-edge clamping element 22. It is also advantageous for suction gripper system 17 to be arranged jointly with clamping element 22 on lever 21.

According to a preferred embodiment, a stripping cylinder 4 is disposed adjacent to transport cylinder 3. Like transport cylinder 3, stripping cylinder 4 is mounted rotatably. Stripping cylinder 4 is used for stripping out waste parts 9 or blanks 10. Stripping cylinder 4 preferably has third openings 32. Third air supply means are provided for supplying air to the third openings 32.

Like transport cylinder 3, stripping cylinder 4 may also be embodied as double-sized or single-sized. In the case of a double-sized embodiment of stripping cylinder 4, its circumference or diameter will correspond to the circumference or diameter of a transport cylinder 3 embodied as double-sized. Stripping cylinder 4 is preferably embodied as single-sized. The configuration of stripping cylinder 4 preferably resembles that of transport cylinder 3 in many features, so that in describing the properties of stripping cylinder 4, reference is made to the discussion of the properties of transport cylinder 3. This applies, in particular, to all modular groups of transport cylinder 3 or of stripping cylinder 4 with regard to which no explicit reference is made to structural differences or a lack thereof. The properties of stripping cylinder 4 are described below on the basis of a single-sized system. This description is also similarly representative of the double-sized system or multi-sized system. In contrast to transport cylinder 3, stripping cylinder 4 does not include a sheet holding system for securing the leading edges of sheet-type substrate 1.

Figure 10:
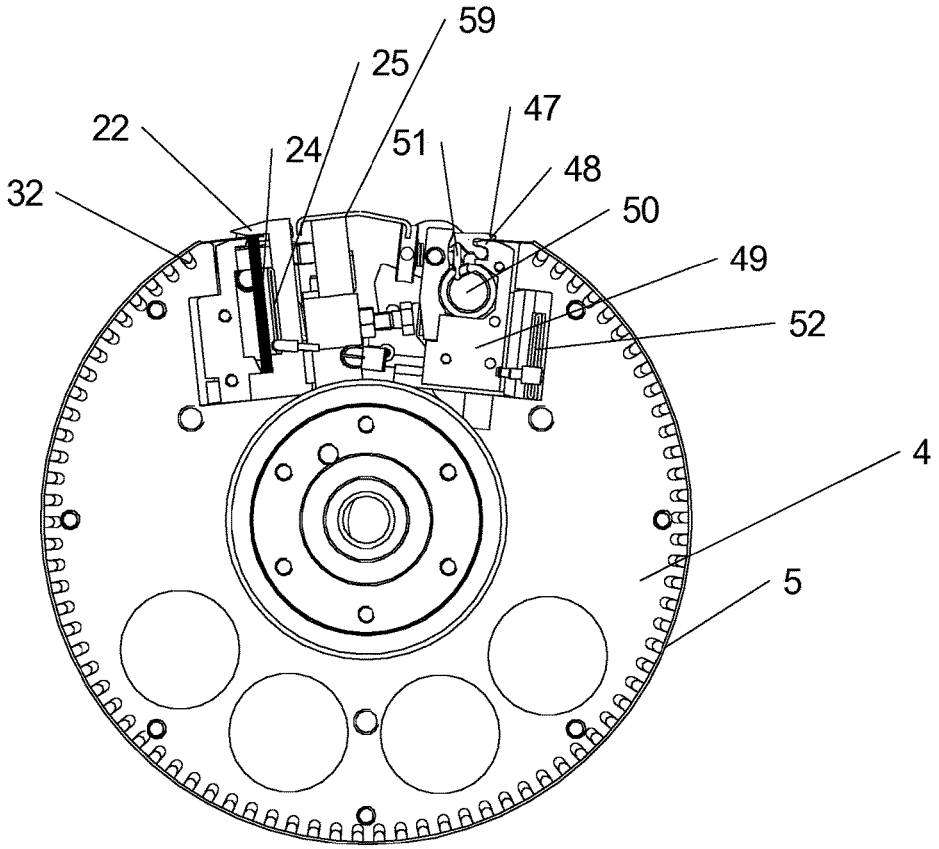
FIG. 10 shows a detail of the stripping cylinder in the region of the cylinder channel, with means for securing the packing in the closed state FIG. 11, FIG. 12 and FIG. 13 each show a transport cylinder with a revolving suction belt FIG. 14 and FIG. 15 each show a transport cylinder with a revolving suction belt

Stripping cylinder 4, like transport cylinder 3, preferably has means for securing a replaceable packing 5. The securing means are preferably embodied as clamping grippers. Using said grippers, a packing 5 can be secured at the trailing edge and at the leading edge. The means for securing the leading edge of packing 5 are preferably formed by leading-edge clamping element 22 and by the additional clamping element 24, which correlates and cooperates therewith to form a clamping gap. Leading-edge clamping element 22 is mounted on the main body of stripping cylinder 4. Additional clamping element 24 may be formed, in particular, as a leaf spring assembly. Adjacent to the additional clamping element 24 is an actuator 25, preferably embodied as a pneumatic muscle. The actuator is preferably connected to an air feed, with which an overpressure can be applied to actuator 25. When the overpressure is applied, actuator 25 expands, so that it comes into contact with and deforms additional clamping element 24. As a result of the deformation, in particular the deflection, of additional clamping element 24, its length in the direction of leading-edge clamping element 22 changes. Thus, by applying an over-pressure, e.g. in the form of compressed air, to actuator 25, the gap that is formed between leading-edge clamping element 22 and additional clamping element 24 can be enlarged, and can be reduced when the over-pressure on actuator 25 is switched off, which corresponds to clamping packing 5. FIG. 10 shows the clamping gripper of the stripping cylinder 4 leading edge with the leading edge of packing 5 secured, i.e. in the closed state.

The trailing edge of packing 5 can be secured between a trailing-edge clamping element 47 and an additional trailing-edge clamping element 48, which together form another clamping gap. The force required to close the trailing-edge clamping gripper is applied by a rotatable clamping shaft 50, which acts on trailing-edge clamping element 47 via a toggle lever 51.

To clamp packing 5, at least one of the clamping grippers, i.e., the leading-edge clamping gripper or the trailing-edge clamping gripper, can be displaced in the circumferential direction of stripping cylinder 4. In FIG. 10, the trailing-edge clamping gripper is displaceable. More particularly, the trailing-edge clamping gripper is mounted on a carriage 49 that is displaceable in the circumferential direction of stripping cylinder 4. Carriage 49 preferably also carries clamping shaft 50 and toggle lever 51, in addition to the trailing-edge clamping gripper. To clamp packing 5, the packing is first secured at both ends by the leading-edge clamping gripper and the trailing-edge clamping gripper. Carriage 49 is then shifted counterclockwise, which is effected by another actuator 52, which may likewise be embodied as a pneumatic muscle.

Regardless of the nature of the embodiment of the means for securing packing 5, said means preferably carry positioning pins, or positioning elements are preferably associated therewith. More particularly, the positioning pins or positioning elements may be assigned directly to the additional leading-edge clamping element 22.

It is self-evident that the elements described here for securing the leading edge and the elements for securing the trailing edge may also be configured differently. For instance, as an alternative to the provision of force-locking elements, it has also proven advantageous for the elements for securing the leading edge and/or the elements for securing the trailing edge to be configured for securing packings 5 in a form-locking manner. In this case, in particular, hook-shaped or claw-shaped retaining elements may be provided, corresponding to recesses formed in packing 5 or engaging in holding rails, which are fixedly connected to packing 5.

Leading-edge clamping gripper and trailing-edge clamping gripper are preferably mounted in a channel in stripping cylinder 4, which may be spanned by a channel cover.

Stripping cylinder 4 preferably has third openings 32 which, when packing 5 is secured, are covered at least partially by the perforations that may be formed in packing 5. The third openings 32 are connected to third air supply means. In the following context, air is understood to include all forms of system air, i.e. in particular blower air or suction air, which are suitable in particular for exerting a physical effect, such as a force effect, for example, and which can be characterized by at least one of the parameters: static pressure, dynamic pressure or volume flow. Such air is generated in a known manner using compressors, condensers, vacuum pumps, suction pumps or similar components.

The third openings 32 can be supplied with suction air. The air supply is preferably embodied as switchable. Switchability in this context refers in particular to switching between suction air and blower air, and it is irrelevant what type of air supply is being switched to what type. The third openings 32 are formed in the circumferential surface of stripping cylinder 4. The third openings 32 are preferably embodied as grooves or holes. The arrangement of third openings 32 in the circumferential surface of stripping cylinder 4 preferably results in a fine mesh network of elements, with which perforations that may be formed in packing 5 can be supplied with air. The perforations in packing 5 are arranged in accordance with the arrangement of waste part(s) 9, on the one hand, or blanks 10, on the other. Thus, for example, in the region of the third openings 32 that are formed in the region of blanks, perforations may be formed in packing 5. This has proven to be advantageous when stripping cylinder 4 is to be used for transporting blanks 10.

If stripping cylinder 4 is intended to be used for transporting waste parts 9, then perforations are preferably provided in packing 5 in the region of those third openings 32 that are formed in the region of waste parts 9. These measures allow blanks 10 and waste parts 9 to be treated differently or secured on the circumferential surface of transport cylinder 3 or its packing 5. The release of blanks 10 or waste parts 9 can be supported by the application of blower air to the third openings 32.

The details of the supply of air to third openings 32 will not be presented separately, and will be described below in reference to the configuration of air supply means 14, 15 on transport cylinder 3. The air supply means for supplying air to the third openings 32 preferably comprise a rotary slide valve or a rotary inlet. The rotary slide valve or rotary inlets is/are preferably provided on the end face of transport cylinder 3 or are associated therewith. The rotary slide valve or at least one rotary inlet preferably comprises a disk 18, which is associated with one of the end faces of stripping cylinder 4. A recess X, preferably extending in the form of a circular segment, coaxially to the axis of rotation of stripping cylinder 4, is formed in disk 18. Air is supplied to the recess via a fourth supply port 53. The recess is formed on the side of disk 18 that faces stripping cylinder 4. The recess is not continuous in the circumferential direction of disk 18, and can instead be interrupted, so that a plurality of recesses, one after the other as viewed in the circumferential direction of disk 18, is formed at the same radius. In terms of its distance (radius) from the axis of rotation of stripping cylinder 4, each recess corresponds to openings 58 formed in the end face of stripping cylinder 4. Each of the openings 58 in the end face of transport cylinder 3 communicates via additional lines with either a single opening or with some or all of the third openings 32 in the circumferential surface of stripping cylinder 4. This is of course true only as long as the opening 58 in question Is opposite the respective recess, dependent on the angular position of stripping cylinder 4.

Disk 18 is stationary relative to stripping cylinder 4, which rotates about its central axis in the operating state. Regions of suction air or blower air, which are formed on the circumferential surface of stripping cylinder 4, based on the angle of rotation, are determined by the length of the recesses in the circumferential direction of stripping cylinder 4.

Superimposed on these effects, the regions of suction air or blower air can also be determined by the nature of the air supply and/or by the activation or deactivation thereof. For example, the region that is supplied throughout its extent by the third air supply means in accordance with the recess can be shortened by switching off the air supply to an appropriate angular region. Likewise, a region that is supplied with air throughout its entire extent by the third air supply means in accordance with the recesses can be subdivided into at least one suction region and at least one blower region by switching the air supply between a suction air supply and a blower air supply. The suction region on the circumferential surface of stripping cylinder 4 serves to secure blanks 10 and/or waste parts 9, and the blower region serves to repel the same.

According to a preferred embodiment, the third air supply means are configured for switching off the suction air supply or for switching between suction air supply and blower air supply dependent upon the angular position of the respective third openings 32 being supplied with air. The third air supply means preferably switch off the supply of air to the third openings 32 or switch from suction air supply to blower air supply when the respective third openings 32 reach a third release point as a result of the rotation of stripping cylinder 4 about its central axis. Disk 18 is preferably connected to a frame via a torque arm 20 and is mounted rotatably on stripping cylinder 4. Stripping cylinder 4 is preferably mounted rotatably in the same frame to which torque arm 20 is hinge connected.

For displacing the regions of suction air or blower air that are formed on the circumferential surface of stripping cylinder 4 dependent upon the angle of rotation, adjusting elements may be provided for rotating disk 18.

To facilitate mounting, disk 18 preferably includes a recess that permits a radial displacement of disk 18 in the sense of a shift for the purpose of replacement. The length of the recess is greater than the diameter of a journal of stripping cylinder 4 in the region of stripping cylinder 4 where disk 18 is assigned to said cylinder.

Stripping cylinder 4 and transport cylinder 3 preferably each carry a packing 5 for treating substrates 1, in particular for separating and/or stripping processed, i.e., surface-cut or cut-through tab-attached or perforated substrate 1, into at least one waste part 9 and at least one blank 10. During separation and/or stripping, residual holding tabs or material connections, or material connections that have intentionally not been fully cut, in particular fibers or fiber bundles in the region of cutting lines between waste part 9 and at least one blank 10, are torn. For this purpose, one packing 5 may be configured as a female die and the other packing 5 may be configured as a male die. The male die has a base plane and regions that are raised relative to the base plane. The raised regions act on substrate 1, and form tools. The female die has a base plane and regions that are recessed relative to the base plane or relative to other recesses. Male and female dies are arranged on transport cylinder 3 or stripping cylinder 4 in such a way that the raised regions of the male die are opposite the recessed regions or the additional recesses in the female die. The male die thus forms a type of counterpart to the female die. The female die is arranged either on transport cylinder 3 or on stripping cylinder 4, and the male die is arranged on the respective other cylinder. The other cylinder in this context is the cylinder that cooperates with the cylinder carrying the female die (transport cylinder 3 or stripping cylinder 4). Preferably, the female die is arranged on transport cylinder 3 and the male die is arranged on the stripping cylinder. The above-described tool pair of the male and female dies preferably differs from male and female die pairs such as those used for cutting or perforating, e.g. on the processing cylinders upstream of separation system 2. The structural configuration of the male die is determined by its function of pressing the elements that are to be separated and/or stripped out only into the recessed regions or the additional recesses in the female die. Accordingly, the raised regions of the male die may also have significantly smaller extensions than the recessed regions or the additional recesses in the female die that correspond to them. A flexo printing plate, in particular, may be used as the male die.

In one alternative embodiment, the male die has no regions that are raised in relation to the base plane, and instead its entire base plane is raised. In this case, the male die is provided with an elastic coating or is made of an elastic material, at least on the side facing the female die.

During separation and/or stripping, waste parts 9 and blanks 10 are moved relative to one another, for the purpose of tearing residual tabs or individual fibers or fiber bundles in the area of cutting lines. To this end, either waste parts 9 or blanks 10 are preferably pressed by the male die into the recessed regions or the additional recesses in the female die. When a male die having an elastic surface is used, waste parts 9 are pressed into the recessed regions or the additional recesses in the female die, with the surface of the male die extending in these locations, whereas in regions of the surface outside of the depressions or additional recesses in the female die, the substrate is pressed against the surface of the female die.

According to another preferred embodiment, no stripping cylinder 4 is associated with transport cylinder 3, although waste parts 9 and blanks 10 are also moved relative to one another in this embodiment, and residual tabs or individual fibers or fiber bundles in the area of cutting lines are also torn. Separation system 2 is preferably configured such that it acts exclusively on the side of the processed substrate 1 that faces transport cylinder 3 while substrate 1 is being transported on transport cylinder 3. In a preferred embodiment, separation system 2 is composed of raised regions and regions that are depressed in relation to the raised regions on the surface of transport cylinder 3. More preferably, the first openings 12, which may be operatively connected to the first air supply means 14, are associated with the depressed regions. First air supply means 14 are preferably configured for supplying suction air. More preferably, a packing 5 is replaceably assigned to the circumferential surface of transport cylinder 3, in which case the raised regions on the surface of transport cylinder 3 are formed by packing 5, and the depressed regions on the surface of transport cylinder 3 are formed by the circumferential surface of transport cylinder 3 in the region of perforations formed in packing 5. The second openings 13, which are operatively connected to second air supply means 15, may be formed in the raised regions and/or the depressed regions of the surface of transport cylinder 3. In addition, the first and/or second air supply means 14, 15 may be switchable between a suction air supply and a blower air supply.

To accomplish the relative movement between waste parts 9 and blanks 10, a packing 5, configured, in particular, in the manner of a female die and having depressed regions or additional perforations, may be assigned to transport cylinder 3. In the area of the depressed regions or additional perforations, a negative pressure is applied via the first and/or second openings 12, 13, moving waste parts 9 and blanks 10 relative to one another, i.e., in particular, drawing waste parts 9 into the depressed regions or the additional perforations, while blanks 10 are supported on the base plane of the female die. As an alternative, it is also possible for the blanks 10 to be drawn into the depressed regions or the additional perforations, while waste parts 9 are supported on the base plane of the female die. In other words, the separation process is preferably induced solely by the force of the negative pressure applied in the depressed regions or additional perforations, or the suction air on the sides of blanks 10 or waste parts 9 that face transport cylinder 3.

In that case, perforations are preferably arranged in the area of the depressed regions. These perforations ensure that the negative pressure applied to the first and/or second openings 12, 13 can spread to the side of the blanks 10 or waste parts 9 that faces transport cylinder 3.

In separating substrate sheets 1 into waste parts 9 and blanks 10, particularly in environments of low atmospheric humidity, problems that may be caused by undesirable electrostatic charges on waste parts 9 and/or blanks 10 and/or on the surfaces of transport cylinder 3 and/or stripping cylinder 4 may occur. The electrostatic charge buildup causes waste parts 9 and/or blanks 10 to adhere to the surfaces of transport cylinder 3 and/or stripping cylinder 4. In these cases, the force of gravity usually is not sufficient to remove the waste parts 9 and blanks 10 from the cylinder surface and/or from the tools or tool parts, in particular male and female dies, secured on the cylinder surfaces.

Figure 9:
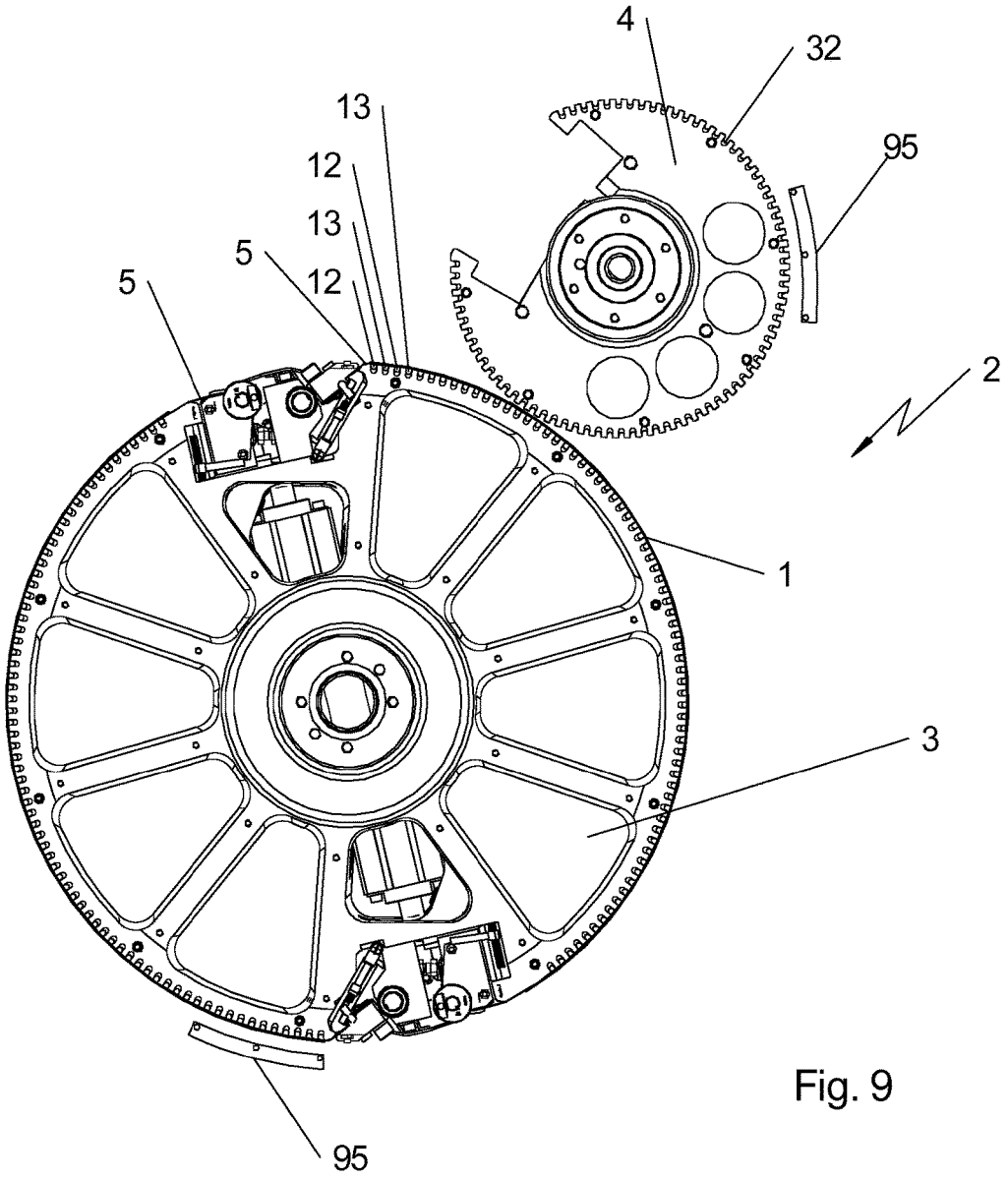
FIG. 9 shows the transport cylinder with the stripping cylinder
Figure 49:
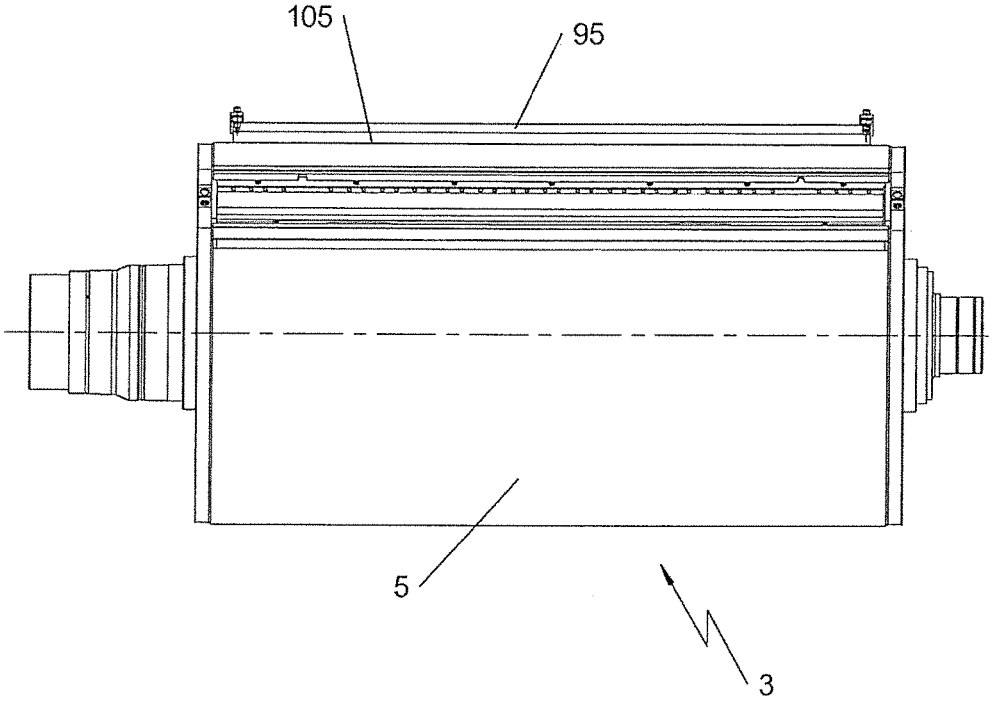
FIG. 49 shows an antistatic device on the transport cylinder

According to a further embodiment, which serves in particular to prevent problems caused by electrostatic charge buildup, it is provided that a separation system 2 is formed, comprising a transport cylinder 3 and a stripping cylinder 4 assigned thereto, wherein an antistatic device 95 is associated with transport cylinder 3 and/or stripping cylinder 4 (FIG. 9 and FIG. 49, with transport cylinder 3 being depicted by way of example in FIG. 49). Transport cylinder 3 preferably has means for securing a replaceable packing 5, along with openings 12, 13 which, when packing 5 is secured, are at least partially covered by perforations that may be formed in packing 5, wherein air supply means 14, 15 are provided for supplying air to openings 12, 13. Antistatic device 95 preferably comprises at least one electrode, connected to at least one high-voltage source. The high-voltage source may be a positive or a negative high-voltage source. Alternatively, the high-voltage source may be switched between an operating mode as a positive high-voltage source and an operating mode as a negative high-voltage source. The high-voltage sources may be connected via a controller to a sensor that detects the voltage applied to the surfaces of transport cylinder 3 and/or stripping cylinder 4 or to the tools or tool parts attached thereto. The controller is preferably configured for the case-by-case activation of the positive or negative high-voltage source or for switching the switchable high-voltage source based upon the plus or minus sign of the applied voltage. The controller can likewise process the value of the applied voltage (FIG. 12) as a system parameter and can actuate at least one high-voltage source dependent upon this system parameter. The high-voltage sources described preferably supply a pulsed or an unpulsed DC voltage.

The electrode of antistatic device 95 preferably extends in the axial direction of stripping cylinder 4 over its length and/or in the axial direction of transport cylinder 3 over its length.

According to one refinement, antistatic device 95 comprises a brush, with the brush comprising a roller-shaped or strip-shaped main body, in particular electrically conductive. Bristles 105 are associated with the main body. In the case of a roller-type embodiment, the main body may be mounted rotatably.

In this case, bristles 105 are preferably arranged uniformly distributed on the circumferential surface of the main body. In the case of a strip-type embodiment of the main body, the main body is preferably arranged fixedly in relation to the surface of the cylinder to which it is assigned (transport cylinder 3 or stripping cylinder 4), at least in the operating position.

Bristles 105 are preferably made of an electrically conductive material, such as a metal, for example. A carbon compound may also be used as the material for bristles 105. Bristles 105 are further preferably made of braided fibers or fiber bundles. These may be arranged side by side in a row. Several of the described rows of braided fibers or fiber bundles are preferably arranged one behind the other as viewed in the direction of rotation of transport cylinder 3 or stripping cylinder 4. As an alternative to the attachment of bristles 105, a blanket 105 having electrically conductive fibers may also be assigned to the main body. These fibers may be woven into the blanket 105 or attached to the blanket 105 by means of an adhesion promoter, for example. In the refinements in which bristles 105 or a blanket 105 are assigned to the main body, the bristles 105 or blanket 105 form(s) the electrode or is/are connected to the electrode.

The embodiments of antistatic devices 95 that are equipped with bristles 105 or a blanket 105 are arranged with respect to transport cylinder 3 or stripping cylinder 4 in such a way that they touch the circumferential surface of the respective cylinder. Preferably, a device is provided with which the antistatic device 95 can be displaced between an operating position, in which bristles 105 or blanket 105 touch(es) the circumferential surface of the respective cylinder, and a parked position, in which bristles 105 or blanket 105 do/does not touch the circumferential surface of the respective cylinder.

Alternatively or additionally, it is preferable in such refinements for antistatic device 95 to comprise a blower device, which generates a volume flow of a gaseous medium ionized by at least one electrode in the direction of the circumferential surface of transport cylinder 3 and/or the circumferential surface of stripping cylinder 4.

Alternatively or in addition to the configuration of separation system 2 with an antistatic device 95, the tools or tool parts that are used, such as male and female dies, for example, and/or the cylinder surfaces of transport cylinder 3 and/or a stripping cylinder 4 associated therewith, may also be configured as antistatic, in particular using electrically conductive materials.

Figure 11:
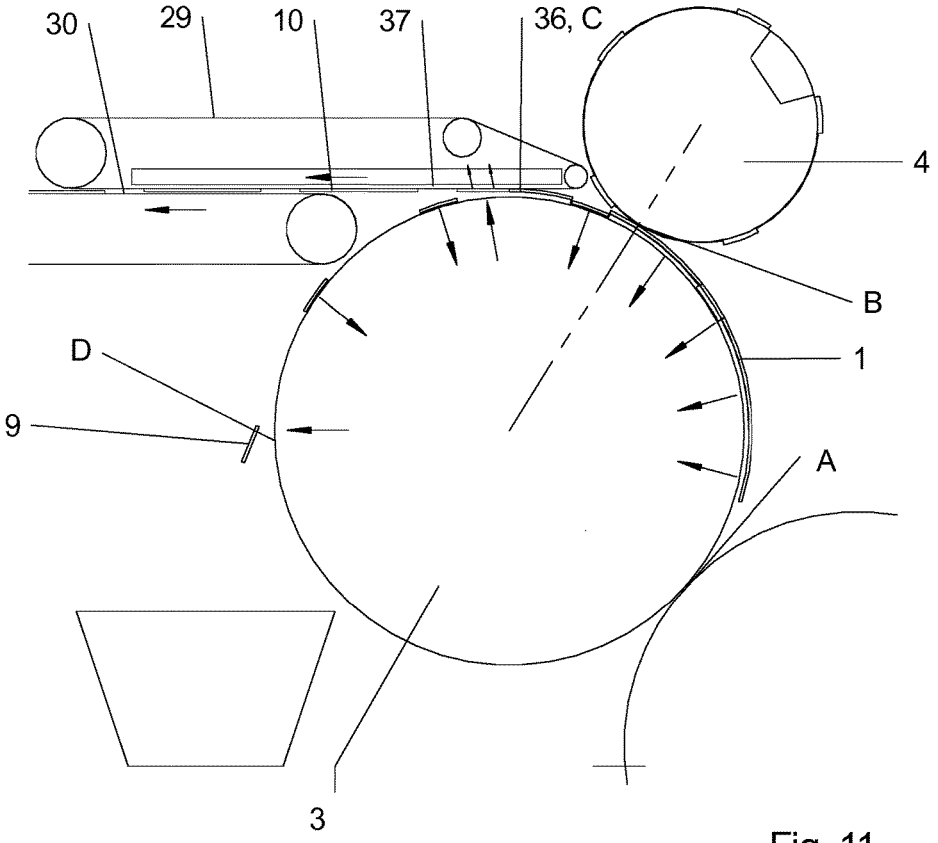
Figure 12:
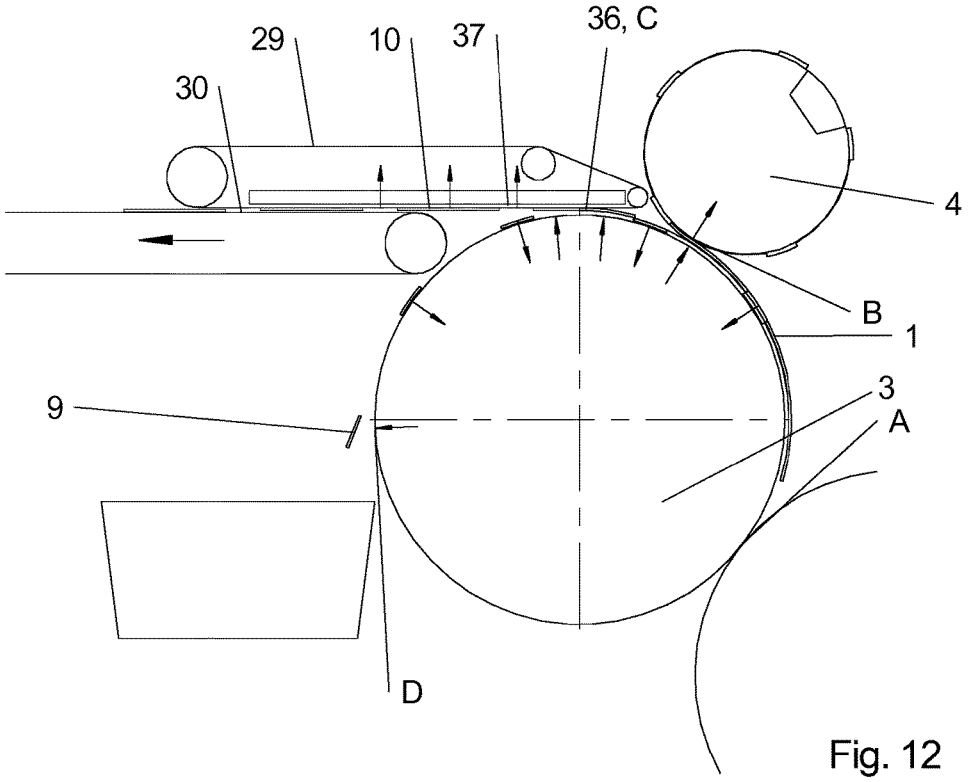

According to another preferred embodiment, with or without stripping cylinder 4, a revolving conveyor belt 29 is assigned to transport cylinder 3, as is clear from FIG. 11 or FIG. 12 in particular. Conveyor belt 29 is preferably disposed above transport cylinder 3. Conveyor belt 29 is assigned to transport cylinder 3, preferably wrapping partially around the surface thereof and forming a wrap angle therewith. Alternatively, conveyor belt 29 may be assigned to transport cylinder 3 so as to form a tangency point 36. More preferably, tangency point 36 is formed at the 12 o'clock position on transport cylinder 3. The length of conveyor belt 29 is determined by the arrangement of deflecting rollers. Conveyor belt 29 preferably includes a horizontally extending transport region 37. Conveyor belt 29 may be embodied in particular as a suction belt. Further preferably, suction air is applied to conveyor belt 29 at least in transport region 37. As a result, conveyor belt 29 may be configured for the suspended transport of blanks and/or waste parts 10, 9.

The function of conveyor belt 29 is, in particular, to receive processed substrate sheets 1, waste parts 9 or blanks 10 at tangency point 36 or in the region of the wrap of conveyor belt 29 around transport cylinder 3, and to transport these further.

An additional transport system, for example in the form of an additional conveyor belt 30, may follow conveyor belt 29. An overlap region is preferably formed between conveyor belt 29 and the additional conveyor belt 30, with said region serving to transfer processed substrate sheets 1 or blanks 10 and/or waste parts 9 from conveyor belt 29 to the additional conveyor belt 30. More preferably, the additional conveyor belt 30 is configured for the horizontal transport of blanks and/or waste parts 10, 9.

It is self-evident that, in place of the additional conveyor belt 30, another suitable transport system may also be provided, which receives processed substrate sheets 1 or blanks 10 and/or waste parts 9 from conveyor belt 29.

In place of the additional conveyor belt 30, a container for receiving waste parts may also be arranged beneath conveyor belt 30.

In addition to conveyor belt 29, an additional transport system 76 may also be assigned directly to transport cylinder 3, i.e. forming a transfer region or transfer point between transport cylinder 3 and the additional transport system for processed substrate sheets 1 or blanks 10 and/or waste parts 9. This additional transport system 76 is preferably embodied as a sheet guiding cylinder or a sheet guiding drum or as a chain conveyor system with gripper bars or as a conveyor belt.

The operating method of one embodiment, as illustrated preferably by FIG. 11 or FIG. 12, may be described as follows. The embodiment of the device illustrated here for treating substrates is preferably a component of a sheet-fed printing machine. The sheet-fed printing machine may comprise one or more printing units. More preferably, two processing cylinders, between which substrate 1 can be inserted, are arranged upstream of the embodiment illustrated in FIG. 11 or FIG. 12, with substrate 1 undergoing processing in its passage therebetween by means of tool parts that are active in the cylinder nip, said tool parts being selected from the group composed of cutting tools, punching tools, creasing tools, and perforating tools. One of these processing cylinders is illustrated as a semicircle in FIG. 11 and FIG. 12. The processing cylinder is preferably embodied as a sheet transport cylinder and includes a sheet holding system. The sheet transport cylinder transfers a processed substrate sheet 1 to transport cylinder 3 at the tangency point A between transport cylinder 3 and the upstream sheet transport cylinder. The sheet holding system of the sheet transport cylinder releases the treated substrate sheet 1, while the gripper system, in particular suction gripper system 17 of transport cylinder 3, receives the processed, in particular surface-cut, substrate sheet 1. Substrate sheet 1 preferably comprises an outer margin, to which waste parts 9 and blanks 10 are attached via what are known as residual tabs. Transport cylinder 3 carries a packing 5. Packing 5 has perforations and is provided with depressions at the locations where it acts on blanks 10. Perforations are introduced in packing 5 in the region of blanks 10, at the locations where the first openings 12 are formed, while the second openings 13 are covered by packing 5, i.e. are sealed, in the region of blanks 10. Perforations are also introduced in packing 5 in the region of waste parts 9, at the locations where the second openings 13 are formed, while the first openings 12 are covered by packing 5, i.e. are sealed, in the region of waste parts 9. When, as a result of the rotation of transport cylinder 3, the first openings 12 have passed through tangency point A or are precisely at tangency point A, a negative pressure is applied to the first openings 12 by first air supply means 14, thereby securing blanks 10 on the circumferential surface of transport cylinder 3 or on packing 5. The further rotation of transport cylinder 3 causes the blanks 10 and waste parts 9 secured by the negative pressure to reach tangency point B, which is formed between transport cylinder 3 and stripping cylinder 4. At tangency point B, the raised regions of the packing 5 disposed on stripping cylinder 4 contact the surfaces of waste parts 9, and press waste parts 9 into the depressions in the packing 5 secured on transport cylinder 3. This causes the residual tabs that connect waste parts 9 to the frame or to useful parts 10 to tear. At tangency point B, a negative pressure is preferably applied via the second air supply means 15 to the second openings 13 in the region of waste parts 9, securing waste parts 9 on the circumferential surface of transport cylinder 3 or on packing 5. Alternatively, the negative pressure may be applied to the second openings 13 in the region of waste parts 9 via second air supply means 15 as early as tangency point A or immediately thereafter. When the blanks 10 reach the transfer point or transfer region C between transport cylinder 3 and conveyor belt 29, the first air supply means 14 are preferably deactivated. The negative pressure in the region of the first openings 12 is no longer applied, and blanks 10 are no longer secured, and thus are released. As a result of the negative pressure preferably applied to conveyor belt 29, blanks 10 are raised off of transport cylinder 3 at the transfer point or in transfer region C, secured on the bottom side of conveyor belt 29 and transported away while suspended thereon. The transfer of blanks 10 from transport cylinder 3 to conveyor belt 29 can be supported by the application of an overpressure to first openings 12. The supply of air to the first openings 12 is preferably switched from negative pressure to an overpressure when the first openings in the region of the blanks 10 reach the transfer point or transfer region C. Blanks 10 can preferably be transported away by means of the additional conveyor belt 30. To do this, conveyor belt 29 conveys blanks 10 up to the additional conveyor belt 30, where it transfers blanks 10 to the additional conveyor belt 30. For the transfer, the negative pressure being applied to conveyor belt 29 is preferably deactivated, so that the blanks are secured on the additional conveyor belt 30 by the force of gravity or by the additional suction effect on the additional conveyor belt, and are transported away by same. When the waste parts 9 reach release point D, the negative pressure being applied to the second openings 13 in the region of waste parts 9 is deactivated, or preferably, an overpressure is applied instead of the negative pressure. As a result, waste parts 9 are released, or waste parts 9 are actively repelled, and can be received by a waste container. In the region of release point D, in addition to the release of waste parts 9, the leading edge of substrate sheet 1 is preferably also released from gripper system 17.

The further operation of one embodiment, as illustrated preferably by FIG. 11 or FIG. 12, can be described as follows. The sheet transport cylinder transfers a processed substrate sheet 1 to transport cylinder 3 at tangency point A between transport cylinder 3 and the upstream sheet transport cylinder. In said transfer, the sheet holding system of the sheet transport cylinder releases the processed substrate sheet 1, while the gripper system, in particular suction gripper system 17, of transport cylinder 3, receives the processed, in particular surface-cut, substrate sheet 1. Substrate sheet 1 preferably comprises an outer margin, to which waste parts 9 and blanks 10 are attached via what are known as residual tabs. Transport cylinder 3 carries a packing 5. Packing 5 has perforations and is provided with depressions at the locations where it acts on blanks 10. Perforations are introduced in packing 5 in the region of blanks 10, at the locations where the first openings 12 are formed, while the second openings 13 are covered by packing 5, i.e. are sealed, in the region of blanks 10. Perforations are also introduced in packing 5 in the region of waste parts 9, at the locations where the second openings 13 are formed, while the first openings 12 are covered by packing 5, i.e. are sealed, in the region of waste parts 9. When, as a result of the rotation of transport cylinder 3, the first openings 12 have passed through tangency point A or are precisely at tangency point A, a negative pressure is applied to the first openings 12 by the first air supply means 14, securing blanks 10 on the circumferential surface of transport cylinder 3 or on packing 5. The further rotation of transport cylinder 3 causes the blanks 10 and waste parts 9 secured by the negative pressure to reach tangency point B, which is formed between transport cylinder 3 and stripping cylinder 4. At tangency point B, the raised regions of the packing 5 disposed on stripping cylinder 4 contact the surfaces of waste parts 9, and press waste parts 9 into the depressions in the packing 5 secured on transport cylinder 3. This causes the residual tabs that connect waste parts 9 to the frame or to blanks 10 to tear. The packing 5 secured on stripping cylinder 4 has perforations that correspond to the third openings 32 in stripping cylinder 4. The perforations are formed in the region of packing 5 where it is not raised or interacts in rolling contact with blanks 10. When the third openings 32 of stripping cylinder 4 reach tangency point B and are opposite a respective blank 10 at tangency point B, a negative pressure is applied to said openings. This negative pressure manifests a force that acts to lift the blanks 10 off of the surface of transport cylinder 3. The negative pressure at the third openings 32 of stripping cylinder 4 is deactivated as soon as said openings have again left the region of tangency point B, or a few angular degrees thereafter, in particular 10 degrees. The negative pressure applied to the first openings 12 is preferably deactivated when the first openings 12 in question are in the region of tangency point B. This ensures that the blank 10 in question will be lifted off of the surface of transport cylinder 3, under the influence of the negative pressure at the third openings 32 of stripping cylinder 4, briefly, i.e., for a few angular degrees, in particular 10 degrees of the rotational movement of transport cylinder 3. This measure additionally supports the separation of blanks 10 from waste parts 9, because these are moved actively in different directions for at least a short period of time. At tangency point B, a negative pressure is preferably applied via the second air supply means 15 to the second openings 13, in the region of waste parts 9, securing the waste parts 9 on the circumferential surface of transport cylinder 3 or on packing 5. Alternatively, the negative pressure may be applied via the second air supply means 15 to the second openings 13, in the region of waste parts 9, as early as tangency point A or immediately thereafter. When the blanks 10 in question reach the transfer point or transfer region C between transport cylinder 3 and conveyor belt 29, the first air supply means 14 are preferably deactivated. The negative pressure in the region of the first openings 12 is no longer applied, and blanks 10 are no longer secured, and are thus released. As a result of the negative pressure preferably being applied to conveyor belt 29, blanks 10 are lifted off of transport cylinder 3 at the transfer point or in transfer region C, are secured on the bottom side of conveyor belt 29 and are transported away suspended thereon. The transfer of blanks 10 from transport cylinder 3 to conveyor belt 29 can be supported by the application of an overpressure to first openings 12. The supply of air to first openings 12 is preferably switched from negative pressure to overpressure when the first openings in the region of the blanks 10 in question reach the transfer point or transfer region C. Blanks 10 can preferably be transported away by the additional conveyor belt 30. To do this, conveyor belt 29 conveys blanks 10 up to additional conveyor belt 30, where it transfers blanks 10 to the additional conveyor belt 30. For the transfer, the negative pressure being applied to conveyor belt 29 is preferably deactivated, so that the blanks are secured on the additional conveyor belt 30 by the force of gravity or by the additional suction effect on the additional conveyor belt and are transported away by same. When the waste parts 9 reach release point D, the negative pressure being applied to the second openings 13 in the region of waste parts 9 is deactivated, or preferably, an overpressure is applied instead of the negative pressure. As a result, waste parts 9 are released, or waste parts 9 are actively repelled, and can be received by a waste container. In the region of release point D, in addition to the release of waste parts 9, the leading edge of substrate sheet 1 is preferably also released by gripper system 17.

A further operating method of an embodiment, as illustrated preferably by FIG. 11 or FIG. 12, relates to whole-sheet processing or whole-sheet inspection and will be described below. The sheet transport cylinder transfers a processed substrate sheet 1 to transport cylinder 3 at tangency point A between transport cylinder 3 and the upstream sheet transport cylinder. In said transfer, the sheet holding system of the sheet transport cylinder releases the processed substrate sheet 1, while the gripper system, in particular suction gripper system 17, of transport cylinder 3, receives the processed, in particular surface-cut, substrate sheet 1. Substrate sheet 1 preferably comprises an outer margin, to which waste parts 9 and blanks 10 are attached via what are known as residual tabs. Transport cylinder 3 carries a packing 5. Packing 5 has perforations. The perforations are introduced in packing 5 at the locations where the first and/or second openings 12, 13 are formed. When, as a result of the rotation of transport cylinder 3, the first and/or second openings 12, 13 have passed through tangency point A or are precisely at tangency point A, a negative pressure is applied to the first and/or second openings 12, 13 by the first and/or second air supply means 14, 15, securing only blanks 10, or only waste parts 9, or blanks 10 and waste parts 9 on the circumferential surface of transport cylinder 3 or on packing 5. The further rotation of transport cylinder 3 causes the blanks 10 and waste parts 9 to pass through tangency point B. At tangency point B, there is no contact between the waste parts 9 or the blanks and other elements. When the blanks 10 in question and the waste parts 9 in question reach the transfer point or transfer region C between transport cylinder 3 and conveyor belt 29, the first and/or second air supply means 14, 15 are preferably deactivated. The negative pressure is no longer applied to the region of the first and/or second openings 12, 13, and blanks 10 and waste parts 9 are no longer secured and are thus released. The securing of the leading edges of substrate sheets 1 by gripper system 17 is also released at the transfer point or in transfer region C. Due to the negative pressure preferably being applied to conveyor belt 29, blanks 10 and waste parts 9 and the frames of substrate sheets 1, including the leading edges of substrate sheets 1, which are still connected to one another by the residual tabs (whole sheets), are lifted off of transport cylinder 3 at the transfer point or in transfer region C, are secured to the bottom side of conveyor belt 29, and are transported away by the same while suspended thereon. The transfer of blanks 10 and waste parts 9 and the frames of substrate sheets 1, including the leading edges of substrate sheets 1, as whole sheets from transport cylinder 3 to conveyor belt 29 can be supported by the application of an overpressure to the first and/or second openings 12, 13. The supply of air to the first and/or second openings 12, 13 is preferably switched from negative pressure to overpressure when the first and/or second openings 12, 13 reach the transfer point or transfer region C.

The whole sheets can preferably be transported away by the additional conveyor belt 30. To do this, conveyor belt 29 conveys the whole sheets up to the additional conveyor belt 30 and transfers the whole sheets to the additional conveyor belt 30. For the transfer, the negative pressure being applied to conveyor belt 29 is preferably deactivated, so that the whole sheets are secured on the additional conveyor belt 30 by the force of gravity or by the additional suction effect and are transported away by the same.

Figure 13:
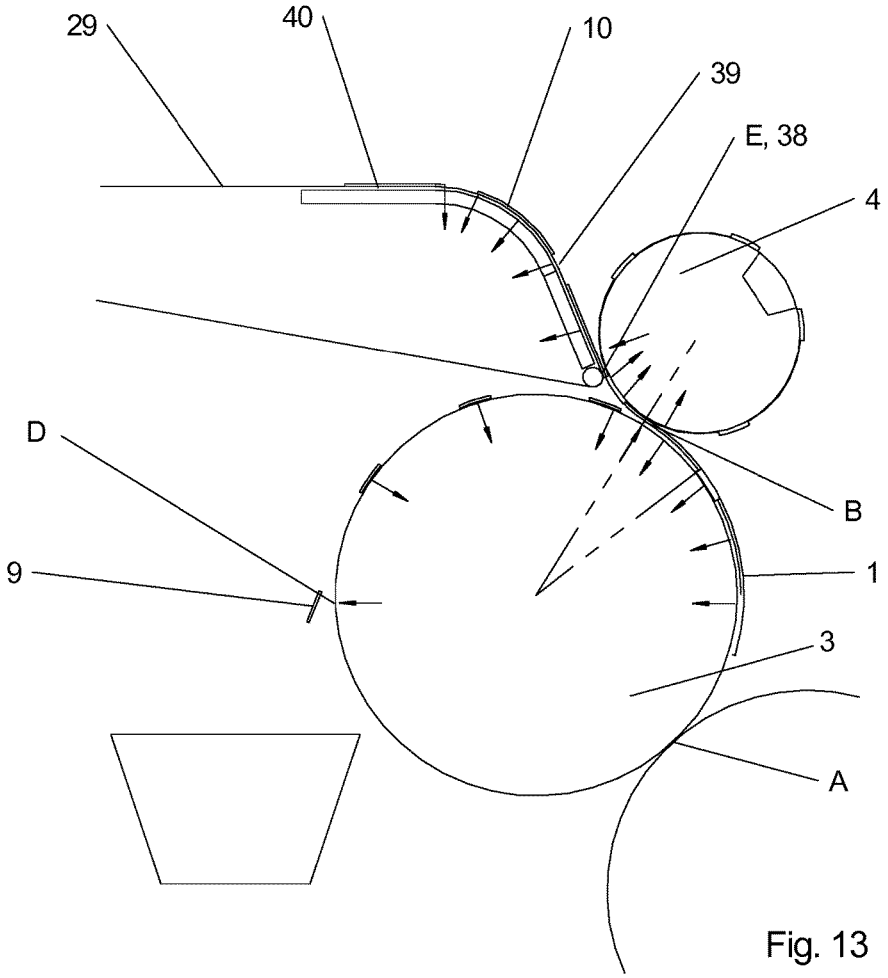

According to another preferred embodiment including a stripping cylinder 4, a revolving conveyor belt 29 is assigned to the stripping cylinder, as can be seen in FIG. 13, in particular. Conveyor belt 29 is preferably disposed above transport cylinder 3. Conveyor belt 29 is preferably assigned to stripping cylinder 4, forming a transfer point 38 or transfer region. More preferably, conveyor belt 29 is arranged wrapping around part of the circumference of stripping cylinder 4, forming a wrap angle. Especially preferably, transfer point 38 or the transfer region is formed at the 8 o'clock position on stripping cylinder 4, and stripping cylinder 4 is assigned to transport cylinder 3 at the 12 o'clock position on transport cylinder 3. The length of conveyor belt 29 is determined by the arrangement of deflecting rollers. Conveyor belt 29 preferably has a first transport region 39, extending at least approximately tangentially to stripping cylinder 4. More preferably, the first transport region 39 is inclined at an angle of between 30 and 60 degrees from horizontal. Conveyor belt 29 preferably has second transport region 40, extending approximately horizontally, in particular precisely horizontally. Conveyor belt 29 is a suction belt, in particular, and the first transport region 39 is a region in which suction air is applied to conveyor belt 29. The function of conveyor belt 29 is, in particular, to receive processed substrate sheets 1, waste parts 9 or blanks 10 from stripping cylinder 4 at transfer point 38 or in the transfer region between conveyor belt 29 and stripping cylinder 4, and to transport them further. Another transport system, for example, in the form of an additional conveyor belt 30, may follow conveyor belt 29. An overlap region, the function of which is to allow processed substrate sheets 1 or blanks 10 and/or waste parts 9 to be transferred from conveyor belt 29 to the additional conveyor belt 30, is preferably formed between conveyor belt 29 and the additional conveyor belt 30. It is self-evident that, instead of the additional conveyor belt 30, another suitable transport system may also be provided, which receives processed substrate sheets 1 or blanks 10 and/or waste parts 9 from conveyor belt 29. In addition to conveyor belt 29, an additional transport system 76 may also be assigned directly to transport cylinder 3, i.e. forming a transfer region or transfer point between transport cylinder 3 and the additional transport system 76 for processed substrate sheets 1 or blanks 10 and/or waste parts 9. This additional transport system 76 is preferably embodied as a sheet guiding cylinder or sheet guiding drum, or as a chain conveyor system with gripper bars or as a conveyor belt. Stripping cylinder 4 preferably has third openings 32 and third air supply means for supplying air to the third openings 32. The third air supply means can preferably be switched between a suction air supply and a blower air supply. More particularly, the third air supply means is configured to be switched between suction air supply and blower air supply dependent upon the angular position of the respective third openings 32 being supplied with air. More preferably, the third air supply means are configured for switching the supply of air to the third openings 32 from suction air supply to blower air supply when the third openings 32 in question reach a third release point, in particular the transfer point or transfer region between stripping cylinder 4 and conveyor belt 29, by virtue of the rotation of stripping cylinder 4 about its axis of rotation. The third openings 32 may be configured as grooves or holes. The third air supply means preferably comprise a rotary slide valve or a rotary inlet, and the at least one rotary slide valve or the at least one rotary inlet may be provided on the front side of stripping cylinder 4. Stripping cylinder 4, like transport cylinder 3, preferably has means for securing a replaceable packing 5. The securing means are preferably embodied as clamping grippers. Using said grippers, a packing 5 can be secured at its trailing edge and at its leading edge. The means for securing the leading edge of packing 5 are preferably formed by leading-edge clamping element 22 and the additional clamping element 24, which cooperates in correlation with the leading-edge element to form a clamping gap. Leading-edge clamping element 22 is mounted on the main body of stripping cylinder 4. Additional clamping element 24 may be formed, in particular, as a leaf spring assembly. Adjacent to the additional clamping element 24 is an actuator 25, preferably embodied as a pneumatic muscle. The actuator is preferably connected to an air feed, with which an overpressure can be applied to actuator 25. The trailing edge of packing 5 can be secured between a trailing-edge clamping element 47 and an additional trailing-edge clamping element 48, which together form another clamping gap. The force required to close the trailing-edge clamping gripper is applied by a rotatable clamping shaft 50, which acts on trailing-edge clamping element 47 via a toggle lever 51.

Additional preferred details of stripping cylinder 4 are presented in FIG. 10 and in the associated description, to which reference is made in connection with the exemplary embodiment described. A packing 5 having perforations is preferably secured on stripping cylinder 4. The perforations in packing 5 of stripping cylinder 4 correspond to the third openings 32 in stripping cylinder 4. The perforations are preferably formed in the region of packing 5 in which said packing is not raised and interacts in rolling contact with blanks 10. When the third openings 32 in stripping cylinder 4 reach tangency point B and are opposite a respective blank 10 at tangency point B, a negative pressure is applied to them. As a result of this negative pressure, a force that acts to lift blanks 10 off of the surface of transport cylinder 3 is manifested.

A preferred operating method of an embodiment as preferably illustrated by FIG. 13 can be described as follows. The sheet transport cylinder transfers a processed substrate sheet 1 to transport cylinder 3 at tangency point A between transport cylinder 3 and the upstream sheet transport cylinder. In said transfer, the sheet holding system of the sheet transport cylinder releases the processed substrate sheet 1, while the gripper system, in particular suction gripper system 17, of transport cylinder 3, receives the processed, in particular surface-cut, substrate sheet 1. Substrate sheet 1 preferably comprises an outer margin, to which waste parts 9 and blanks 10 are attached via what are known as residual tabs. Transport cylinder 3 carries a packing 5. Packing 5 has perforations and is provided with depressions in the locations where it acts on blanks 10. Perforations are preferably introduced in packing 5 in the region of blanks 10, at the locations where the first openings 12 are formed, while the second openings 13 are covered by packing 5, i.e. are sealed, in the region of blanks 10. Perforations are preferably also introduced in packing 5 in the region of waste parts 9, at the locations where the second openings 13 are formed, while the first openings 12 are covered by packing 5, i.e. are sealed, in the region of waste parts 9. When, as a result of the rotation of transport cylinder 3, the first openings 12 have passed through tangency point A or are precisely at tangency point A, a negative pressure is applied to the first openings 12 by first air supply means 14, securing blanks 10 on the circumferential surface of transport cylinder 3 or on packing 5. The further rotation of transport cylinder 3 causes the blanks 10 and waste parts 9 secured by the negative pressure to reach tangency point B, which is formed between transport cylinder 3 and stripping cylinder 4. At tangency point B, the raised regions of the packing 5 disposed on stripping cylinder 4 contact the surfaces of waste parts 9, and press waste parts 9 into the depressions in the packing 5 secured on transport cylinder 3. This causes the residual tabs that connect waste parts 9 to the frame or to blanks 10 to tear. The packing 5 secured on stripping cylinder 4 has perforations that correspond to the third openings 32 in stripping cylinder 4. The holes are preferably formed in the region of packing 5 where the packing is not raised or interacts in rolling contact with blanks 10. When the third openings 32 in stripping cylinder 4 reach tangency point B, and at tangency point B are opposite or immediately upstream of a blank 10 in question, a negative pressure is applied to said openings. As a result of this negative pressure, a force that acts to lift blanks 10 off of the surface of transport cylinder 3 is manifested. The negative pressure applied to the first openings 12 in transport cylinder 3 is preferably deactivated when the first openings 12 in question are in the region of tangency point B. This ensures that the blank 10 in question will be lifted off of the surface of transport cylinder 3, under the influence of the negative pressure at the third openings 32 of the stripping cylinder. The negative pressure applied to the second openings 13 is preferably maintained when the second openings 13 in question pass through tangency point B. Waste parts 9 are thereby held on the surface of transport cylinder 4 and are transported past tangency point B, while blanks 10 are transferred from transport cylinder 3 to stripping cylinder 4 at tangency point B. The rotation of stripping cylinder 4 transports the blanks 10 secured by negative pressure further in the direction of conveyor belt 29 until the blanks reach the transfer point or transfer region E of stripping cylinder 4 and conveyor belt 29. At the transfer point or transfer region E of stripping cylinder 4 and conveyor belt 29, a suction effect is exerted via the conveyor belt 29, preferably configured as a suction belt, on the side of blanks 10 that faces away from stripping cylinder 4. When the third openings 32 in question reach the transfer point or transfer region E, the negative pressure applied to said openings is deactivated. Following the deactivation of the negative pressure at the third openings 32, an overpressure can preferably be built up. As a result of the forces described here, the blanks 10 in question are transferred from stripping cylinder 4 to conveyor belt 29 at the transfer point or transfer region E. Conveyor belt 29 runs on deflecting rollers, at least one of which is driven, and preferably transports blanks 10 to a pile device or delivery device (not shown). After the transfer point or transfer region E passes through the third openings 32, the negative pressure applied to said openings can be deactivated. The deactivation ends no later than when the third openings 32 arrive at tangency point B again. At tangency point B, a negative pressure is preferably applied by the second air supply means 15 to the second openings 13 in the region of waste parts 9, securing waste parts 9 on the circumferential surface of transport cylinder 3 or on packing 5. Alternatively, the negative pressure may be applied by the second air supply means 15 to the second openings 13 in the region of waste parts 9 as early as tangency point A or immediately thereafter. When waste parts 9 reach release point D, the negative pressure applied to second openings 13 in the region of waste parts 9 is deactivated, or more preferably, an overpressure is applied in place of the negative pressure. This results in a release of waste parts 9 or an active repulsion of waste parts 9, which can be received by a waste container. In the region of release point D, in addition to waste parts 9, the leading edge of substrate sheet 1 is preferably released by gripper system 17.

A further operating method of an embodiment as is preferably illustrated by FIG. 13, relates to whole-sheet processing or whole-sheet inspection and will be described below. The sheet transport cylinder transfers a processed substrate sheet 1 to transport cylinder 3 at tangency point A between transport cylinder 3 and the upstream sheet transport cylinder. In said transfer, the sheet holding system of the sheet transport cylinder releases the processed substrate sheet 1, while the gripper system, in particular suction gripper system 17, of transport cylinder 3, receives the processed, in particular surface-cut, substrate sheet 1. Substrate sheet 1 preferably comprises an outer margin, to which waste parts 9 and blanks 10 are attached via what are known as residual tabs. Transport cylinder 3 carries a packing 5. Packing 5 has perforations. The perforations are introduced in packing 5 at the locations where the first and/or second openings 12, 13 are formed. When, as a result of the rotation of transport cylinder 3, the first and/or second openings 12, 13 have passed through tangency point A or are precisely at tangency point A, a negative pressure is applied to the first and/or second openings 12, 13 by the first and/or second air supply means 14, 15, securing only blanks 10, or only waste parts 9, or blanks 10 and waste parts 9 on the circumferential surface of transport cylinder 3 or on packing 5. When the blanks 10 in question and the waste parts 9 in question reach tangency point B as a result of the further rotation of transport cylinder 3, the first and/or second air supply means 14, 15 are preferably deactivated. As the negative pressure is no longer applied to the region of the first and/or second openings 12, 13, the blanks 10 and waste parts 9 are no longer secured and are thus released. The securing of the leading edges of substrate sheets 1 by means of gripper system 17 is also released at tangency point B. When the third openings 32 of stripping cylinder 4 reach tangency point B, and at tangency point B are opposite or directly upstream of a blank 10 in question, a negative pressure is applied to said openings. As a result of this negative pressure, a force acting to lift blanks 10 off of the surface of transport cylinder 3 is manifested. The negative pressure applied to the first and/or second openings 12, 13 of transport cylinder 3 is preferably also deactivated when the first and/or second openings 12, 13 in question are in the area of tangency point B. As a result of the negative pressure preferably applied to the third openings, blanks 10 and waste parts 9 and the frames of substrate sheets 1, including the leading edges of substrate sheets 1, which are still connected to one another by the residual tabs (whole sheets), are lifted off of transport cylinder 3 at tangency point B and transferred to stripping cylinder 4. The transfer of blanks 10 and waste parts 9 and the frames of substrate sheets 1 including the leading edges of substrate sheets 1 as whole sheets from transport cylinder 3 to stripping cylinder 4 can be supported by applying an overpressure to the first and/or second openings 12, 13. The supply of air to the first and/or second openings 12, 13 is preferably switched from negative pressure to overpressure when the first and/or second openings 12, 13 reach tangency point B. The further rotation of stripping cylinder 4 transports the whole sheets secured by negative pressure further in the direction of conveyor belt 29, until the whole sheets reach the transfer point or transfer region E of stripping cylinder 4 and conveyor belt 29. At the transfer point or transfer region E of stripping cylinder 4 and conveyor belt 29, a suction effect is preferably applied by the conveyor belt 29, preferably embodied as a suction belt, on the side of the whole sheets that faces away from stripping cylinder 4. When the third openings 32 in question reach the transfer point or transfer region E, the negative pressure applied to them is deactivated. Following deactivation of the negative pressure at third openings 32, an overpressure can preferably be built up. As a result of the acting forces described here, the whole sheets are transferred from stripping cylinder 4 to conveyor belt 29 at the transfer point or in the transfer region E. Conveyor belt 29 runs on deflecting rollers, at least one of which is driven, and transports the whole sheets preferably to a stacking device or delivery device (not shown). Once the third openings 32 have passed through the transfer point or transfer region E, the negative pressure applied to them can be deactivated. This deactivation ends at least by the time the third openings 32 enter tangency point B again.

Figure 14:
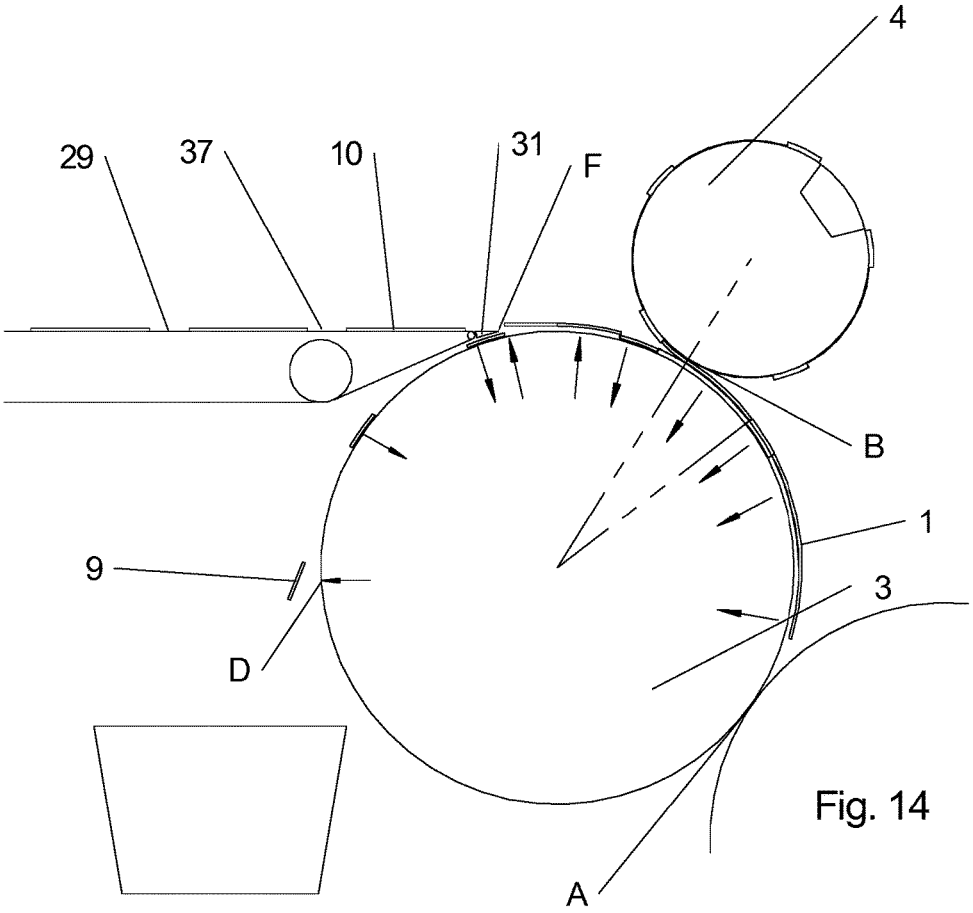

According to another preferred embodiment with or without stripping cylinder 4, a peeling device 31 (also called a peeling mechanism) is assigned to transport cylinder 3, as is clear from FIG. 14, in particular. Peeling device 31 preferably includes a supporting surface, extending in the direction of a virtual tangent to transport cylinder 3. The supporting surface may be aligned horizontally. Further preferably, a revolving conveyor belt 29, which may be configured as a suction belt revolving over deflecting rollers, is assigned to peeling device 31. Peeling device 31 is preferably assigned to transport cylinder 3 at the 12 o'clock position thereof, or immediately adjacent to said position, as viewed in the direction of rotation of transport cylinder 3. Conveyor belt 29 preferably includes a transport region 37, which is horizontal or is inclined by an angle of less than 10 degrees from horizontal. According to a preferred embodiment, the supporting surface formed on peeling device 31 and the transport region 37 lie in one and the same virtual plane. More preferably, the supporting surface and transport region 37 extend in the direction of a virtual tangent to transport cylinder 3.

Transport cylinder 3 and optional stripping cylinder 4 may be configured in accordance with the embodiments of transport cylinder 3 and stripping cylinder 4 already described in particular in conjunction with the subjects according to FIGS. 9 through 13.

The function of peeling device 31 is, in particular, to lift with the help of peeling device 31, processed substrate sheets 1, waste parts 9 or blanks 10 off of the surface of transport cylinder 3 or the surface of the packing 5 that is placed thereon, and to feed these to conveyor belt 29, which transports these parts away. An additional transport system in the form of an additional conveyor belt 30, for example, may be attached to conveyor belt 29. An overlap region, in which processed substrate sheets 1 or blanks 10 and/or waste parts 9 can be transferred from conveyor belt 29 to additional conveyor belt 30, is preferably formed between conveyor belt 29 and additional conveyor belt 30.

It is self-evident that, instead of the additional conveyor belt 30, another suitable transport system may also be provided that would receive processed substrate sheets 1 or blanks 10 and/or waste parts 9 from conveyor belt 29.

In place of additional conveyor belt 30, a container may also be arranged beneath conveyor belt 29 to receive waste parts 9.

In addition to conveyor belt 29, an additional transport system 76 may also be associated directly with transport cylinder 3, i.e. forming a transfer region or a transfer point between transport cylinder 3 and the additional transport system 76 for processed substrate sheets 1 or blanks 10 and/or waste parts 9. This additional transport system 76 is preferably embodied as a sheet guiding cylinder or sheet guiding drum or as a chain conveyor system with gripper bars, or as a conveyor belt.

The operating method of an embodiment as preferably illustrated by FIG. 14 can be described as follows. The embodiment of the device illustrated here for treating substrates 1 is preferably a component of a sheet-fed printing machine. The sheet-fed printing machine may comprise one or more printing units 6. Further preferably, two processing cylinders between which substrate 1 can be inserted are preferably arranged upstream of the embodiment illustrated in FIG. 14, wherein substrate 1 undergoes processing as it passes through by means of tool parts that are active in the cylinder nip and are selected from the group composed of cutting tools, punching tools, creasing tools and perforating tools. One of the processing cylinders is illustrated as a semicircle in FIG. 14. The processing cylinder is preferably embodied as a sheet transport cylinder and has a sheet holding system. The sheet transport cylinder transfers a processed substrate sheet 1 to transport cylinder 3 at tangency point A between transport cylinder 3 and the upstream sheet transport cylinder. In said transfer, the sheet holding system of the sheet transport cylinder releases the processed substrate sheet 1, while the gripper system, in particular suction gripper system 17, of transport cylinder 3, receives the processed, in particular surface-cut, substrate sheet 1. Substrate sheet 1 preferably comprises an outer margin, to which waste parts 9 and blanks 10 are attached via what are known as residual tabs. Transport cylinder 3 carries a packing 5. Packing 5 has perforations and is provided with depressions at the locations where it acts on blanks 10. Perforations are introduced in packing 5 in the region of blanks 10, at the locations where the first openings 12 are formed, whereas the second openings 13 are covered by packing 5, i.e. are sealed, in the region of blanks 10. Perforations are also introduced in packing 5 in the region of waste parts 9, at the locations where the second openings 13 are formed, whereas the first openings 12 are covered by packing 5, i.e. are sealed, in the region of waste parts 9. When, as a result of the rotation of transport cylinder 3, the first openings 12 have passed through tangency point A or are precisely at tangency point A, a negative pressure is applied to the first openings 12 by first air supply means 14, securing blanks 10 on the circumferential surface of transport cylinder 3 or on packing 5. The further rotation of transport cylinder 3 causes the blanks 10 and waste parts 9 secured by the negative pressure to reach tangency point B, which is formed between transport cylinder 3 and stripping cylinder 4. At tangency point B, the raised regions of the packing 5 disposed on stripping cylinder 4 contact the surfaces of waste parts 9, and press waste parts 9 into the depressions in the packing 5 secured on transport cylinder 3. This causes the residual tabs that connect waste parts 9 to the frame or to good parts (blanks) 10 to tear. A negative pressure that secures waste parts 9 on the circumferential surface of transport cylinder 3 or on packing 5 is preferably applied via second air supply means 15 to the second openings 13 in the area of waste parts 9, preferably at tangency point B. Alternatively, the negative pressure may be applied via the second air supply means 15 to the second openings 13, in the region of waste parts 9, as early as tangency point A or immediately thereafter. As a result of the rotation of transport cylinder 3, blanks 10 and waste parts 9 are transported past tangency point B until they ultimately reach transfer point F between transport cylinder 3 and peeling system 31. Before the blanks 10 in question reach transfer point F between transport cylinder 3 and peeling device 31, first air supply means 14 of transport cylinder 3 are switched from a suction air supply to a blower air supply. The negative pressure in the area of first openings 12 is relieved, so that blanks 10 are no longer secured and are repelled from the surface of transport cylinder 3 or from its packing 5 to the extent to which the overpressure is built up at the first openings 12. At least the leading edges of blanks 10, as viewed in the direction of rotation of transport cylinder 3, thus protrude beyond peeling device 31 in the radial direction of transport cylinder 3. Peeling device 31 is aimed into the gap formed between the leading edges of blanks 10 and the surface of transport cylinder 3 or the surface of its packing 5. The rotation of transport cylinder 3 pushes the blanks 10 onto the supporting surface of peeling device 31 until they reach the carrying region of conveyor belt 29, which transports blanks 10 away. In contrast to the first openings 12, the negative pressure applied to the second openings 13 by second air supply means 15 is maintained while the second openings 13 pass through tangency point B and until they reach release point D. When release point D is reached, the negative pressure applied to the second openings 13 is deactivated. In a preferred embodiment, an overpressure can additionally be applied to the second openings 13 when the second openings 13 enter the region of release point D. With the aforementioned method steps, not only is the securing of waste parts 9 deactivated upon reaching release point D, but the lifting off of waste parts 9 is supported by pneumatic means, in addition to the effect of gravitational force. In the area of release point D, the leading edge of substrate sheets 1, in addition to waste parts 9, is preferably also released by gripper system 17.

A further operating method of an embodiment as is preferably illustrated in FIG. 14 relates to whole-sheet processing or whole-sheet inspection and will be described in the following. The sheet transport cylinder transfers a processed substrate sheet 1 to transport cylinder 3 at tangency point A between transport cylinder 3 and the upstream sheet transport cylinder. In said transfer, the sheet holding system of the sheet transport cylinder releases the processed substrate sheet 1, while the gripper system 17, in particular suction gripper system 17, of transport cylinder 3, receives the processed, in particular surface-cut, substrate sheet 1. Substrate sheet 1 preferably comprises an outer margin, to which waste parts 9 and blanks 10 are attached via what are known as residual tabs. Transport cylinder 3 carries a packing 5. Packing 5 has perforations. The perforations are introduced in packing 5 at the locations where first and/or second openings 12, 13 are formed. When, as a result of the rotation of transport cylinder 3, the first and/or second openings 12, 13 have passed through tangency point A or are precisely at tangency point A, a negative pressure is applied to the first and/or second openings 12, 13 by the first and/or second air supply means 14, 15, securing only blanks 10, or only waste parts 9, or blanks 10 and waste parts 9 on the circumferential surface of transport cylinder 3 or on packing 5. The further rotation of transport cylinder 3 causes the blanks 10 and waste parts 9 to pass through tangency point B. At tangency point B, there is no contact between the waste parts 9 or the blanks 10 and other elements. Stripping cylinder 4 is thrown off of transport cylinder 3. When the blanks 10 in question and the waste parts 9 in question reach transfer point F between transport cylinder 3 and peeling device 31, first and/or second air supply means 14, 15 are deactivated or are preferably switched to blower air supply. The negative pressure in the region of the first and/or second openings 12, 13 is no longer applied, and blanks 10 and waste parts 9 and the frames of substrate sheets 1, including the leading edges of substrate sheets 1 that are still connected to one another by the residual tabs (whole sheets) are no longer secured and are thus released at transfer point F and are preferably lifted off of the surface of transfer cylinder 3 or packing 5 in a targeted manner. The securing of the leading edges of substrate sheets 1 by gripper system 17 is also canceled at the transfer point or in transfer region C. As a result of the rotation of transport cylinder 3, the whole sheets are then pushed over the supporting surface of peeling device 31 until they enter the active region of conveyor belt 29, which transports them away.

Figure 15:
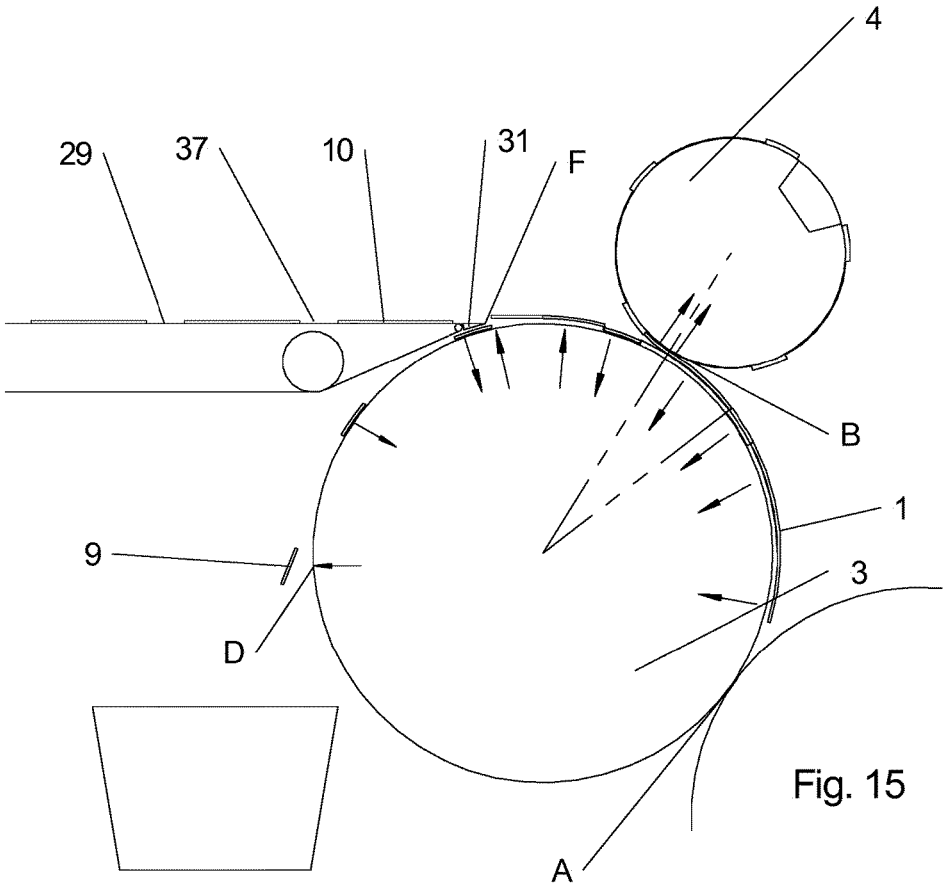

The operating method of an embodiment as is illustrated preferably in FIG. 15 can be described as follows. The sheet transport cylinder transfers a processed substrate sheet 1 to transport cylinder 3 at tangency point A between transport cylinder 3 and the upstream sheet transport cylinder. In said transfer, the sheet holding system of the sheet transport cylinder releases the processed substrate sheet 1, while the gripper system 17, in particular suction gripper system 17, of transport cylinder 3, receives the processed, in particular surface-cut, substrate sheet 1. Substrate sheet 1 preferably comprises an outer margin, to which waste parts 9 and blanks 10 are attached via what are known as residual tabs. Transport cylinder 3 carries a packing 5. Packing 5 has perforations and is provided with depressions at the locations where it acts on blanks 10. Perforations are introduced in packing 5 in the region of blanks 10, at the locations where the first openings 12 are formed, whereas the second openings 13 are covered by packing 5, i.e. are sealed, in the region of blanks 10. Perforations are also introduced in packing 5 in the region of waste parts 9, at the locations where the second openings 13 are formed, whereas the first openings 12 are covered by packing 5, i.e. are sealed, in the region of waste parts 9. When, as a result of the rotation of transport cylinder 3, the first openings 12 have passed through tangency point A or are precisely at tangency point A, a negative pressure is applied to the first openings 12 by first air supply means 14, securing blanks 10 on the circumferential surface of transport cylinder 3 or on packing 5. The further rotation of transport cylinder 3 causes the blanks 10 and waste parts 9 secured by the negative pressure to reach tangency point B, which is formed between transport cylinder 3 and stripping cylinder 4. At tangency point B, the raised regions of the packing 5 disposed on stripping cylinder 4 contact the surfaces of waste parts 9, and press waste parts 9 into the depressions in the packing 5 secured on transport cylinder 3. This causes the residual tabs that connect waste parts 9 to the frame or to good parts 10 to tear. Packing 5, secured on stripping cylinder 4, has perforations corresponding to third openings 32 in stripping cylinder 4. The perforations are formed in the region of packing 5 in which the packing is not raised and does not interact in rolling contact with blanks 10. When the third openings 32 in stripping cylinder 4 reach tangency point B, and at tangency point B are opposite a blank 10 in question, a negative pressure is applied to said openings. As a result of this negative pressure, a force acting to lift blanks 10 off of the surface of transport cylinder 3 is manifested. The negative pressure at the third openings 32 in stripping cylinder 4 is deactivated as soon as these openings have left the region of tangency point B again, or a few angular degrees thereafter, in particular 10 degrees. The negative pressure applied to first openings 12 is preferably deactivated when the first openings 12 in question are in the area of tangency point B. This ensures that the blank 10 in question will be lifted off of the surface of transport cylinder 3 briefly, i.e., for a few angle degrees, in particular 10 degrees of rotational movement of transport cylinder 3, under the action of the negative pressure at the third openings 32 in stripping cylinder 4. This measure additionally supports the separation of blanks 10 from waste parts 9, because these are moved actively in different directions for at least a short period of time. At tangency point B, a negative pressure is preferably applied via the second air supply means 15 to the second openings 13, in the region of waste parts 9, securing the waste parts 9 on the circumferential surface of transport cylinder 3 or on packing 5. Alternatively, the negative pressure may be applied via the second air supply means 15 to the second openings 13, in the region of waste parts 9, as early as tangency point A or immediately thereafter. As a result of the rotation of transport cylinder 3, blanks 10 and waste parts 9 are transported past tangency point B until they ultimately reach transfer point F between transport cylinder 3 and peeling device 31. Before the blanks 10 in question reach transfer point F between transport cylinder 3 and peeling device 31, the first air supply means 14 of transport cylinder 3 are switched from a suction air supply to a blower air supply. The negative pressure in the area of first openings 12 is relieved, so that blanks 10 are no longer secured and are repelled from the surface of transport cylinder 3 or from its packing 5 to the extent to which the overpressure is built up at the first openings 12. At least the leading edges of blanks 10, as viewed in the direction of rotation of transport cylinder 3, thus protrude beyond peeling device 31 in the radial direction of transport cylinder 3. Peeling device 31 is aimed into the gap formed between the leading edges of blanks 10 and the surface of transport cylinder 3 or the surface of its packing 5. The rotation of transport cylinder 3 pushes the blanks 10 onto the supporting surface of peeling device 31 until they reach the carrying region of conveyor belt 29, which transports blanks 10 away. In contrast to the first openings 12, the negative pressure applied to the second openings 13 by second air supply means 15 is maintained while the second openings 13 pass through tangency point B and until they reach release point D. When release point D is reached, the negative pressure applied to the second openings 13 is deactivated. In a preferred embodiment, an overpressure can additionally be applied to the second openings 13 when the second openings 13 enter the region of release point D. With the aforementioned method steps, not only is the securing of waste parts 9 terminated upon reaching release point D, but the lifting off of waste parts 9 is supported by pneumatic means, in addition to the effect of gravitational force. In the area of release point D, the leading edge of substrate sheets 1, in addition to waste parts 9, is preferably also released by gripper system 17.

Figure 17:
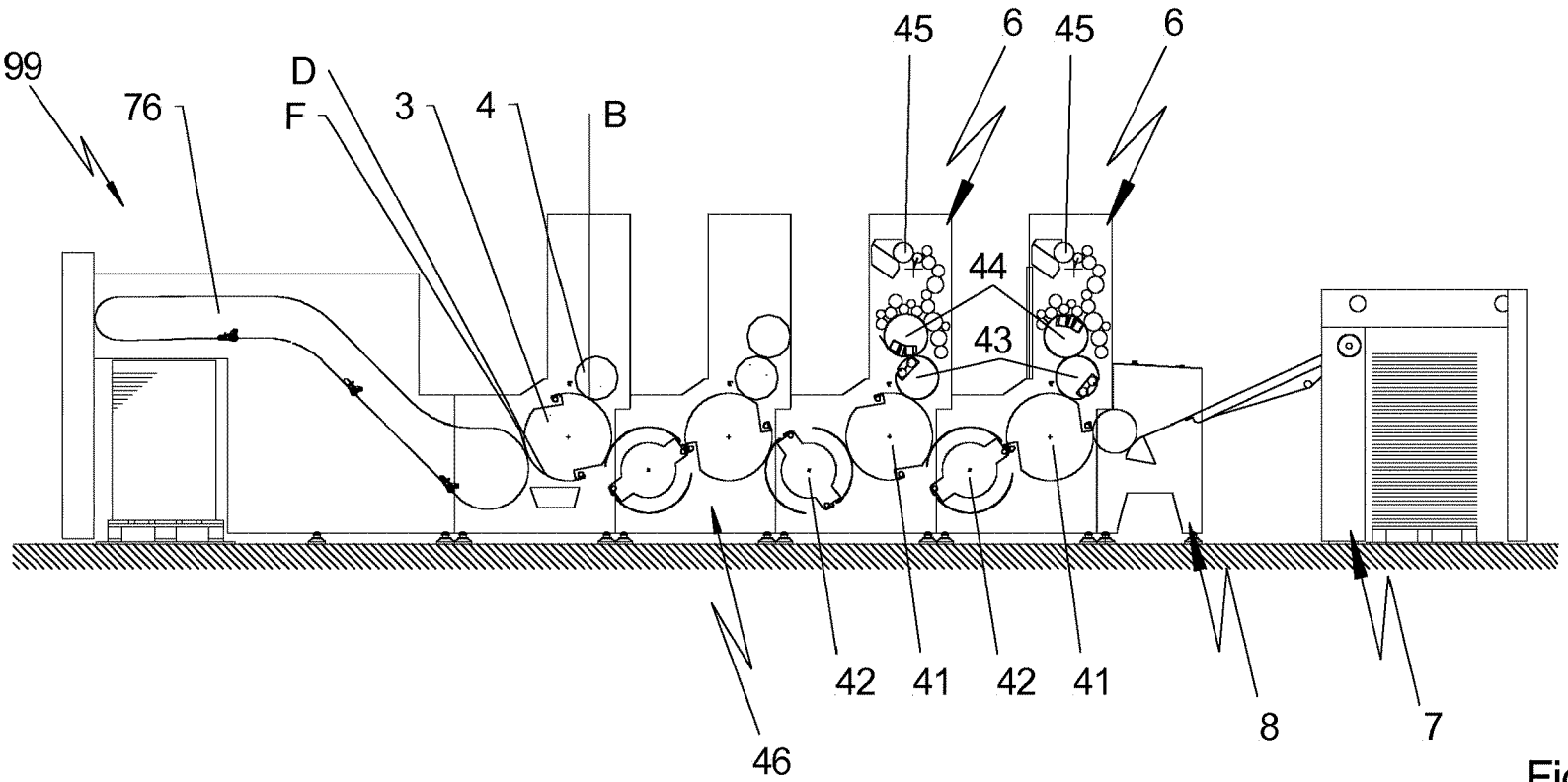
FIG. 17 shows a schematic diagram of a sheet processing machine with a schematic diagram of a device for treating substrates

In place of conveyor belt 29, an additional transport system 76 may also be assigned directly to transport cylinder 3, i.e. forming a transfer region or a transfer point between transport cylinder 3 and the additional transport system 76 for processed substrate sheets 1 or blanks 10 and/or waste parts 9. This additional transport system 76 is preferably embodied as a sheet guiding cylinder or sheet guiding drum or sheet guiding system, in particular as a chain conveyor system with gripper bars, or as a conveyor belt. An embodiment that includes a chain conveyor system with gripper bars as a component of delivery 99 of a sheet-fed printing machine is illustrated in FIG. 17.

The chain conveyor system contains drawing means that are moved via driving and deflecting means and drive gripping devices, in particular gripper bars, for conveying substrate. The gripping devices have securing elements for receiving and securing the sheet-type substrates 1. Clamping and/or suction grippers in particular can be used as the securing elements for gripping the edges of the substrate. Additional gripping devices for the trailing edges of the substrate are provided in refinements not shown here. The sheet conveyor system, embodied here as a chain conveyor system, contains chains, on which gripper bars for transporting the substrates 1 are arranged, and which are laid over and driven by chain wheels and are guided in laterally arranged guide rails, not shown here. Substrates 1 are conveyed by the gripper bars in the transport direction to the delivery pile supported on a pallet, for example, or on some other type of transport base. The gripper bars preferably contain leading-edge clamping grippers having gripper fingers that cooperate with gripper bars and are arranged at a distance from one another on a gripper shaft and can be controlled thereby.

For the reliable transport of substrates 1 held by the gripper bars, a substrate guiding device and a dryer, for example, are provided in delivery 99. The substrate guiding device has substrate guide plates which face the gripper bars and are provided with blower air nozzles and extend over the width of the machine. Blower modules, by which the blower air nozzles are supplied with blower air, are provided beneath the substrate guide plate, so that a supporting air cushion is formed between the substrate guide plate and the substrates 1 transported by the gripper bars. To be able to control the heating of the substrate guide plate in the region of the dryer, a coolant circuit may be integrated. To prevent substrates 1 from sticking together on the delivery pile, a separating agent applicator device, not further specified, in particular a powdering device, preferably combined with a device for suction removal of the powder, is preferably provided in the area of delivery 99. Upstream of the delivery pile, a braking device, not further specified, is provided, for decelerating the substrates 1 released by the gripper bars. The braking device may include rotating suction rings and/or revolving suction belts or may be embodied as an after-gripper system. The substrates 1 decelerated by the braking device are deposited at front stops and are thus deposited aligned on the delivery pile. The delivery pile is preferably lowered by the thickness of the deposited substrate in question, preferably by a pile lifting drive, so that the pile surface always assumes an approximately constant level.

A further operating method of an embodiment as preferably illustrated in FIG. 17 will be described below. The substrates 1 to be processed are provided as a pile of substrate sheets in feed unit 7, and are separated from this substrate sheet pile and fed, one after the other, to either one or a plurality of printing units 6 and printed therein or, if no printing units 6 are provided, are sent directly to processing unit 46. The processing of substrate sheets 1 takes place in processing unit 46. For this purpose, substrate sheets 1 are inserted one after the other into a cylinder nip formed between two processing cylinders, and are punched, so that from each substrate sheet 1, a punched sheet (processed substrate sheet 1) comprising at least one blank 10 and at least one waste part 9 with a frame enclosing these parts is formed, wherein blank 10, waste part 9 and frame are attached to one another via material connections that have not been severed completely. The processing cylinders may be configured as tool-carrying punching cylinders or may be embodied as printing cylinders 41 and rubber packing cylinder 43 of a sheet-fed printing machine. Substrate sheets 1, which have now been processed, are preferably transferred to transport cylinder 3 by a sheet transport cylinder at tangency point A between transport cylinder 3 and the upstream sheet transport cylinder. In said transfer, the sheet holding system of the sheet transport cylinder releases the processed substrate sheet 1, while the gripper system 17, in particular suction gripper system 17, of transport cylinder 3, receives the processed, in particular surface-cut, substrate sheet 1. Transport cylinder 3 preferably carries a packing 5. Packing 5 has perforations. The perforations are introduced in packing 5 at the locations where openings 12, 13, in particular first and/or second openings 12, 13, are formed. When, as a result of the rotation of transport cylinder 3, the openings 12 have passed through tangency point A or are precisely at tangency point A, a negative pressure is applied to the openings 12, 13 by the first and/or second air supply means 14, 15, securing blanks 10, or only waste parts 9, or blanks 10 and waste parts 9 on the circumferential surface of transport cylinder 3 or on packing 5. The further rotation of transport cylinder 3 causes the waste parts 9 secured by the negative pressure to reach tangency point B, which is formed between transport cylinder 3 and stripping cylinder 4. At tangency point B, the raised regions of the packing 5 disposed on stripping cylinder 4 contact the surfaces of waste parts 9, and press waste parts 9 into the depressions in the packing 5 secured on transport cylinder 3. The material connections that have not been completely severed and that connect waste parts 9 to the frame or to blanks 10 are thereby separated, i.e. torn. It is self-evident that the raised regions of packing 5 may alternatively be configured as depressed regions. In that case, the corresponding regions of stripping cylinder 4 are preferably raised. What is crucial is that the raised or depressed regions on transport cylinder 3 and on a stripping cylinder 4 associated therewith are configured such that the material connections that have not been completely severed are separated, i.e. torn.

As a result of the rotation of transport cylinder 3, blanks 10 and waste parts 9 are transported past tangency point B until they ultimately reach transfer point F between transport cylinder 3 and additional transport system 76. At transfer point F, the frames with blanks 10 attached to them solely via material connections that have not been completely severed are transferred to a pile-forming unit, in particular a delivery 99, more preferably each to a gripper bar of delivery 99, from which each is then preferably transported to a pile carrier and stacked.

When waste parts 9 reach transfer point F between transport cylinder 3 and additional transport system 76, the first and/or second air supply means 14, 15 of transport cylinder 3 maintain the supply of suction air to first and/or second openings 12, 13. Only when waste parts 9 reach release point D is the supply of suction air to the first and/or second openings 12, 13 stopped or preferably switched to a supply of blower air, so that waste parts 9 are released or are preferably actively repelled.

In conjunction with the separation processes between transport cylinder 3 and stripping cylinder 4, it has proven advantageous in preferred embodiments to eliminate only selected material connections that have not been completely severed and to maintain others in a targeted manner, in order to maintain the stability required for further transport of the frame and the blanks 10 connected thereto. It is therefore preferably provided to eliminate the incompletely severed material connections between blanks 10 and the frame part at the rear in the direction of transport of the frame, and to maintain the incompletely severed material connections between blanks 10 and the frame part at the front in the direction of transport of the frame, between transport cylinder 3 and stripping cylinder 4. In addition, the incompletely severed material connections between blanks 10 and the frame parts at the sides in the direction of transport of the frame may also be eliminated.

More preferably, the incompletely severed material connections among a plurality of blanks 10 are maintained between transport cylinder 3 and stripping cylinder 4.

The method described above can be carried out in particular using one of the described embodiments of the device for treating substrates 1, in particular using the device illustrated in FIG. 17 and described in reference to FIG. 17.

Figure 16:
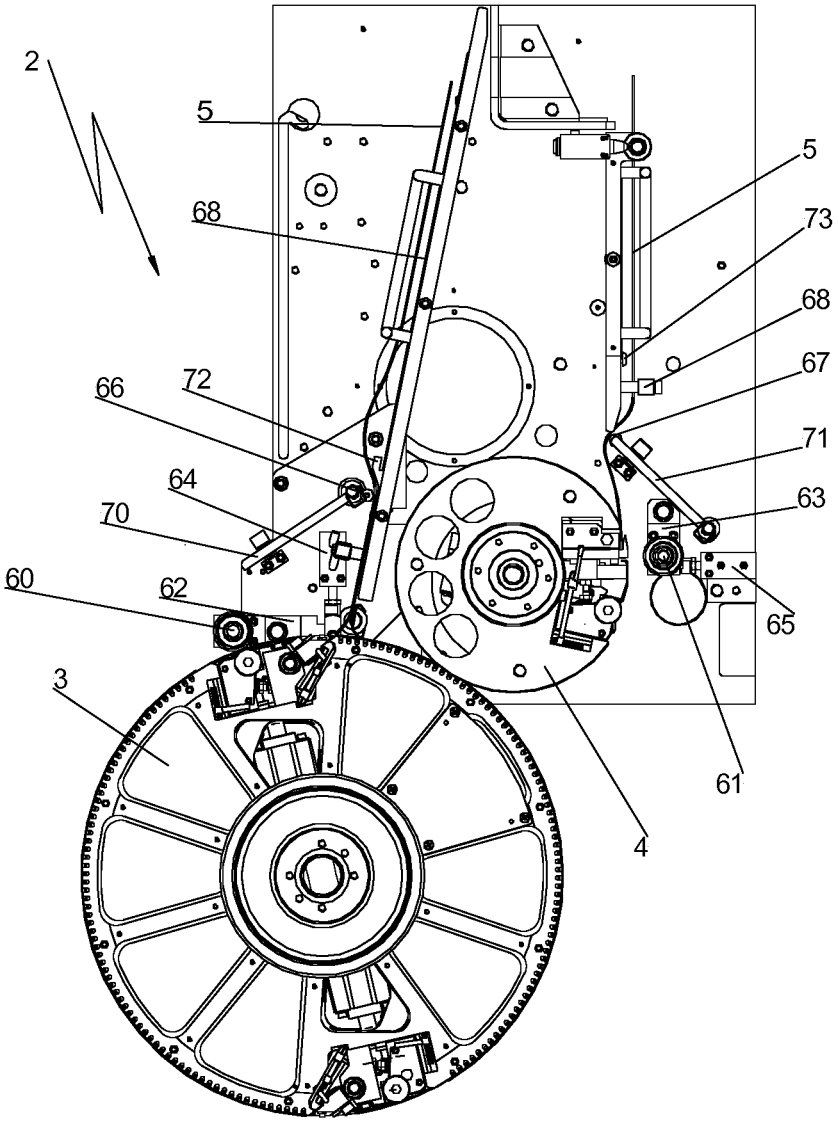
FIG. 16 shows a transport cylinder with means for loading a packing

A further preferred embodiment is illustrated in FIG. 16, in particular, and will be described in greater detail below. This embodiment comprises a transport cylinder 3, which may correspond in its basic configuration to the transport cylinder 3 illustrated in FIG. 2, so that reference is herewith made to FIG. 2 in particular and to the associated parts of the description, and additionally to FIGS. 3 to 8, including the associated parts of the description. A stripping cylinder 4, which may correspond in its basic configuration to the stripping cylinder 4 illustrated in FIG. 10, may be assigned to transport cylinder 3, so that reference is herewith made to FIG. 10 and to the associated parts of the description.

Transport cylinder 3 and/or stripping cylinder 4 preferably include(s) means for securing a replaceable packing 5.

In the case of a preferred embodiment having a transport cylinder 3 without an associated stripping cylinder 4, the means for loading replaceable packing 5 are assigned to transport cylinder 3. In the case of an additional preferred embodiment having a transport cylinder 3 with an associated stripping cylinder 4, the means for loading replaceable packing 5 are assigned to transport cylinder 3 or to stripping cylinder 4 or to both transport cylinder 3 and stripping cylinder 4.

When assigned to transport cylinder 3, the means for loading replaceable packing 5 comprise a pressing means 60 that can optionally be thrown onto and off of transport cylinder 3, in particular pivoted up to and away from said cylinder, and when assigned to stripping cylinder 4, said means comprise a pressing means 61 that can optionally be thrown onto and off of stripping cylinder 4, in particular pivoted up to and away from said cylinder. Pressing means 60, 61 is preferably embodied as a roller or cylinder. The roller or cylinder may have an elastic surface, in particular a rubber surface. The roller or cylinder is rotatably mounted and may extend over the entire width of the cylinder in question (transport cylinder 3 or stripping cylinder 4) or over only a portion of its width. The cylinder may likewise be formed by a plurality of rollers arranged flush with one another in terms of their axes of rotation. The roller or cylinder is freely movable, or in a preferred embodiment is motor driven. More preferably, the roller or cylinder may also be assigned a motor that drives and/or brakes the roller or cylinder. A suitable braking device, for example in the form of friction brakes, may also be assigned to the cylinder.

The roller or cylinder is preferably mounted on a displaceable pressing arm 62, 63, to which a drive means 64, 65, preferably in the form of a linear drive 64, 65, more preferably in the form of a pneumatic cylinder 64, 65 or an electric linear motor, is assigned. Pressing arm 62, 63 is pivotable about a pivot point.

The means for loading replaceable packing 5 preferably comprise a guide roller 66, 67 and/or a guide rail 68, 69. More preferably, the at least one guide roller 66, 67 is associated with a movably mounted guard 70, 71. A sensor that detects the position of guard 70, 71 may be assigned to said guard.

The means for loading replaceable packing 5 may additionally comprise a magazine 72, 73 capable of accommodating a plurality of packings 5. Magazine 72, 73 is configured to hold at least one packing 5, while at least one additional packing 5 that may be replaced by the stored packing 5 is disposed on transport cylinder 3 or on stripping cylinder 4. In addition to holding a packing 5 to be loaded, magazine 72, 73 is preferably also capable of receiving a packing 5 that has been or will be removed. Magazine 72, 73 preferably has different holding spaces for a packing 5 to be loaded and a packing 5 to be removed.

The means for loading replaceable packing 5 may additionally include a prepositioning device, in particular positioning pins. The prepositioning device is preferably assigned to magazine 72, 73. To arrange a packing 5 on transport cylinder 3, transport cylinder 3 is first rotated into a receiving position intended for receiving packing 5. Transport cylinder 3 may be rotated with the help of a dedicated drive assigned thereto, or via a gearwheel train which acts as a drive mechanism connecting transport cylinder 3 to additional cylinders, and which is driven by means of a main drive. In the receiving position, the means for securing the leading edge of replaceable packing 5 are at least approximately opposite magazine 72. In this position, the bottom edge of the packing 5 to be loaded (which corresponds to the leading edge when said packing is secured on transport cylinder 3) is on a magazine 72 configured as a rail 68, preferably an angled rail. According to a preferred embodiment, positioning means in the form of positioning pins, for example, which correspond to positioning recesses in packing 5, are assigned to magazine 72. If said positioning means are configured as positioning pins, the positioning recesses in packing 5 are opposite the positioning pins, and packing 5 is pre-aligned toward the positioning pins due to the placement of the positioning recesses. To load packing 5, the bottom edge of packing 5 is released by rail 72 by means of the motorized pivoting or rotation of rail 72, or by the leading edge of packing 5 being lifted manually off of rail 72. Guard 70, which is in turn pivotably mounted and preferably carries a guide roller 66 at its end, is pivoted manually or by motor such that an access opening is produced, through which packing 5 can be supplied to the means for securing packing 5. As soon as the leading edge of packing 5 has passed through the access opening opened up by guard 70 and guide roller 66, guard 70 is pivoted back into its starting position manually or by a motor, so that guide roller 66 contacts packing 5, and packing 5 is thereby guided on its path to the clamping gap formed between clamping jaw 22 and striking surface 24. Packing 5 is preferably supplied by virtue of gravitational force or alternatively by motor propulsion or manually. When the leading edge of packing 5 has reached the clamping gap, lever 21 is pivoted, thereby securing the leading edge of packing 5 between clamping jaw 22 and striking surface 24. Transport cylinder 3 is then rotated counterclockwise by motor. Once the leading edge of packing 5 has passed beneath pressing roller 60 by virtue of the rotation of transport cylinder 3, linear drive 64 is actuated. Linear drive 64 pivots pressing lever 62 until pressing roller 60 is in contact with packing 5 and presses the same against the circumferential surface of transport cylinder 3. Transport cylinder 3 is then rotated further counterclockwise by motor, thereby pressing packing 5 against the circumferential surface of transport cylinder 3 in the area of action of pressing roller 60, until the trailing edge of packing 5 has reached the clamping gap formed between clamping jaw 47 and striking surface 48.

When the trailing edge of packing 5 has entered the clamping gap, clamping shaft 50 is rotated, thereby closing the clamping gap. Pressing roller 60 is then pivoted away. When packing 5 is to be removed from transport cylinder 3, pressing roller 60 remains pivoted away from transport cylinder 3. Either the leading edge or the trailing edge of packing 5 is released from transport cylinder 3, and transport cylinder 3 is then rotated, conveying packing 5 back in the direction of magazine 72. Finally, the edge of packing 5, which has remained secured up to that time, is released.

The arrangement of a packing 5 on stripping cylinder 4 is comparable to the arrangement of a packing 5 on transport cylinder 3, and therefore, reference is preferably made thereto unless differences are expressly described.

To arrange a packing 5 on stripping cylinder 4, stripping cylinder 4 is first rotated into a receiving position intended for receiving packing 5. Stripping cylinder 4 may be rotated with the help of a dedicated drive associated therewith, or via a gearwheel train which acts as a drive mechanism connecting transport cylinder 3 to additional cylinders and which is driven by means of a main drive. Stripping cylinder 4 is preferably driven by a dedicated drive, whereas transport cylinder 3 is driven via a gearwheel train which acts as a drive mechanism connecting transport cylinder 3 to additional cylinders and which is driven by means of a main drive.

In the receiving position, the means for securing the trailing edge of replaceable packing 5 are at least approximately opposite magazine 73. In this position, the bottom edge of the packing 5 to be loaded (which corresponds to the trailing edge when said packing is secured on stripping cylinder 4) is on a magazine 73 comprising holding pins. According to a preferred embodiment, the holding pins are embodied as positioning means in the form of positioning pins that correspond to positioning recesses in packing 5. If said positioning means are configured as positioning pins, the positioning recesses in packing 5 are opposite the positioning pins, and packing 5 is pre-aligned toward the positioning pins due to the placement of the positioning recesses. To load packing 5, the bottom edge of packing 5 is released by the holding pins in that the holding pins are retracted, or in that the trailing edge of packing 5 is lifted manually off of the holding pins. The pivotably mounted guard 71, which preferably carries a guide roller 67 at its end, is pivoted manually or by motor such that an access opening is produced, through which packing 5 can be supplied to the means for securing packing 5.

As soon as the trailing edge of packing 5 has passed through the access opening opened up by guard 71 and guide roller 67, guard 71 is pivoted back into its starting position manually or by a motor, so that guide roller 67 contacts packing 5, and packing 5 is thereby guided on its path to the clamping gap formed between clamping jaw 22 and striking surface 24. Packing 5 is preferably loaded by virtue of gravitational force or alternatively by motor propulsion or manually. When the trailing edge of packing 5 has reached the clamping gap, pneumatic muscle 25 is released, thereby securing the trailing edge of packing 5 between clamping jaw 22 and striking surface 24. Stripping cylinder 4 is then rotated clockwise by motor. Once the trailing edge of packing 5 has passed beneath pressing roller 61 by virtue of the rotation of stripping cylinder 4, linear drive 65 is actuated. Linear drive 65 pivots pressing lever 63 until pressing roller 61 is in contact with packing 5 and presses the same against the circumferential surface of stripping cylinder 4. Stripping cylinder 4 is then rotated further clockwise by motor, thereby pressing packing 5 against the circumferential surface of stripping cylinder 4 in the area of action of pressing roller 61, until the leading edge of packing 5 has reached the clamping gap formed between clamping jaw 47 and striking surface 48. When the leading edge of packing 5 has entered the clamping gap, clamping shaft 50 is rotated, thereby closing the clamping gap. Pressing roller 61 is then pivoted away. When packing 5 is to be removed from stripping cylinder 4, pressing roller 61 remains pivoted away from stripping cylinder 4. Either the leading edge or the trailing edge of packing 5 is released from stripping cylinder 4, and stripping cylinder 4 is then rotated, conveying packing 5 back in the direction of magazine 73. Finally, the edge of packing 5, which has remained secured up to that time, is released.

While preferred embodiments of a device for treating substrates, in accordance with the present invention, have been set forth fully and completely hereinabove, it would be apparent to one of skill in the art that various changes could be made thereto, without departing from the true spirit and scope of the subject invention, which is accordingly to be limited only by the appended claims.

The invention claimed is:

1. A device for treating substrates (1) having a separation system (2), with which processed substrate (1) can be separated into at least one waste part (9) and at least one blank (10), wherein the separation system (2) comprises a transport cylinder (3) and a stripping cylinder (4) associated therewith, and the transport cylinder (3) has means for securing a replaceable packing (5), along with first and second openings (12, 13) which, when the packing (5) is secured, are at least partially covered by perforations that may be formed in the packing (5), wherein first air supply means (14) for supplying air to the first openings (12) and second air supply means (15) for supplying air to the second openings (13) independently of the supply of air to the first openings (12) are provided, and the first and/or the second air supply means (14, 15) are switchable between a suction air supply and a blower air supply.

2. The device according to claim 1, comprising two processing cylinders (96, 97), between which the substrate (1) can be inserted, wherein the substrate (1) undergoes processing as it passes through the cylinder nip by means of tool parts acting therein from the group composed of cutting tools, punching tools, creasing tools, perforating tools and grooving tools, and the processing cylinders (96, 97) are disposed upstream of the separation system (2).

3. The device according to claim 1, wherein the first and/or the second air supply means (14, 15) are configured to be switched between suction air supply and blower air supply dependent upon the angular position of the respective openings (12, 13) being supplied with air.

4. The device according to claim 1, wherein the first air supply means (14) switches off the supply of air to the first openings (12) or switches from suction air supply to blower air supply when the first openings (12) in question reach a first release point by virtue of the rotation of the transport cylinder (3) about its axis of rotation (16).

5. The device according to claim 1, wherein the second air supply means (15) switches off the supply of air to the second openings (13) or switches from suction air supply to blower air supply when the second openings (13) in question reach a second release point by virtue of the rotation of the transport cylinder (3) about its axis of rotation (16).

6. The device according to claim 1, wherein the first and second openings (12, 13) are each arranged in alternation in the circumferential direction of the transport cylinder (3) or in the axial direction of the transport cylinder (3).

7. The device according to claim 1, wherein the first and/or the second openings (12, 13) are configured as grooves or holes.

8. The device according to claim 1, wherein the separation system (2) is a component of a sheet-fed printing machine.

9. The device according to claim 8, wherein at least one printing unit (6) is disposed upstream of the separation system (2).

10. The device according to claim 1, wherein the processing cylinders (96, 97) are disposed between the at least one printing unit (6) and the separation system (2).

11. The device according to claim 1, wherein the transport cylinder (3) has a gripper system (17) for securing the leading edges of sheet-type substrate (1).

12. The device according to claim 11, wherein the gripper system (17) for securing the leading edges of sheet-type substrate (1) is configured as a suction gripper system (17) or as a clamping gripper system (17).

13. The device according to claim 12, wherein the suction gripper system (17) is configured to generate a suction region, the length of which in the axial direction of the transport cylinder (3) is equal to a multiple of its length in the circumferential direction.

14. The device according to claim 13, wherein the length of the suction region in the axial direction of the transport cylinder (3) is adjustable.

15. The device according to claim 12, wherein the suction gripper system (17) is mounted on the means for securing the packing (5).

* * * * *